US006521389B2

(12) United States Patent
Yamada et al.

(10) Patent No.: US 6,521,389 B2
(45) Date of Patent: Feb. 18, 2003

(54) SILVER HALIDE PHOTOGRAPHIC LIGHT-SENSITIVE MATERIAL AND PROCESSING METHOD THEREOF

(75) Inventors: Kohzaburoh Yamada, Minami-ashigara (JP); Masahiko Taniguchi, Minami-ashigara (JP); Takashi Hoshimiya, Minami-ashigara (JP); Hirokazu Kyota, Minami-ashigara (JP); Toshihide Ezoe, Minami-ashigara (JP); Shoji Yasuda, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/925,372

(22) Filed: Aug. 10, 2001

(65) Prior Publication Data

US 2002/0132179 A1 Sep. 19, 2002

(30) Foreign Application Priority Data

Aug. 11, 2000 (JP) ..... 200-245050

(51) Int. Cl.[7] ..... G03C 1/05

(52) U.S. Cl. ..... 430/264; 430/598; 430/564; 430/502; 430/503; 430/449; 430/546

(58) Field of Search ..... 430/264, 598, 430/564, 502, 503, 567, 546, 449

(56) References Cited

U.S. PATENT DOCUMENTS 4,385,108 A * 5/1983 Takagi et al. ..... 430/264
4,459,347 A * 7/1984 Parton et al. ..... 430/598
5,134,055 A 7/1992 Okamura et al.
5,190,850 A * 3/1993 Sakai ..... 430/264

FOREIGN PATENT DOCUMENTS

| | | |
|---|---|---|
| EP | 0 495 477 B1 | 7/1992 |
| JP | 2665692 | 6/1997 |
| JP | 2717525 | 11/1997 |

* cited by examiner

*Primary Examiner*—Geraldine Letscher
(74) *Attorney, Agent, or Firm*—Birch, Stewart, Kolasch & Birch, LLP

(57) ABSTRACT

A silver halide photographic light-sensitive material, which contains at least one compound of the formula (1):
Formula (1)

wherein PUG represents a nitrogen-containing heterocyclic group which is bonded to the adjacent carbonyl group through a nitrogen atom, the heterocyclic group directly or indirectly has at least one nitro group as its substituent(s) and can give a pKa value of 9 to 11, ph represents a phenyl group and directly or indirectly has at least one dissociating group as its substituent(s), Z represents a substituent being capable of substitution on the benzene ring, and p is 0 to 4.

17 Claims, No Drawings

SILVER HALIDE PHOTOGRAPHIC LIGHT-SENSITIVE MATERIAL AND PROCESSING METHOD THEREOF

FIELD OF THE INVENTION

The present invention relates to a silver halide photographic light-sensitive material, and a method for forming an ultra-high-contrast image, using the same, and particularly to an ultra-high-contrast silver halide photographic light-sensitive material used in the field of graphic arts, and a photographic image-forming method using the same.

BACKGROUND OF THE INVENTION

In order to make reproduction of a line original or a continuous tone original by halftone dots, better in the field of graphic arts, an image-forming system exhibiting a photographic property of ultra-high-contrast (particularly, $\gamma=10$ or more) is necessary.

As a method for obtaining a high-contrast photographic property, a lithographic development manner using the so-called "infectious development effect" has been hitherto used. This manner has the drawback that the developing solution used for it is unstable and thus is difficult to use. An image-forming system, in which development is performed with a developing solution having good storage stability, to obtain an ultra-high-contrast photographic property, has been desired. Examples thereof are disclosed in U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746, and the like. These relate to a system of developing a surface-latent-image-type silver halide photographic light-sensitive material, to which a hydrazine derivative is added, with a stable MQ (Metol-and-Quinol-containing) or PQ (1-phenyl-pyrazolidone-and-hydroquinone-containing) developing solution having a pH of 11.0 to 12.3, to obtain an ultra-high-contrast negative image whose $\gamma$ is over 10. According to this system, photographic properties of ultra-high-contrast and high sensitivity can be obtained, and a sulfite salt having a high concentration can be added to the developing solution. Therefore, stability of the developing solution against air oxidization is highly improved compared with any conventional lithographic developing solution.

In the field of photoengraving, a photographic light-sensitive material having good reproducibility of an original, a stable processing solution, easy replenishment, and the like, are desired, to cope with variation and complication of printed matters.

An original, particularly in the step of photographing an original comprising line images, is made by combining typeset characters, handwritten characters, illustrations, a photograph converted to halftone dots, and the like. In one original, therefore, image portions having different densities and line widths coexist being intermixed. A process camera, a photographic light-sensitive material, or an image-forming method for finishing such an original with high reproducibility, are intensely desired. In the plate-making of a catalogue or a large-sized poster, enlarging or scaling down of a dot photograph is widely carried out. In plate-making in which dots are enlarged, lines are made large, to give images in which dots fade. In plate-making in which dots are scaled down, the number of lines per inch becomes larger than that of an original, to give images in which dots are very fine. Accordingly, in order to keep halftone dot reproducibility good, an image-forming method that can give wider latitude is desired.

To improve reproduction of the original, JP-A-3-39952 (the term "JP-A-" as used herein means an unexamined published Japanese patent application), JP-A-3-174143, or the like disclose an ultra-high contrast silver halide light-sensitive material having a multilayer structure, which includes a layer containing a redox compound that releases a development inhibitor by oxidation, and a light-sensitive silver halide emulsion layer containing a hydrazine derivative. In this method, reproduction of an original is remarkably improved.

However, the improving of original-reproducibility is an eternal theme for graphic art light-sensitive materials. Thus, a system giving a better original-reproducibility is intensely desired.

The above method, in which a surface-latent-image-type silver halide photographic light-sensitive material, to which a hydrazine derivative is added, is processed in a developer having a pH of 11.0 to 12.3, makes it possible to improve the stability of a developer by using a high-density sulfurous acid preservative. However, in order to obtain an ultra-high contrast photographic image, it is necessary to use a developer having a relatively high pH value. In this case, the developer tends to be oxidized by air, and it is therefore necessary to replenish a large amount of a developer. In view of this, various ideas, in which an ultra-high contrast photographic image-forming system utilizing nuclei formation developing of a hydrazine compound is realized using a developer having a lower pH, have been attempted.

In order to obtain an ultra-high contrast image by using a stable developer having a pH of lower than 11.0, a method using a highly active hydrazine-type nucleating agent, and a nucleation accelerator, is disclosed in U.S. Pat. No. 4,269,929 (JP-A-61-267759), U.S. Pat. No. 4,737,452 (JP-A-60-179734), U.S. Pat. Nos. 5,104,769, and 4,798,780; JP-A-1-179939 and JP-A-1-179940; U.S. Pat. Nos. 4,998,604 and 4,994,365, and JP-A-8-272023.

However, the above method cannot be said to be satisfactory in the point of original-reproducibility in the case of using the aforementioned redox compound that releases a development inhibitor by oxidation. There is a strong need to develop light-sensitive materials having higher original-reproducibility. Also, in view of environmental problems, which have been greatly emphasized in recent years, there is a strong need to develop light-sensitive materials that cause less fluctuation in the photographic properties, and that also cause less fluctuation in original-reproducibility, with change in the composition of a developer, to decrease developer waste.

On the other hand, Japanese Patent No. 2,676,439 discloses a hydrazine-type redox compound containing a sulfo group, and JP-A-9-269553 discloses a hydrazine-type redox compound having in its molecule two sulfonamido groups, and a redox compound having phenol as its moiety. However, these compounds make it impossible to give a silver halide photographic light-sensitive material having good original-reproducibility, and suppressed black-spots (black peppers), high sensitivity, and high contrast, by use of a developing solution having a low pH.

SUMMARY OF THE INVENTION

The present invention is a silver halide photographic light-sensitive material, which comprises at least one compound represented by the following formula (1):

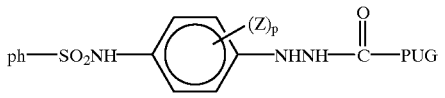

wherein PUG represents a nitrogen-containing heterocyclic group which is bonded to the adjacent carbonyl group through a nitrogen atom, the heterocyclic group is a heterocyclic group which directly or indirectly has at least nitro group as its substituent(s) and can give a pKa value of 9 to 11, ph represents a phenyl group and directly or indirectly has at least one dissociating group as its substituent(s), Z represents a substituent which is capable of substitution on the benzene ring, and p is an integer of 0 to 4.

Further, the present invention is a method of processing a silver halide photographic light-sensitive material, which comprises the step of developing the silver halide photographic light-sensitive material described above with a developing solution having a pH of 9.0–11.0 after image-wise exposure to light.

Other and further features and advantages of the invention will appear more fully from the following description.

DETAILED DESCRIPTION OF THE INVENTION

According to the present invention there are provided the following means.

(1) A silver halide photographic light-sensitive material, comprising at least one compound represented by the following formula (1):

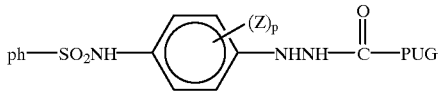

wherein PUG represents a nitrogen-containing heterocyclic group which is bonded to the adjacent carbonyl group through a nitrogen atom, the heterocyclic group is a heterocyclic group which directly or indirectly has at least one nitro group as its substituent(s) and can give a pKa value of 9 to 11, ph represents a phenyl group and directly or indirectly has at least one dissociating group as its substituent(s), Z represents a substituent which is capable of substitution on the benzene ring, and p is an integer of 0 to 4.

(2) The silver halide photographic light-sensitive material according to item 1, wherein the heterocyclic group represented by PUG is selected from indazoles.

(3) The silver halide photographic light-sensitive material according to item (1) or (2), wherein the dissociating group capable of direct or indirect substitution on the ph group is a benzenesulfonamido group having, as its substituent(s), at least one electron withdrawing group.

(4) The silver halide photographic light-sensitive material according to any one of items (1)-(3), wherein the compound represented by the formula (1) has, as its ballasting group(s), at least one group having as a moiety an alkyl or alkylene group having 9 or more carbon atoms.

(5) The silver halide photographic light-sensitive material according to any one of items (1)–(4), which comprises at least one nucleating agent.

(6) The silver halide photographic light-sensitive material according to item 5, which comprises at least one nucleation accelerator.

(7) A method of processing a silver halide photographic light-sensitive material, which comprises the step of developing the silver halide photographic light-sensitive material according to any one of items (1) to (6), with a developing solution having a pH of 9.0–11.0, after image-wise exposure to light.

The following will describe the compound represented by the formula (1) and used in the present invention in detail.

In the formula (1), Z is any substituent which is capable of substitution on the benzene ring.

In the present invention, examples of the optional substituent include a halogen atom (a fluorine atom, chlorine atom, bromine atom or iodine atom), alkyl group (including an aralkyl group, cycloalkyl group, active methine group and the like), alkenyl group, alkynyl group, aryl group, heterocyclic group, heterocyclic group containing a quaternary nitrogen atom (e.g., pyridinio group), acyl group, alkoxycarbonyl group, aryloxycarbonyl group, carbamoyl group, carboxyl group or its salts, sulfonylcarbamoyl group, acylcarbamoyl group, sulfamoylcarbamoyl group, carbazoyl group, oxalyl group, oxamoyl group, cyano group, thiocarbamoyl group, hydroxyl group, alkoxy group (a group containing a repeating unit of an ethyleneoxy group or a propyleneoxy group), aryloxy group, heterocyclic oxy group, acyloxy group, (alkoxy or aryloxy)carbonyloxy group, carbamoyloxy group, sulfonyloxy group, amino group, (alkyl, aryl or heterocyclic)amino group, nitrogen-containing heterocyclic group substituted at N, acylamino group, sulfonamido group, ureido group, thioureido group, imido group, (alkoxy or aryloxy)carbonylamino group, sulfamoylamino group, semicarbazido group, thiosemicarbazido group, hydrazino group, quaternary ammonio group, oxamoylamino group, (alkyl or aryl)sulfonylureido group, acylureido group, acylsulfamoylamino group, nitro group, mercapto group, (alkyl, aryl or heterocyclic)thio group, (alkyl or aryl)sulfonyl group, (alkyl or aryl)sulfinyl group, sulfamoyl group, acylsulfamoyl group, sulfonylsulfamoyl group or its salts, sulfo group or its salts, and groups containing a phosphoric acid amide or phosphate structure.

These substituents may be further substituted with those substituents listed above.

In the formula (1), ph represents a phenyl group and directly or indirectly has at least one dissociating group as its substituent(s). The dissociating group is a group or a moiety which has a proton which have such a low acidity that the proton can be dissociated in an alkali developing solution; or a salt thereof. Specific examples thereof include carboxyl (—COOH), phosphonic acid(—$PO_3H$), phosphoric acid (—$OPO_3H$), arylsulfonamido, alkylsulfonamido, sulfamoyl, acylsulfamoyl, carbamoylsulfamoyl, sulfonylureido, sulfonylcarbamoyl, sulfamoylcarbamoyl, acylcarbamoyl, sulfonylsulfamoyl, and active methylene groups; and salts thereof.

However, sulfo (—$SO_3H$), mercapto (—SH), —NH— contained in the nitrogen-containing heterocyclic ring, and hydroxy groups (—OH) are excluded. The arylsulfonamido group is limited to a benzenesulfonamido group having as its substituent(s) at least one electron withdrawing group. The electron withdrawing group means a substituent having a positive value of Hammett's substituent constant σp in the case that the electron withdrawing group is a group present at the ortho or para position in the benzene ring of the benzenesulfonamide, and the electron withdrawing group means a substituent having a negative value of Hammett's substituent constant σm in the case that the electron withdrawing group is a group present at the meta position in the benzene ring of the benzenesulfonamide. Specific examples of the substituent having a positive σp value include halogen atoms, acyl, alkoxycarbonyl, aryloxycarbonyl, carbamoyl, carboxyl, cyano, (alkyl or aryl)sulfonyl, sulfo or a salt thereof, sulfamoyl, nitro, thioureiodo, sulfonamido, imido, and alkyl having plural halogen atoms as substituents (for example, $—CF_3$). Specific examples of the substituent having a positive σm value include acylamino, ureido, (alkoxy or aryloxy)carbonylamino, sulfamoylamino, (alkyl, aryl or heterocyclic)thio, alkoxy, and aryloxy, as well as examples described as the substituent having a positive σp value. The benzene ring may be substituted with two or more electron withdrawing groups, or the benzene rings may be substituted with any group other than the electron withdrawing group.

In the case that the dissociating group represents an active methylene group, the active methylene group is a methylene or methine group exists between two or three electron withdrawing groups. The electron withdrawing group is an atom group having a positive value of Hammett's substituent constant σp. Specific contents thereof are the same as described above. The two or three electron withdrawing group may be bonded to each other to form a cyclic structure.

In the present invention, specific examples of the salt of the dissociating group include alkali metal ions, alkali earth metal ions, organic ammonium ion, and organic phosphonium ions, such as sodium, potassium, lithium, magnesium, and tetrabutylammonium cations.

The case that in the formula (1) the ph group indirectly has at least one dissociating group is a case in which the dissociating group is bonded to the ph group through a connecting group of not less than bivalence. The connecting group of not less than bivalence is specifically represented by the following formula:

$$\{(*)_m\text{-L1}\}_n\text{-L2-}^{**}$$

wherein L1 represents an alkylene or phenylene group, L2 represents —O—,—N($R_N$)—, —S—, —C(=O)—, —$SO_2$—, —SO—, —C(=S)—, —P(=O—), or a combination thereof, $R_N$ represents a hydrogen atom, or a monovalent alkyl or aryl group, * represents a position which is bonded to the dissociating group, ** represents a position which is bonded to the ph group in the formula (1), m is 1 or 2, and n is 1 or 2. The group represented by L1 or $R_N$ may have any substituent. Specific examples thereof are the same as described about the group represented by Z in the formula (1).

The ph group in the formula (1) may have, as a substituent, an optional substituent along with the dissociating group or substituents comprising the dissociating group. Specific examples of the optional substituent are the same as described about the substituent represented by Z in the formula (1).

The nitrogen-containing heterocyclic group represented by PUG in the formula (1) is a nitrogen-containing heterocyclic group which is bonded to the adjacent carbonyl group through its nitrogen atom, and can give a pKa value of 9 to 11. The nitrogen-containing heterocyclic group is a nitrogen-containing heterocyclic group which directly or indirectly has at least one nitro group as its substituent(s).

The pKa value is a pKa value obtained by means of a pH meter in accordance with an acid-base rule, using a mixed solution of acetonitrile and water (1:1) as a solvent.

Examples of the nitrogen-containing heterocyclic group represented by PUG in the formula (1) include 5- to 7-membered, aromatic or non-aromatic, monocyclic or condensed cyclic nitrogen-containing heterocyclic groups. Specific examples of the heterocyclic groups include benzotriazoles, benzimidazoles, indazoles, phthalimides, succinic imides, hydantoins, urazoles, o-sulfobenzimides, and isatins.

In the case that the nitrogen-containing heterocyclic group represented by PUG in the formula (1) indirectly has at least one nitro group as its substituent(s), the substituent for connecting the nitro group to the nitrogen-containing heterocyclic group represented by PUG is a divalent connecting group containing at least one arylene group. The connecting group may contain a group composed of an alkylene group, —O—, —N($R_{N'}$)—, —S—, —C(=O)—, —$SO_2$—, —SO—, —C(=S)—, —P(=O)—, or a combination thereof. $R_{N'}$ represents a hydrogen atom, or a monovalent alkyl or aryl group.

The following will describe a preferred range of the compound represented by the formula (1) used in the present invention.

Preferred examples of Z in the formula (1) include alkyl, acylamino, sulfonamido, ureido, sulfamoylamino, imido, hydroxyl, alkoxy, aryloxy, acyl, alkoxycarbonyl, aryloxycarbonyl, carbamoyl, (alkyl, aryl or heterocyclic) thio, sulfamoyl, cyano and nitro groups, and halogen atoms.

In the formula (1), p is preferably 0 or 1, and is more preferably 0.

In the formula (1), the dissociating group which the ph group has is preferably a carboxyl (—COOH), arylsulfonamido, alkylsulfonamido, sulfamoyl, acylsulfamoyl, carbamoylsulfamoyl, sulfonylureido, sulfonylcarbamoyl, sulfamoylcarbamoyl, acylcarbamoyl, sulfonylsulfamoyl, and active methylene group, or a salt thereof.

Particularly preferred are a carboxyl group or a salt thereof, arylsulfonamido, sulfonylureido, sulfonylcarbamoyl, and sulfamoylcarbamoyl groups.

The arylsulfonamide group herein is limited to a benzenesulfonamido group having at least one electron withdrawing group as its substituent(s). Examples of the electron withdrawing group (i.e., the substituent) present at the ortho or para position in the benzene ring of the benzenesulfonamido include halogen atoms, acyl, alkoxycarbonyl, carbamoyl, cyano, sulfamoyl, nitro, thioureido, sulfonamido, imido and alkyl groups which are substituted with plural halogen atoms (for example, $—CF_3$). Examples of the substituent present at the meta position include acylamino, ureido, (alkoxy or aryloxy)carbonylamino, sulfamoylamino, and alkoxy groups, as well as examples described as the substituent capable of positioning at the ortho or para position.

In the case that in the formula (1) the ph group indirectly has at least one dissociating group through a connecting group of not less than bivalence, preferred examples of the connecting group include *-alkylene-CONH—, *-alkylene-NHCONH—, *-alkylene-$SO_2$NH, *-alkylene-NH$SO_2$NH—, *-alkylene-NHCO—, *-alkylene-OCO—, *-phenylene-CONH—, *-phenylene-NHCONH—, *-phenylene-$SO_2$NH—, *-phenylene-NHCO—, *-phenylene-NH$SO_2$NH—, and *-phenylene-OCO—, wherein * is a position which is bonded to the dissociating group.

The heterocyclic group represented by PUG in the formula (1) is preferably a heterocyclic group which can give a pKa value of 9.5–11.0, and more preferably a heterocyclic group which can give a pKa value of 9.8–10.8. Preferred examples of the heterocyclic group represented by PUG in the formula (1) include benzimidazoles, indazoles, and benzotriazoles.

In the case that the heterocyclic group represented by PUG in the formula (1) is indirectly substituted with the nitro group, a phenyl group substituted with at least one nitro group is preferably bonded to the heterocyclic group through a single bond or a divalent connecting group. Preferred examples of the connecting radial include —NHCO—, —NHCONH—, —O-alkylene-, —$NHSO_2$—, —O—, —S—, and —S-alkylene.

In the case that PUG in the formula (1) represents any one of benzotriazoles, it is preferred that PUG is further indirectly substituted by the nitro group. It is also preferred that the phenyl group substituted with at least one nitro group is connected through a connecting group such as Btr—NHCO—, Btr—NHCONH—, Btr—O-alkylene- Btr—$NHSO_2$—, Btr—O—, Btr—S—, or Btr—S-alkylene, wherein Btr represents a position where substitution with any one of benzotriazoles occurs.

As the heterocyclic groups represented by PUG in the formula (1), indazoles are preferred. Indazoles wherein one nitro group and one or two electron withdrawing groups other than the nitro group are directly substituted at the same time are particularly preferred. In this case, specific examples of the substituent, other than the nitro group, which is used for direct substitution on the indazoles and can give a pKa of 9–11 include halogen atoms (chlorine, bromine, fluorine and iodine atoms), alkoxycarbonyl, aryloxycarbonyl, sulfamoyl, sulfonamido, cyano, carbamoyl, trifluoromethyl and carboxyl groups; a sulfo group and salts thereof; and acyl and formyl groups. Among these examples, halogen atoms, alkoxycarbonyl, sulfamoyl and carbamoyl are more preferred. Alkoxycarbonyl, and carbamoyl groups are particularly preferred, and alkoxycarbonyl groups (particularly, a methoxycarbonyl group) is most preferred.

The compound represented by the formula (1) used in the present invention may be a compound in which a ballasting group usually used in a immobile additive for photography, such as a coupler, or a polymer is incorporated. The compound containing the ballasting group is one of preferred examples in the present invention. The ballasting group in the present invention means a group having, as a moiety thereof, a straight or branched alkyl (or alkylene), alkoxy (or alkyleneoxy), alkylamino (or alkyleneamino), or alkylthio (or alkylenethio) group, each of which has 6 or more carbon atoms. The ballasting group is preferably a group having, as a moiety thereof, a straight or branched alkyl (or alkylene) group 9–24 carbon atoms.

The ballasting group may be introduced by substitution at any position in the compound represented by the formula (1), and is preferably introduced for direct or indirect substitution on the group represented by ph.

The polymer is, for example, any polymer described in JP-A-1-100530.

The compounds represented by formula (1) may contain a cationic group (e.g. a group containing a quaternary ammonio group, a group containing a quarternarized phosphorus atom, or a nitrogen-containing heterocyclic group containing a quarternarized nitrogen atom), a group containing a repeating unit of an ethyleneoxy group or a propyleneoxy group, an (alkyl-, aryl-, or heterocyclic-) thio group. Examples of the compounds containing these groups include those described, for example, in JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Patent No. 4006032.

The compound represented by the formula (1) containing an (alkyl, aryl or heterocyclic)thio group may be preferably used in the present invention. When an (alkyl, aryl or heterocyclic)thio group is contained in the compound represented by the formula (1), the thio group is preferably substituted on the group represented by ph in the formula (1) directly or indirectly.

The compounds represented by formula (1) may contain an adsorptive group capable of being adsorbed onto the silver halide. Examples of the adsorptive group include an alkylthio group, an arylthio group, a thiourea group, a thioamido group, a mercapto heterocyclic group, and a triazole group, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these adsorptive groups onto the silver halide may be modified into a precursor thereof. Examples of the precursor include those groups described in JP-A-2-285344.

Specific examples of the compounds represented by formula (I) are shown below. However, the present invention is not limited thereto.

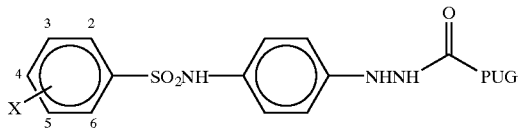

X = PUG =

1

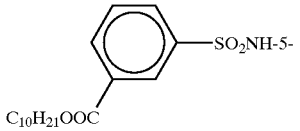

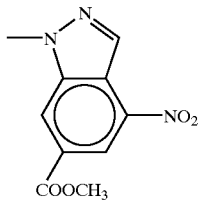

-continued
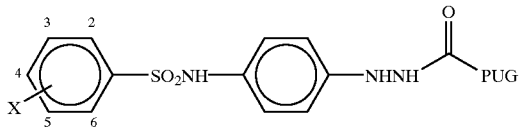
| | X = | PUG = |
|---|---|---|
| 2 | 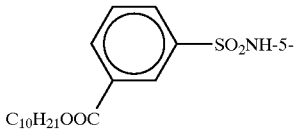  | 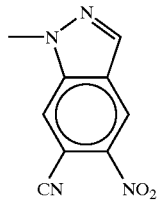  |
| 3 | 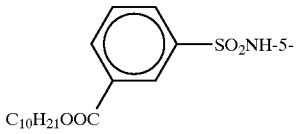  | 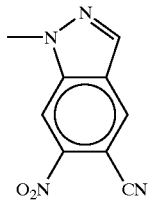  |
| 4 | 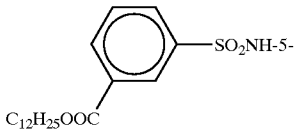  | 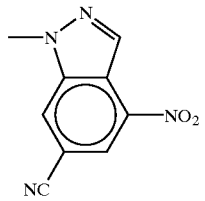  |
| 5 | 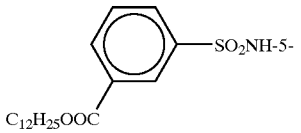  | 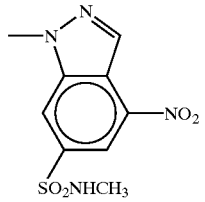  |
| 6 | 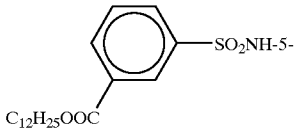  | 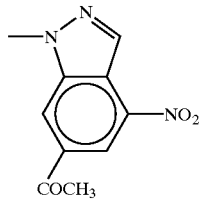  |
| 7 | 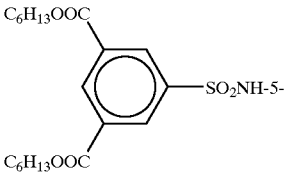  | 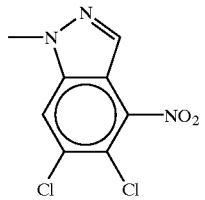  |

-continued
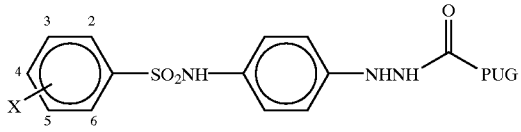
| | X = | PUG = |
|---|---|---|
| 8 | 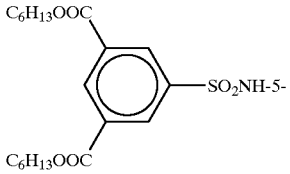 | 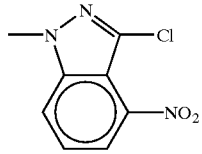 |
| 9 | 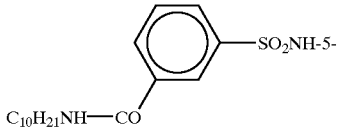 | 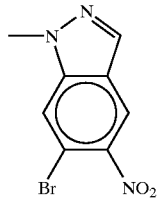 |
| 10 | 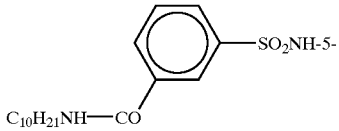 | 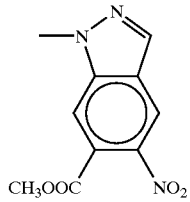 |
| 11 | 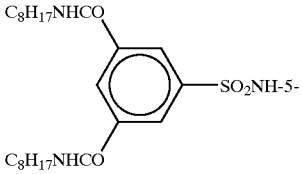 | 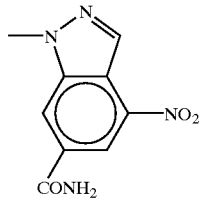 |
| 12 | 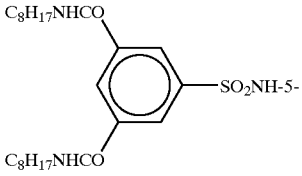 | 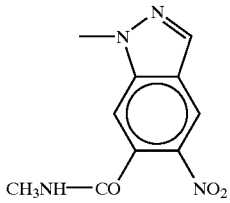 |
| 13 | 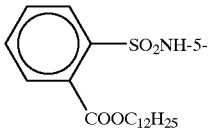 | 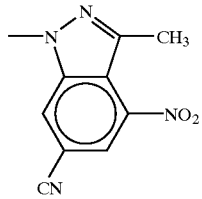 |

-continued
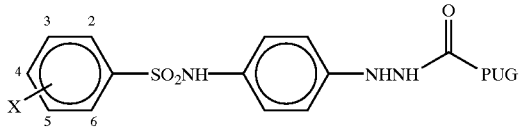
| | X = | PUG = |
|---|---|---|
| 14 | 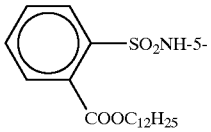  | 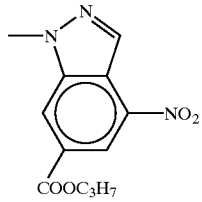  |
| 15 | 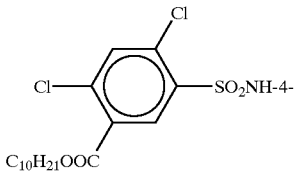  | 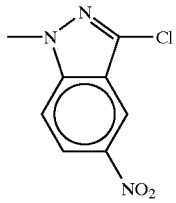  |
| 16 | 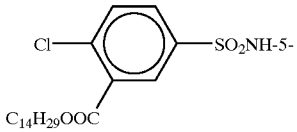  | 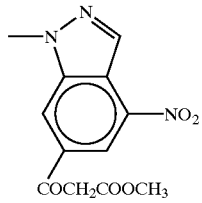  |
| 17 | 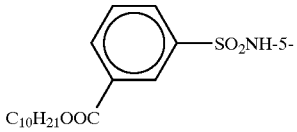  | 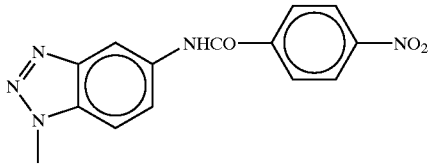  |
| 18 | 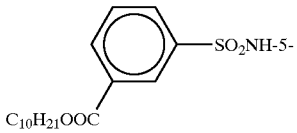  | 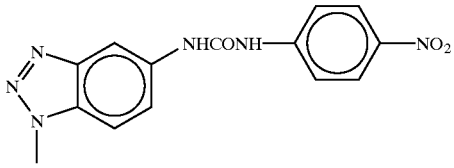  |
| 19 | 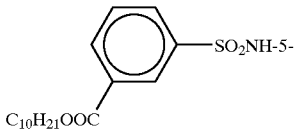  | 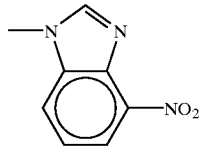  |
| 20 | 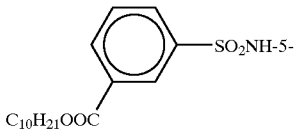  | 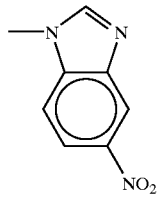  |

-continued
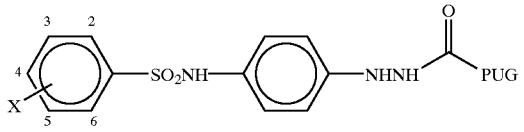
| | X = | PUG = |
|---|---|---|
| 21 | 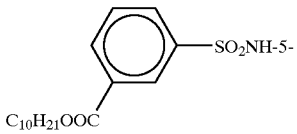  | 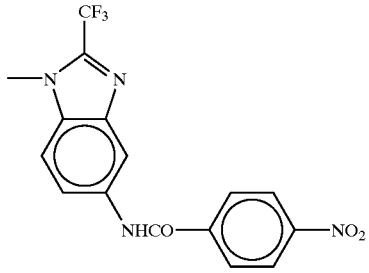  |
| 22 | 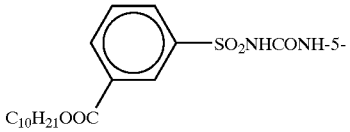  | 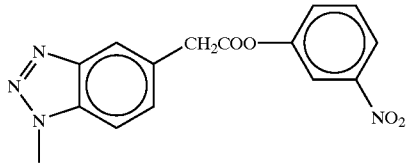  |
| 23 | 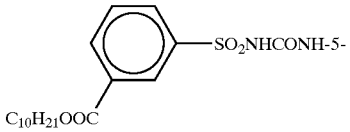  | 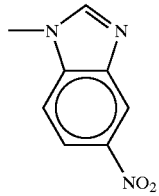  |
| 24 | 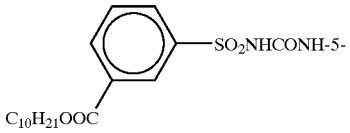  | 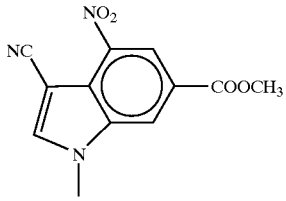  |
| 25 | $C_{11}H_{23}CONHSO_2NH$-5- | 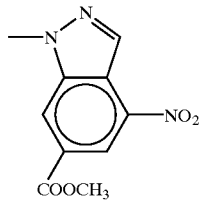  |
| 26 | $C_{12}H_{25}SO_2NHCONH$-5- | 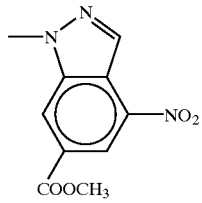  |

-continued
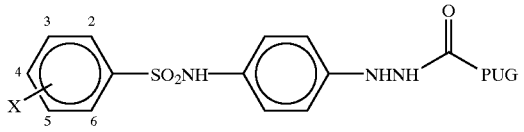
| | X = | PUG = |
|---|---|---|
| 27 | 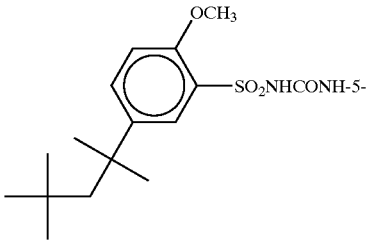  | 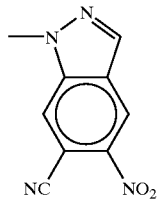  |
| 28 | 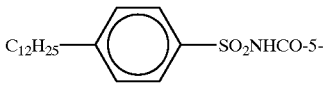  | 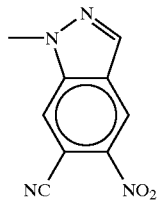  |
| 29 | HOOC—$(CH_2)_{11}$—NH—CO-5- | 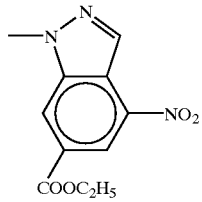  |
| 30 | HOOC—$(CH_2)_{14}$—OOC-5- | 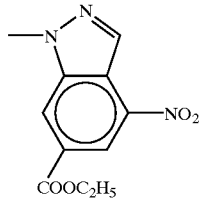  |
| 31 | HOOC—$(CH_2)_{11}$—CONH-5- | 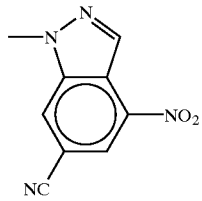  |
| 32 | 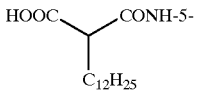  | 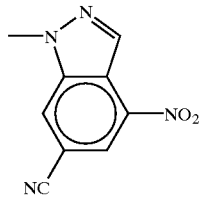  |

-continued
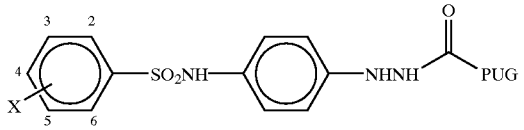
| | X = | PUG = |
|---|---|---|
| 33 | 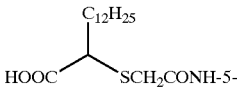 | 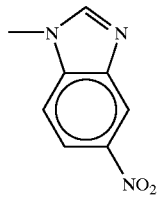 |
| 34 | 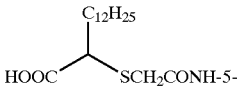 | 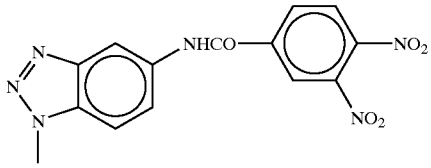 |
| 35 | 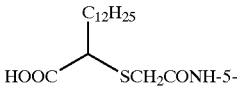 | 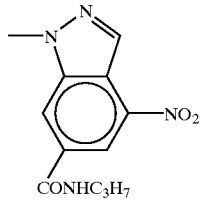 |
| 36 | 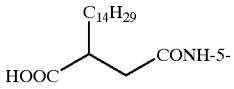 | 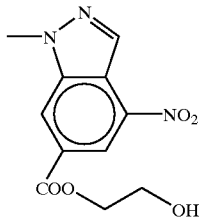 |
| 37 | 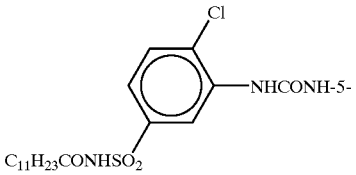 | 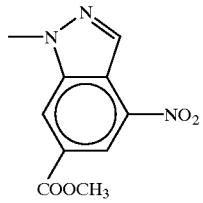 |
| 38 | 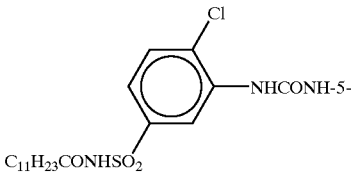 | 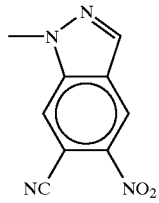 |

-continued
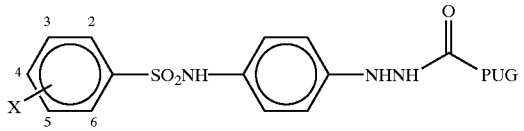
| | X = | PUG = |
|---|---|---|
| 39 | 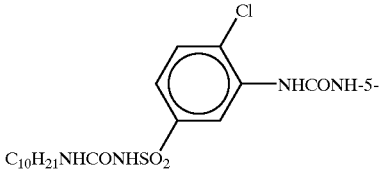  | 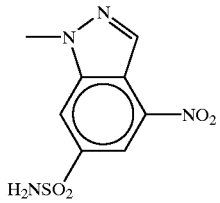  |
| 40 | 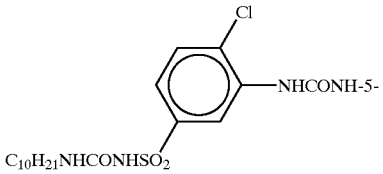  | 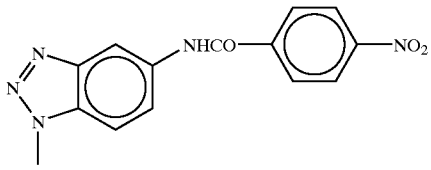  |
| 41 | 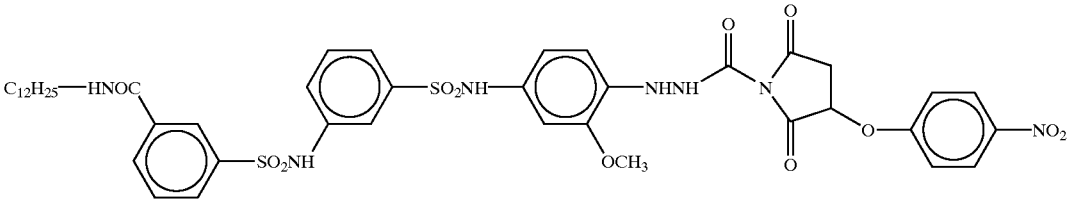  | |
| 42 | 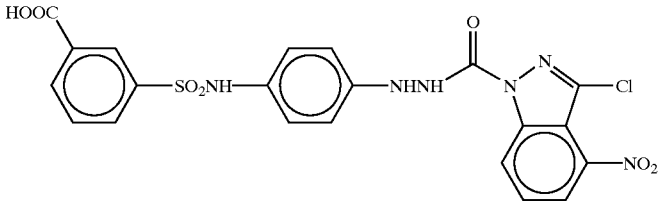  | |
| 43 | 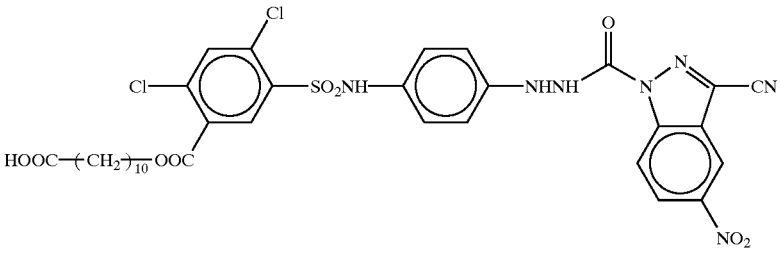  | |
| 44 | 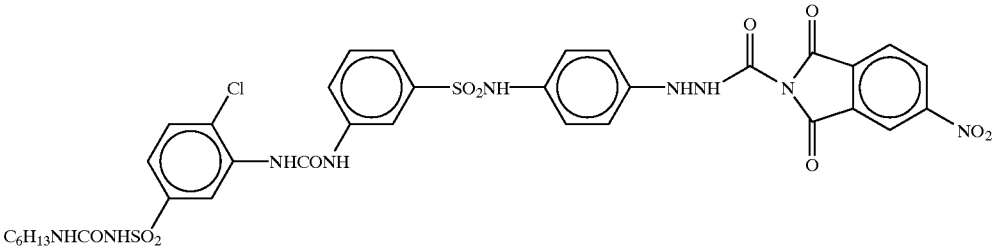  | |

-continued
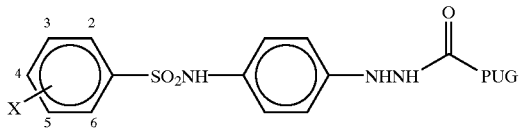
X = PUG =
45
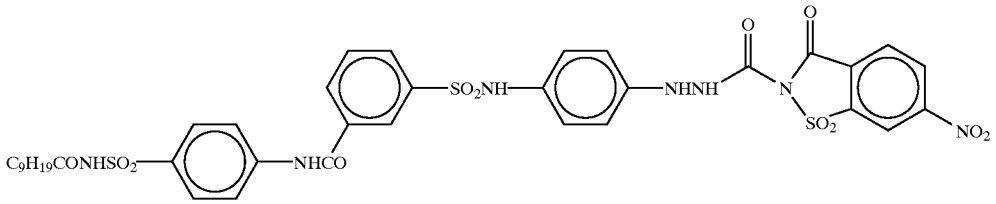
46
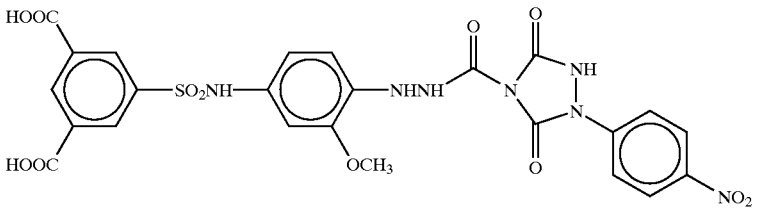
47
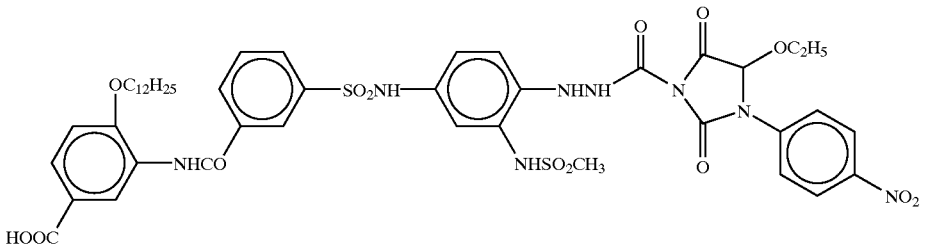
48
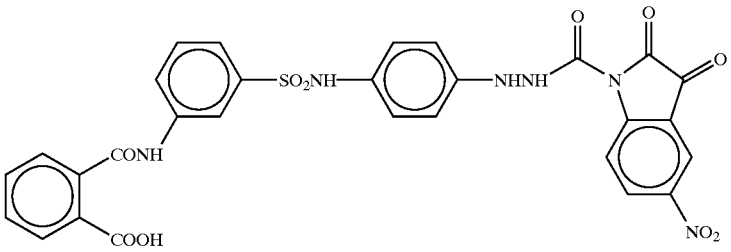
49
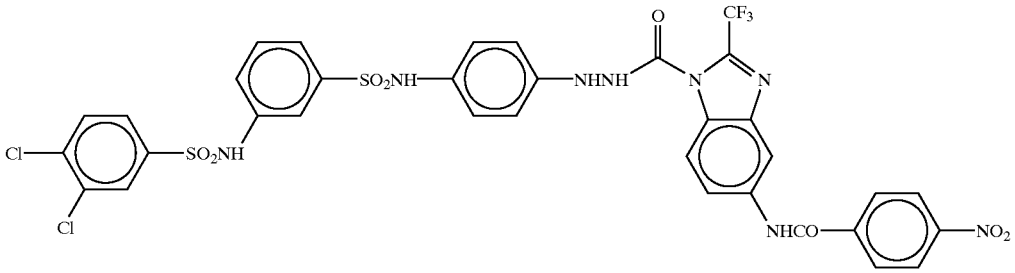
The compound used in the present invention can be synthesized by known methods. These methods are described in, for example, Japanese Patents No. 2,632,056 and No. 2,725,088. Specific examples thereof are described.
Synthetic Example 1 (Synthesis of the Exemplified Compound 1)
The exemplified compound 1 was synthesized in accordance with scheme 1.

Scheme 1

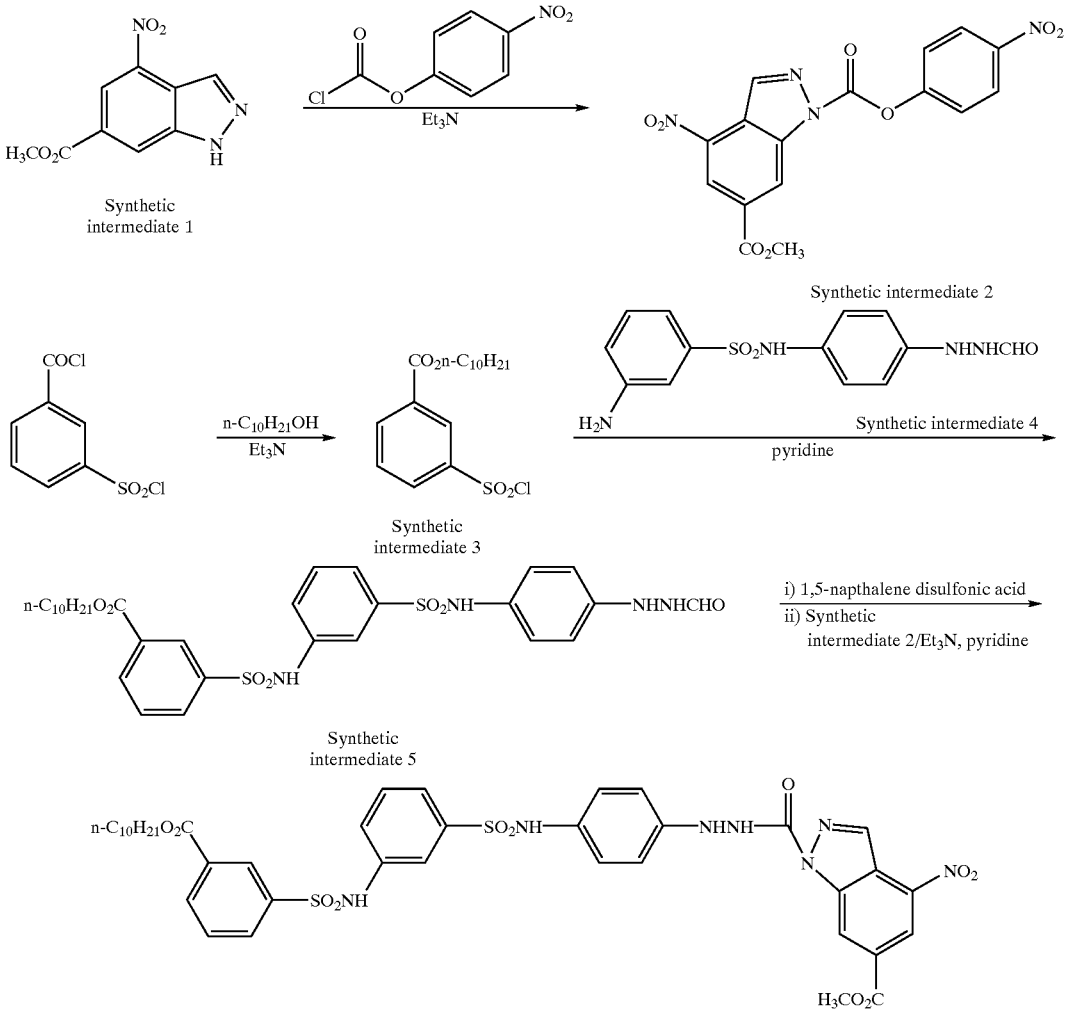

Exemplified compound 1

1) Synthesis of the synthetic intermediate-1

The synthetic intermediate-1 was synthesized in accordance with the method described in J. Chem. Soc. Perkin I 2593 (1979).

2) Synthesis of the synthetic intermediate-2

The synthetic intermediate-1 (450 g, 2.03 mol) was dissolved into 4 liters of dimethylacetoamide, and a mixed solution of 4 liters of acetonitrile and 297 ml of triethylamine. This reaction solution was cooled to 0° C., and then thereto was dropwise added a solution in which chloroformate-4-nitrophenyl (430 g, 2.13 mol) was dissolved into 2 liters of acetonitrile. After the addition, the solution was stirred at 5° C. for 30 minutes, and subsequently 4.5 liters of dilute hydrochloric acid was added thereto, so as to quench the reaction and precipitate a product. The precipitated solid was collected by filtration, washed with a mixed solution of acetonitrile and water (1:1), and then dried to give 740 g of the synthetic intermediate 2 (yield: 94%).

3) Synthesis of the synthetic intermediate-5

3-Chlorosulfonylbenzoic chloride (35.4 g, 0.148 mol) was dissolved into 130 ml of toluene, and then thereto was added 1-decanol (23.4 g, 0.148 ml). Thereafter, the solution was cooled to 0° C., and thereto was dropwise added a solution (100 ml) of triethylamine (20.6 ml, 0.148 mol) in toluene. The solution was reacted at 25° C. for 2 hours, and filtrated. The filtrate was concentrated under reduced pressure. The resultant crude product was dissolved into hexane, and the solution was treated with activated carbon and then concentrated under reduced pressure to give 45 g of the synthetic intermediate-3 as a light yellow liquid (yield: 84%).

The synthetic intermediate-4 (38.2 g, 0.125 mol) was added and dissolved into 30 ml of dimethylacetoamide, 60 ml of acetonitrile, and 11.1 ml of pyridine. To this solution was dropwise added a solution of the synthetic intermediate-3 (45 g, 0.125 mol) in ethyl acetate at −5° C. After the addition, the temperature of the reaction system was raised to room temperature, and the solution was stirred for 1 hour. Dilute hydrochloric acid was added thereto, so as to quench the reaction, and then extraction with ethyl acetate was performed. The organic phase was washed with salt water, dried over sodium sulfate, and concentrated under reduced pressure to give the synthetic intermediate-5 as an amorphous brown material.

4) Synthesis of the exemplified compound 1

The synthetic intermediate-5 (30.3 g, 0.048 mol) and 1,5-naphthalenedisulfonic acid tetrahydrate (17.3 g, 0.048 mol) were dissolved into a mixed solution of 40 ml of acetonitrile and 40 ml of isopropanol. The solution was heated and stirred at 50° C. for 2 hours. The resultant solution was cooled to 10° C., and thereto was added 80 ml of dimethylacetoamide. Furthermore, the synthetic intermediate-2 (16.7 g, 0.043 mol) was added thereto. To this reaction solution were successively added 13.4 ml of triethylamine and 3.5 ml of pyridine, and then the solution was stirred for 2 hours. The reaction mixture was treated with dilute hydrochloric acid, extracted with ethyl acetate and concentrated to give a crude material. This crude material was purified by recrystallization from methanol, to give 20.4 g of the exemplified compound 1 (yield: 50%).

Synthetic Example 2 (Synthesis of the Exemplified Compound 3)

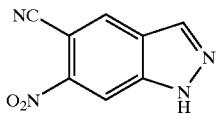

Synthetic intermediate 6

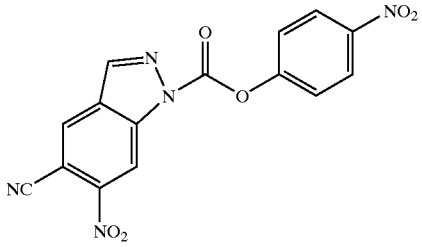

Synthetic intermediate 7

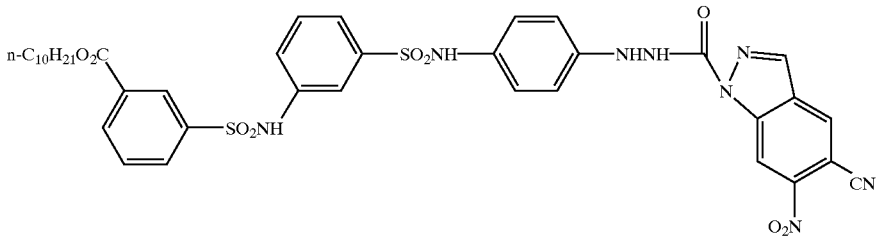

Exemplified compound 3

1) Synthesis of the synthetic intermediate-6

The synthetic intermediate-6 was synthesized in accordance with the method described in J. Org. Chem. 44, 4609 (1979).

2) Synthesis of the synthetic intermediate-7

The synthetic intermediate-7 was synthesized in the same manner as in the Synthetic example 1, except that the synthetic intermediate-6 was used instead of the synthetic intermediate-1.

3) Synthesis of the exemplified compound-3

The exemplified compound-3 was synthesized in the same manner as in the Synthetic example 1, except that the synthetic intermediate-7 was used instead of the synthetic intermediate-2.

In the present invention, the redox compound represented by the formula (1) are each used in an amount ranging from $1\times10^{-6}$ to $5\times10^{-2}$ mol and more preferably from $1\times10^{-5}$ to $1\times10^{-2}$ mol based on 1 mol of silver halide in all emulsion contained in the light-sensitive material. Also, two or more redox compounds may be used together. In the present invention, the redox compound represented by the formula (1) may be dissolved in a proper water-miscible organic solvent, for example, alcohols (methanol, ethanol, propanol or fluorinated alcohol), ketones (acetone or methyl ethyl ketone), dimethylformamide, dimethyl sulfoxide or methyl cellosolve upon use.

The redox compound may be used in the form of an emulsified dispersion produced mechanically by dissolving it by using an auxiliary solvent such as dibutyl phthalate, tricresyl phosphate, oils such as glyceryl triacetate and diethyl phthalate, ethyl acetate or cyclohexanone according to a conventionally well-known emulsion dispersion method. Alternatively, a powder of the redox compound can be dispersed in water by using a ball mill, colloid mill or ultrasonic waves according to a method known as the solid dispersion method upon use.

In the present invention, the redox compound represented by the formula (1) is added to a silver halide emulsion layer or other hydrophilic colloidal layers. The redox compound may also be added to at least one of plural silver halide emulsion layers.

Several examples of the practice will be shown below. However, the present invention is not limited to these examples.

Structure Example 1)

This structure has a silver halide emulsion layer containing the redox compound represented by the formula (1) in the present invention and a protective layer on a support. The emulsion layer or the protective layer may contain a hydrazine derivative described below as a nucleating agent.

Structure Example 2)

This structure has a first silver halide emulsion layer and a second silver halide emulsion layer in this order on a support. The first silver halide emulsion layer or a hydrophilic colloidal layer adjacent thereto contains the hydrazine derivative, and the second silver halide emulsion layer or a hydrophilic colloidal layer adjacent thereto contains the redox compound.

Structure Example 3)

This structure is the same as the Structure example 2) except that the order of two emulsion layers are reversed.

In the Structure examples 2) and 3), an intermediate layer containing a gelatin or a synthetic polymer (e.g., a polyvinyl acetate or a polyvinyl alcohol) may be provided between two light-sensitive emulsion layers.

Structure Example 4)

This structure has a silver halide emulsion layer containing the hydrazine derivative on a support and a hydrophilic colloidal layer containing the redox compound either on the emulsion layer or between the support and the silver halide emulsion layer.

A particularly preferable structure is the Structure example 2) or 3).

In the present invention, it is preferable to further contain at least one nucleating agent. Preferable nucleating agent is a hydrazine derivative represented by the following formula (D).

Formula (D)

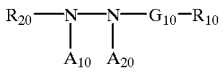

wherein $R_{20}$ represents an aliphatic group, an aromatic group, or a heterocyclic group; $R_{10}$ represents a hydrogen atom or a blocking group; $G_{10}$ represents a —CO—, —COCO—, —C(=S)—, —$SO_2$—, —SO—, or —PO($R_{30}$)— group (in which $R_{30}$ is selected from the same range of groups for $R_{10}$ as defined below, and $R_{30}$ and $R_{10}$ is the same or different), or an iminomethylene group; $A_{10}$ and $A_{20}$ each represent a hydrogen atom, or one of them is a hydrogen atom and the other is a substituted or unsubstituted alkylsulfonyl group, a substituted or unsubstituted arylsulfonyl group, or a substituted or unsubstituted acyl group.

In formula (D), the aliphatic group represented by $R_{20}$ is preferably a substituted or unsubstituted straight-chain, branched-chain, or cyclic alkyl, alkenyl, or alkynyl group, each having 1 to 30 carbon atoms.

In formula (D), the aromatic group represented by $R_{20}$ is a monocyclic or condensed-ring aryl group. Examples of the ring include a benzene ring and a naphthalene ring. The heterocyclic group represented by $R_{20}$ is a monocyclic or condensed-ring, saturated or unsaturated, aromatic or non-aromatic heterocyclic group. Examples of the ring include a pyridine, a pyrimidine, an imidazole, a pyrazole, a quinoline, an isoquinoline, a benzimidazole, a thiazole, a benzothiazole, a piperidine, and a triazine ring.

$R_{20}$ is preferably an aryl group, and especially preferably a phenyl group.

$R_{20}$ may be substituted with a substituent. Typical examples of the substituent include a halogen atom (fluorine, chlorine, bromine, or iodine), an alkyl group, which includes an aralkyl group, a cycloalkyl group, and an active methine group; an alkenyl group, an alkynyl group, an aryl group, a heterocyclic group, a quaternary nitrogen atom-containing heterocyclic group (e.g. a pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group; an alkoxy group, which group contains a group containing a repeating unit of an ethyleneoxy group or a propyleneoxy group; an aryloxy group, a heterocyclic oxy group, an acyloxy group, an (alkoxy or aryloxy)carbonyloxy group, a carbamoyloxy group, a sulfonyloxy group, an amino group, an (alkyl, aryl, or heterocyclic)amino group, an N-substituted nitrogen-containing heterocyclic group, an acylamino group, a sulfonamido group, a ureido group, a thioureido group, an isothioureido group, an imido group, an (alkoxy or aryloxy)-carbonylamino group, a sulfamoylamino group, a semicarbazido group, a thiosemicarbazido group, a hydrazino group, a quaternary ammonio group, an oxamoyl amino group, an (alkyl or aryl)sulfonylureido group, an acylureido group, an N-acylsulfamoylamino group, a nitro group, a mercapto group, an (alkyl, aryl, or heterocyclic)-thio group, an (alkyl or aryl)sulfonyl group, an (alkyl or aryl)sulfinyl group, a sulfo group or a salt thereof, a sulfamoyl group, an N-acylsulfamoyl group, a sulfonylsulfamoyl group or a salt thereof, and a group having a phosphonamide or phosphate structure.

These substitutes may be further substituted by any of the above substituents.

Preferable examples of the substituent that $R_{20}$ may have include an alkyl group having 1 to 30 carbon atoms, wherein an active methylene group is included; an aralkyl group, a heterocyclic group, a substituted amino group, an acrylamino group, a sulfonamido group, a ureido group, a sulfamoylamino group, an imido group, a thioureido group, a phosphonamido group, a hydroxy group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl, or heterocyclic)thio group, a sulfo group or a salt thereof, a sulfamoyl group, a halogen atom, a cyano group, and a nitro group.

In formula (D), $R_{10}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group, and a hydrazino group.

The alkyl group represented by $R_{10}$ is preferably an alkyl group having 1 to 10 carbon atoms. Specific examples of the alkyl group include a methyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a methanesulfonamidomethyl group, a benzenesulfonamidomethyl group, a hydroxymethyl group, a methoxymethyl group, a methylthiomethyl group, a phenylsulfonylmethyl group, and an o-hydroxybenzyl group. The alkenyl group is preferably an alkenyl group having 1 to 10 carbon atoms. Examples of the alkenyl group include a vinyl group, a 2,2-dicyanovinyl group, a 2-ethoxycarbonylvinyl group, and a 2-trifluoro-2-methoxycarbonylvinyl group. The alkynyl group is preferably an alkynyl group having 1 to 10 carbon atoms. Examples of the alkynyl group include an ethynyl group and a 2-methoxycarbonylethynyl group. The aryl group is preferably a monocyclic or condensed-ring aryl group, and especially preferably an aryl group containing a benzene ring. Examples of the aryl group include a phenyl group, a 3,5-dichlorophenyl group, a 2-methanesulfonamidephenyl group, a 2-carbamoylphenyl group, a 4-cyanophenyl group, and a 2-hydroxymethylphenyl group.

The heterocyclic group is preferably a 5- or 6-membered, saturated or unsaturated, monocyclic or condensed-ring heterocyclic group that contains at least one nitrogen, oxygen, or sulfur atom. Examples of the heterocyclic group include a morpholino group, a piperidino group (N-substituted), a piperazino group, an imidazolyl group, an indazolyl group (e.g. a 4-nitroindazolyl group), a pyrazolyl group, a triazolyl group, a benzimidazolyl group, a tetrazolyl group, a pyridyl group, a pyridinio group (e.g. a N-methyl-3-pyridinio group), a quinolinio group, and a quinolyl group. Among these, especially preferred are a morpholino group, a piperidino group, a pyridyl group, and a pyridinio group.

The alkoxy group is preferably an alkoxy group having 1 to 8 carbon atoms. Examples of the alkoxy group include a methoxy group, a 2-hydroxyethoxy group, and a benzyloxy group. The aryloxy group is preferably a phenyloxy group. The amino group is preferably an unsubstituted amino group, an alkylamino group having 1 to 10 carbon atoms, an arylamino group, or a saturated or unsaturated heterocyclic amino group, wherein a quaternary nitrogen atom-containing heterocyclic group is included. Examples of the amino group include a 2,2,6,6-tetramethylpiperidine-4-ylamino group, a propylamino group, a 2-hydroxyethylamino group, an anilino group, an o-hydroxyanilino group, a 5-benzotriazolylamino group, and an N-benzyl-3-piridinioamino group. The hydrazino group is especially preferably a substituted or unsubstituted hydrazino group, or a substituted or unsubstituted phenylhydrazino group (e.g. a 4-benzenesulfonamidophenylhydrazino group).

These groups represented by $R_{10}$ may be substituted with a substituent. Preferable examples of the substituent are the same as those mentioned as the substituent of $R_{20}$.

In formula (D), $R_{10}$ may be an atomic group capable of splitting a part of $G_{10}$—$R_{10}$ from the residual molecule, and subsequently of taking place cyclization reaction by which a cyclic structure containing atoms of the —$G_{10}$—$R_{10}$ part is formed. Examples of the atomic groups include those described, for example, in JP-A-63-29751.

The hydrazine derivatives represented by formula (D) may contain an adsorptive group capable of being adsorbed onto the silver halide. Examples of the adsorptive group include an alkylthio group, an arylthio group, a thiourea group, a thioamide group, a mercapto heterocyclic group, and a triazole group, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these adsorptive groups onto the silver halide may be modified into a precursor thereof. Examples of the precursor include those groups described in JP-A-2-285344.

$R_{10}$ or $R_{20}$ of formula (D) may contain a polymer or a ballasting group that is usually used for immobile photographic additives, such as a coupler. The ballasting group in the present invention has 6 or more carbon atoms, and it is a group relatively inactive to photographic properties. The ballasting group can be selected from a straight-chain or branched, alkyl group (or alkylene group), alkoxy group (or alkyleneoxy group), alkylamino group (or alkyleneamino group), or alkylthio group, or a group having these groups as its partial structure. It is more preferable that the ballasting group is, having 7 or more but 24 or less carbon atoms, a straight-chain or branched, alkyl group (or alkylene group), alkoxy group (or alkyleneoxy group), alkylamino group (or alkyleneamino group), or alkylthio group, or a group having these groups as its partial structure. Examples of the polymer include those described, for example, in JP-A-1-100530.

$R_{10}$ or $R_{20}$ of formula (D) may contain a plurality of hydrazino groups as a substituent. At this time, the compound represented by formula (D) is a multimer of the hydrazino group. Specific examples of the compound include those described, for example, in JP-A-64-86134, JP-A-4-16938, JP-A-5-197091, WO95-32452, WO95-32453, JP-A-9-179229, JP-A-9-235264, JP-A-9-235265, JP-A-9-235266, and JP-A-9-235267.

$R_{10}$ or $R_{20}$ in the formula (D) may contain a cationic group (specifically, a group containing a quaternary ammonio group, a group containing a quaternary phosphorous atom or a nitrogen-containing heterocyclic group having a quaternary nitrogen atom), a group containing a repeating unit of an ethyleneoxy group or propyleneoxy group, an (alkyl, aryl or heterocyclic)thio group or a dissociating group (which means a group, or a partial structure, having a proton(s) of such low acidity that the proton is dissociable by an alkaline developer, or a salt of such a group or structure, specifically, for example, carboxy group/—COOH, sulfo group/—$SO_3H$, phosphonic acid group/—$PO_3H$, phosphoric acid group/—$OPO_3H$, hydroxy group/—OH, mercapto group/—SH, —$SO_2NH_2$, N-substituted sulfonamide group/—$SO_2NH$—, —$CONHSO_2$—, —$CONHSO_2NH$—, —$NHCONHSO_2$—, —$SO_2NHSO_2$—, —CONHCO—, an activated methylene group, —NH— inherent in a nitrogen-containing heterocyclic group, or salts of these groups). Examples of containing these groups include compounds described in JP-A-7-234471, JP-A-5-333466, JP-A-6-19032, JP-A-6-19031, JP-A-5-45761, U.S. Pat. Nos. 4,994,365, 4,988,604, JP-A-7-259240, JP-A-7-5610, JP-A-7-244348, German Patent No. 4,006,032, JP-A-11-7093.

In formula (D), $A_{10}$ and $A_{20}$ each represent a hydrogen atom or an alkyl or arylsulfonyl group having 20 or less carbon atoms (preferably, a phenylsulfonyl group, or a phenyl sulfonyl group substituted with a substituent(s) so that the total of the Hammett substituent constant of the substituent becomes −0.5 or more), or an acyl group having 20 or less carbon atoms (preferably, a benzoyl group, a benzoyl group substituted with a substituent(s) so that the total of the Hammett substituent constant of the substituent becomes −0.5 or more, or a straight-chain, branched, or cyclic, substituted or unsubstituted, aliphatic acyl group, wherein examples of the substituent include a halogen atom, an ether group, a sulfonamide group, a carbonamide group, a hydroxyl group, a carboxyl group, and a sulfo group). $A_{10}$ and $A_{20}$ each are most preferably a hydrogen atom.

Next, in the present invention, a particularly preferable hydrazine derivative will be explained.

As $R_{20}$, a substituted phenyl group is particularly preferably. As the substituent, a sulfonamide group, acylamino group, ureido group, carbamoyl group, thioureido group, isothioureido group, sulfamoylamino group or N-acylsulfamoylamino group is particularly preferable. A sulfonamide group or ureido group is more preferable and a sulfonamido group is most preferable.

In the hydrazine derivatives represented by the formula (D), $R_{20}$ or $R_{10}$ is particularly preferably substituted directly or indirectly with, as the substituent, at least one of the ballasting group, the group adsorptive onto the silver halide, the group containing the quaternary ammonio group, the nitrogen-containing heterocyclic group having a quaternary nitrogen atom, the group containing a repeating unit of an ethyleneoxy group, the (alkyl, aryl or heterocyclic)thio group, the dissociating group dissociable by an alkaline developer, and the hydrazino group that can form a multimer (e.g., the group represented by —NHNH—$G_{10}$—$R_{10}$, wherein $G_{10}$ and $R_{10}$ have the same meanings as those in the formula (D), respectively). Further $R_{20}$ preferably has at least one of the aforementioned groups as its substituent directly or indirectly. Most preferably, $R_{20}$ represents a phenyl group substituted with a benzenesulfonamide group, and the benzenesulfonamide group has any one of the aforementioned groups as the substituent on its benzene ring, directly or indirectly.

Among those groups represented by $R_{10}$ when $G_{10}$ is a —CO— group, preferred are a hydrogen atom, an alkyl group, an alkenyl group, an alkynyl group, an aryl group, or a heterocyclic group, and more preferably a hydrogen atom, an alkyl group, or a substituted aryl group, wherein the substituent is especially preferably an electron-withdrawing group or an o-hydroxymethyl group. A hydrogen atom or an alkyl group is most preferred.

When $G_{10}$ is a —COCO— group, an alkoxy group, an aryloxy group, and an amino group are preferred. Further, a substituted amino group, specifically an alkylamino group, an arylamino group, and a saturated or unsaturated heterocyclic amino group, is especially preferred.

Further, when $G_{10}$ is a —$SO_2$— group, $R_{10}$ is preferably an alkyl group, an aryl group, or a substituted amino group.

In formula (D), $G_{10}$ is preferably a —CO— group or a —COCO— group and especially preferably a —CO-group.

Next, specific examples of the compound represented by formula (D) are illustrated below, but they are not intended to restrict the scope of the invention.

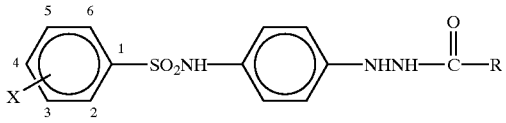

| | X = | R = —H | —$C_2F_4$—COOH (or —$C_2F_4$—$COO^{\ominus}K^{\oplus}$) | 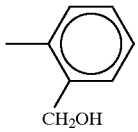 | 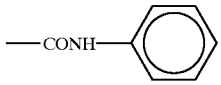 |
|---|---|---|---|---|---|
| D-1 | 3-$NHCOC_9H_{19}$(n) | 1a | 1b | 1c | 1d |
| D-2 | 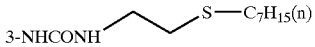 | 2a | 2b | 2c | 2d |
| D-3 | 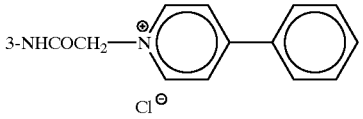 | 3a | 3b | 3c | 3d |
| D-4 | 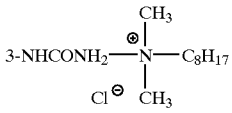 | 4a | 4b | 4c | 4d |
| D-5 | 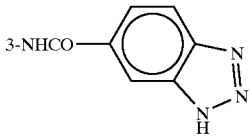 | 5a | 5b | 5c | 5d |
| D-6 | 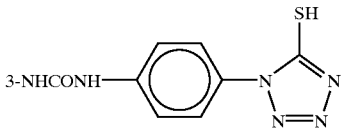 | 6a | 6b | 6c | 6d |
| D-7 | 2,4-$(CH_3)_2$-3-$SC_2H_4$-$(OC_2H_4)_4$—$OC_8H_{17}$ | 7a | 7b | 7c | 7d |

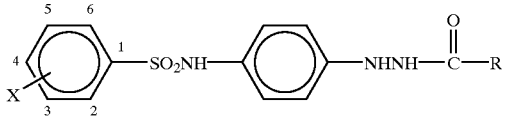

| | X = | R = —H | —$CF_2H$ | 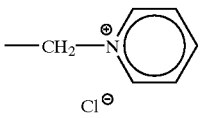 | 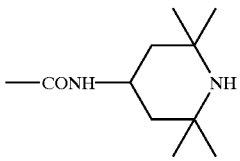 |
|---|---|---|---|---|---|
| D-8 | 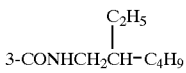 | 8a | 8e | 8f | 8g |
| D-9 | 6-$OCH_3$-3-$C_5H_{11}$(t) | 9a | 9e | 9f | 9g |

-continued
| | | | | | |
|---|---|---|---|---|---|
| D-10 | 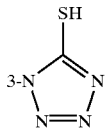 | 10a | 10e | 10f | 10g |
| D-11 | 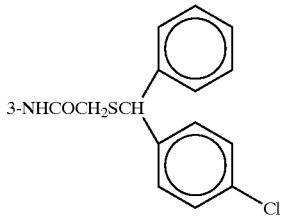 | 11a | 11e | 11f | 11g |
| D-12 | 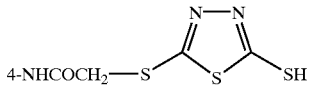 | 12a | 12e | 12f | 12g |
| D-13 | 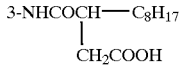 | 13a | 13e | 13f | 13g |
| D-14 | 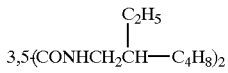 | 14a | 14e | 14f | 14g |
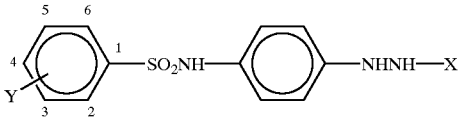
| | | X = | | | |
|---|---|---|---|---|---|
| | Y = | —CHO | —$COCF_3$ | —$SO_2CH_3$ | —$P(OC_2H_5)_2$ (O) |
| D-15 | 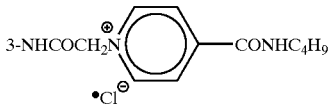 | 15a | 15h | 15i | 15j |
| D-16 | 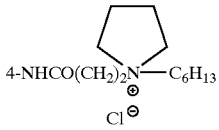 | 16a | 16h | 16i | 16j |
| D-17 | 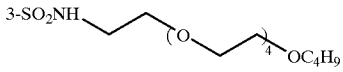 | 17a | 17h | 17i | 17j |
| D-18 | 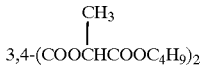 | 18a | 18h | 18i | 18j |
| D-19 | 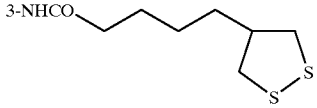 | 19a | 19h | 19i | 19j |
| D-20 | 3-$NHSO_2NH$—$C_8H_{17}$ | 20a | 20h | 20i | 20j |

-continued
| | | | | | |
|---|---|---|---|---|---|
| D-21 | 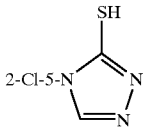 | 21a | 21h | 21i | 21j |
| | | R = | | | |
| | | —H | —$CF_2H$ | 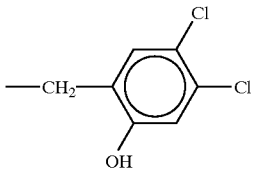 | —$CONHC_3H_7$ |
| D22 | 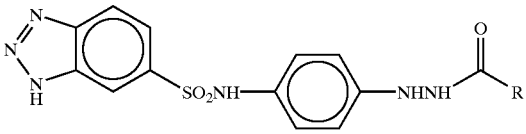 | 22a | 22e | 22k | 22l |
| D-23 | 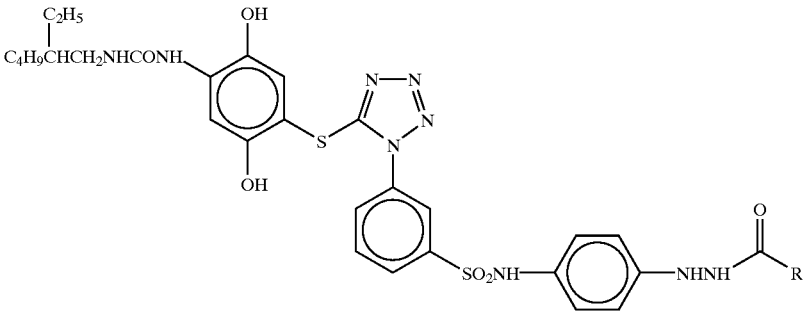 | 23a | 23e | 23k | 23l |
| D-24 | 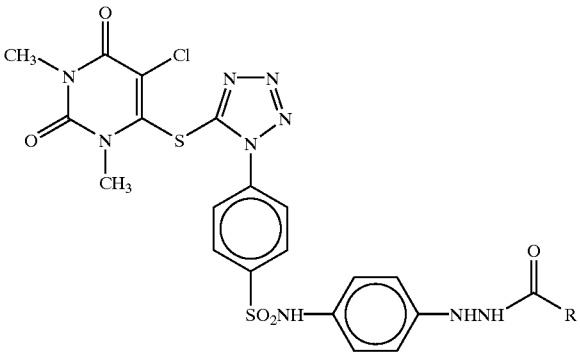 | 24a | 24e | 24k | 24l |
| D-25 | 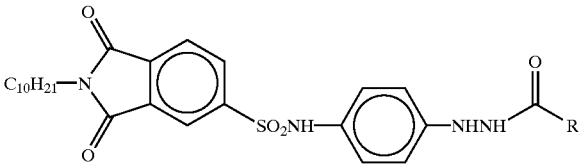 | 25a | 25e | 25k | 25l |

-continued
D-26
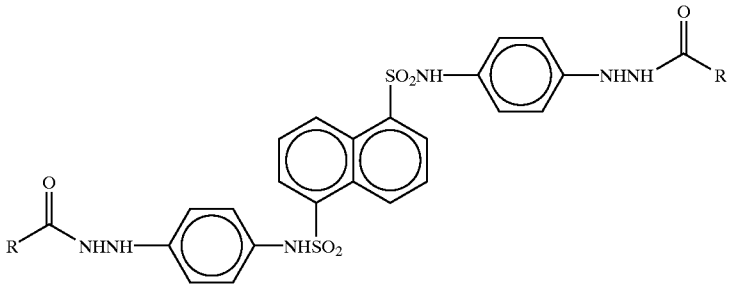
| | 26a | 26e | 26k | 26l |
|---|---|---|---|---|
| | R = | | | |
| | —H | —$CF_2H$ | 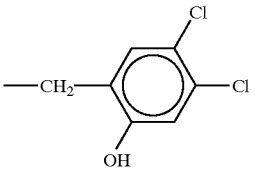 | —$CONHC_3H_7$ |
D27
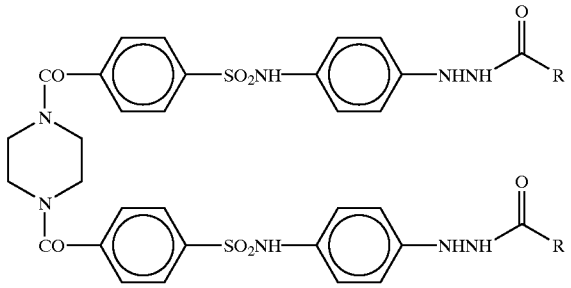
| | 27a | 27e | 27k | 271 |
|---|---|---|---|---|
D-28
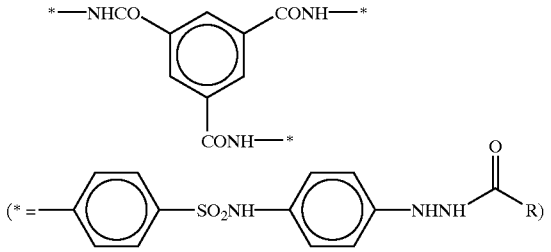
| | 28a | 28e | 28k | 28l |
|---|---|---|---|---|
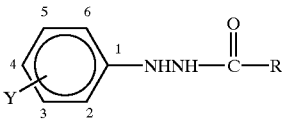
| Y = | R = | | | |
|---|---|---|---|---|
| | —H | —$CH_2OCH_3$ | 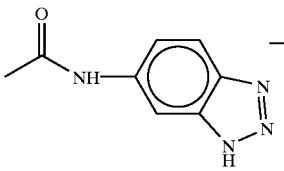 | 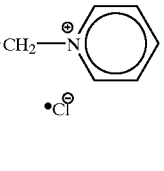 |
D-29
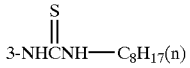
| | 29a | 29m | 29n | 29f |
|---|---|---|---|---|

-continued

| | | | | | |
|---|---|---|---|---|---|
| D-30 | 4-NHP(S)(OCH$_2$—C$_6$H$_4$—)$_2$ | 30a | 30m | 30n | 30f |
| D-31 | 4-NHCONH—(CH$_2$)$_3$O—C$_6$H$_4$—C(CH$_3$)$_2$—CH=CH$_2$ | 31a | 31m | 31n | 31f |
| D-32 | 4-OH<br>3-NHCONHCH$_2$CH(C$_2$H$_5$)—C$_4$H$_9$ | 32a | 32m | 32n | 32f |
| D-33 | 4-NHSO$_2$(CH$_2$)$_2$NHCO—C$_6$H$_4$— 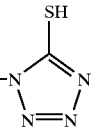 | 33a | 33m | 33n | 33f |
| D-34 | 4-OCH$_2$—C$_6$H$_5$ | 34a | 34m | 34n | 34f |
| D-35 | 4-NHCONHN—(CH$_2$—C$_6$H$_4$—)$_2$ | 35a | 35m | 35n | 35f |

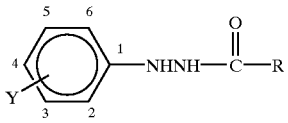

| Y = | R = —H | R = —C$_3$F$_6$—COOH | R = —CONHCH$_3$ | R = 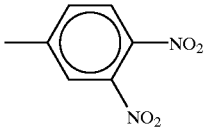 |
|---|---|---|---|---|
| D-36 2-NHSO$_2$CH$_3$—<br>4-NHCONH(CH$_2$)$_3$S— 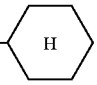 | 36a | 36o | 36p | 36q |
| D-37 2-OCH$_3$<br>4-NHSO$_2$C$_{12}$H$_{25}$ | 37a | 37o | 37p | 37q |
| D-38 3-NHCOC$_{11}$H$_{23}$—<br>4-NHSO$_2$CF$_3$ | 38a | 38o | 38p | 38q |
| D-39 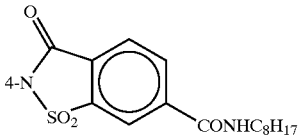 | 39a | 39o | 39p | 39q |
| D-40 4-OCO(CH$_2$)$_2$COOC$_6$H$_{13}$ | 40a | 40o | 40p | 40q |
| D-41 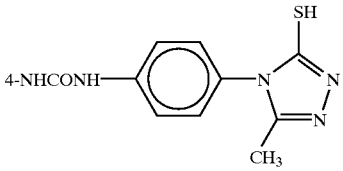 | 41a | 41o | 41p | 41q |

-continued
| | | | | | |
|---|---|---|---|---|---|
| D-42 | 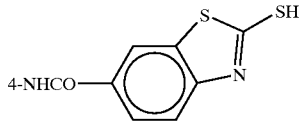 | 42a | 42o | 42p | 42q |
D-43
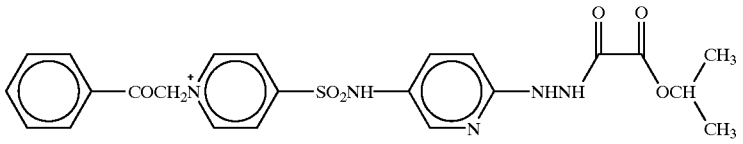
D-44
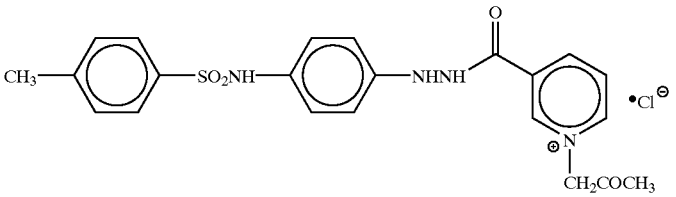
D-45
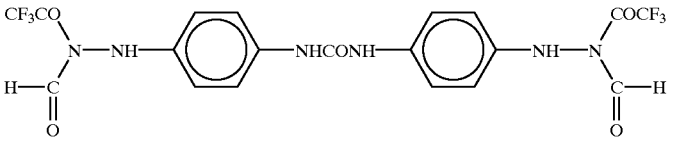
D-46
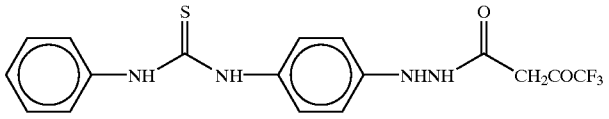
D-47
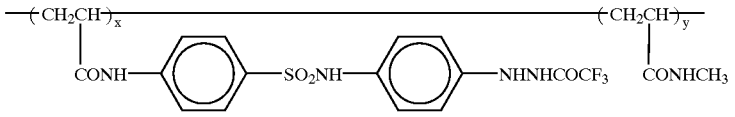
x:y = 3:97 Average M.W. ≒ 100,000
D-48
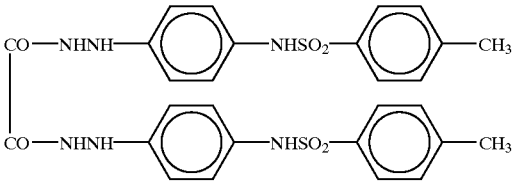
D-49
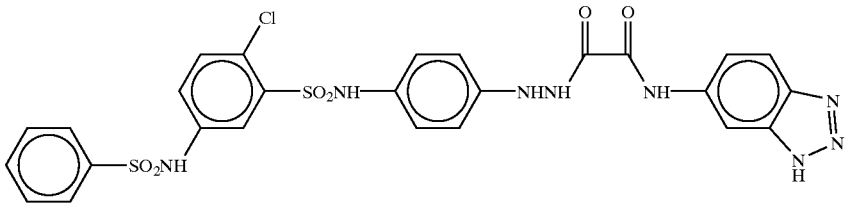
D-50
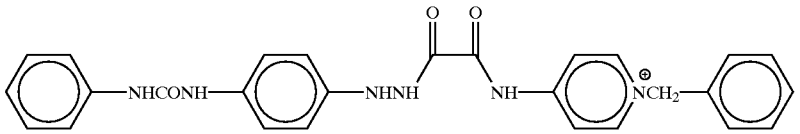

-continued
D-51
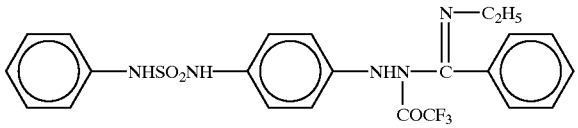
D-52
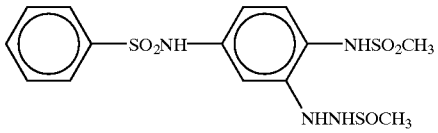
D-53
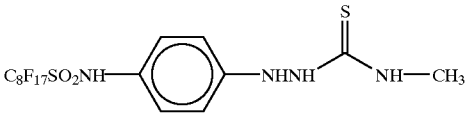
D-54
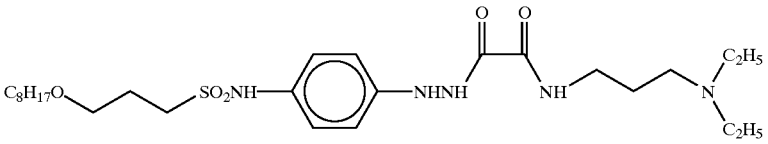
D-55
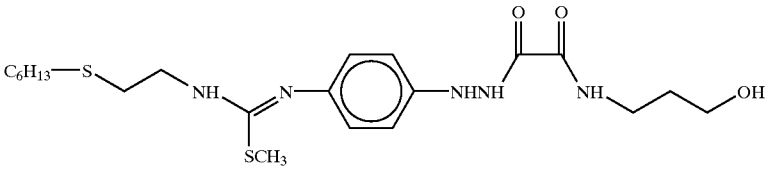
D-56
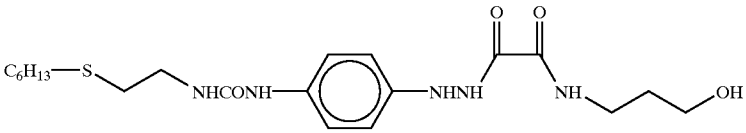
D-57
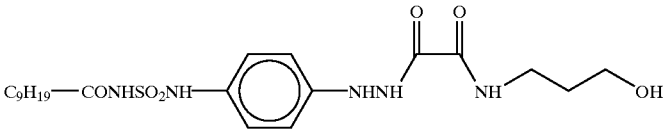
D-58
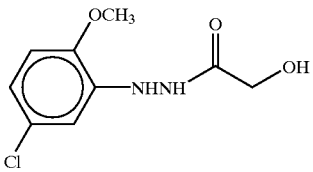
D-59
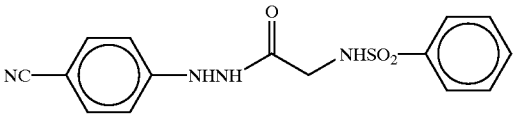
D-60
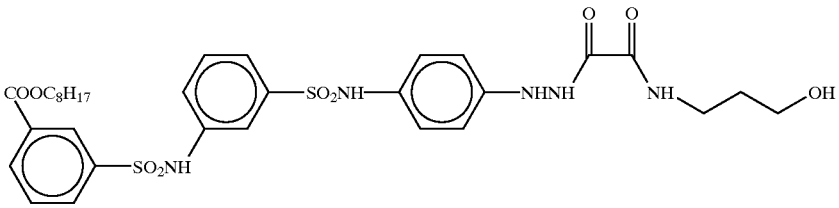

-continued

D-61

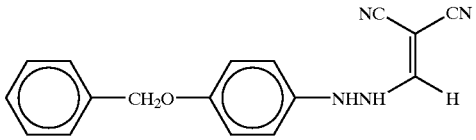

D-62

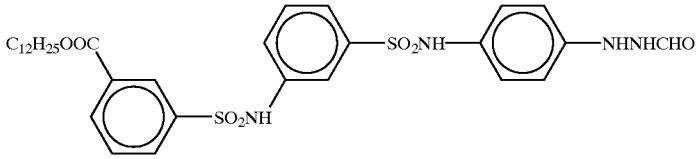

D-63

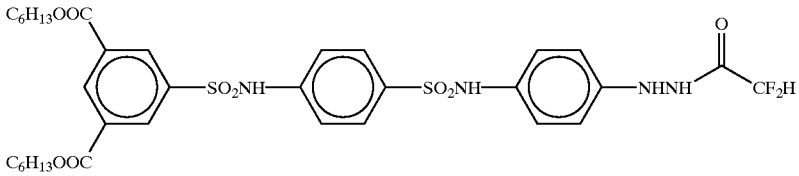

D-64

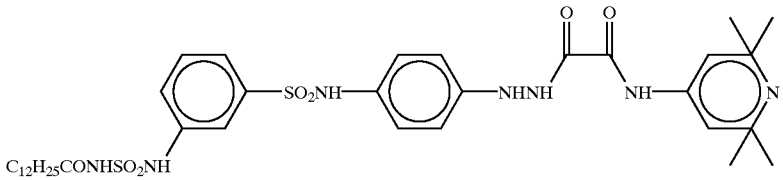

D-65

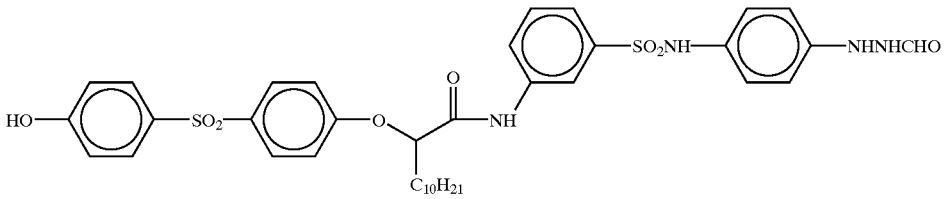

D-66

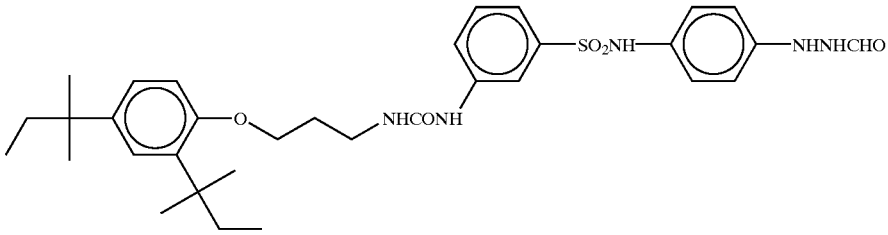

D-67

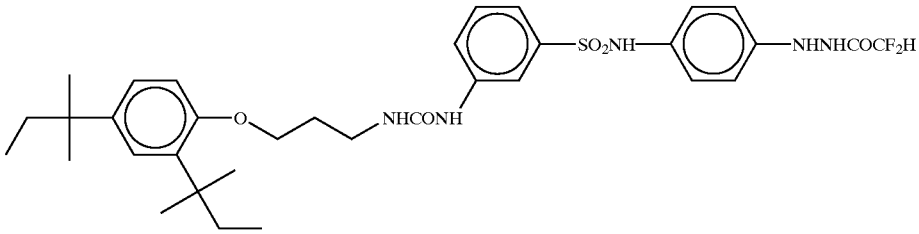

As the hydrazine derivatives for use in the present invention, in addition to the above, the following hydrazine derivatives can also preferably be used. The hydrazine derivatives for use in the present invention can be synthesized by various methods described in the following patents: compounds represented by (Chemical formula 1) described in JP-B-6-77138 ("JP-B" means examined Japanese patent publication); specifically, compounds described on pages 3 and 4 of the publication; compounds represented by formula (I) described in JP-B-6-93082; specifically, Compounds 1 to 38 described on pages 8 to 18 of the publication; compounds represented by formulae (4), (5), and (6) described in JP-A-6-230497; specifically, Compound 4-1 to Compound 4-10 described on pages 25 and 26, Compound 5-1 to Compound 5-42 described on pages 28 to 36, and Compound 6-1 to Compound 6-7 described on pages 39 and 40 of the publication, respectively; compounds represented by formulae (1) and (2) described in JP-A-6-289520; specifically, Compounds 1-1) to 1-17) and 2-1) described on pages 5 to 7 of the publication; compounds represented by (Chemical formula 2) and (Chemical formula 3) described in JP-A-6-313936; specifically, compounds described on pages 6 to 19 of the publication; compounds represented by (Chemical formula 1) described in JP-A-6-313951; specifically, compounds described on pages 3 to 5 of the publication; compounds represented by formula (I) described in JP-A-7-5610; specifically, Compounds I-1 to I-38 described on pages 5 to 10 of the publication; compounds represented by formula (II) described in JP-A-7-77783; specifically, Compounds II-1 to II-102 described on pages 10 to 27 of the publication; compounds represented by formulae (H) and (Ha) described in JP-A-7-104426; specifically, Compounds H-1 to H-44 described on pages 8 to 15 of the publication; compounds that have an anionic group in the vicinity of the hydrazine group or a nonionic group for forming an intramolecular hydrogen bond with the hydrogen atom of the hydrazine; and especially, compounds represented by formulae (A), (B), (C), (D), (E), and (F), described in JP-A-9-22082; specifically, Compounds N-1 to N-30 described in the specification thereof; and compounds represented by formula (1) described in JP-A-9-22082; specifically, Compounds D-1 to D-55 described in the specification thereof. Besides, hydrazine derivatives described in WO 95-32452, WO 95-32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

The hydrazine-series nucleating agent for use in the present invention may be dissolved in an appropriate water-miscible organic solvent, such as an alcohol (e.g. methanol, ethanol, propanol, fluorinated alcohol), a ketone (e.g. acetone, methyl ethyl ketone), dimethylformamide, dimethylsulfoxide, or methyl cellosolve, before use.

Also, the hydrazine-series nucleating agent for use in the present invention may be dissolved using an oil, such as dibutyl phthalate, tricresyl phosphate, glyceryl triacetate, or diethyl phthalate; or using or an auxiliary solvent, such as ethyl acetate or cyclohexanone, by a conventionally well-known emulsion dispersion method, and mechanically processed into an emulsion dispersion before use. Alternatively, the hydrazine derivative powder may be dispersed in water by means of a ball mill, a colloid mill, or ultrasonic waves, according to a method known as a solid dispersion method, and used.

The hydrazine nucleating agent for use in the present invention may be added to a silver halide emulsion layer or to any of other hydrophilic colloid layers on the silver halide emulsion layer side of a support, but it is preferably added to the above-described silver halide emulsion layer or to a hydrophilic colloid layer adjacent thereto. Also, two or more kinds hydrazine-series nucleating agent may be used together.

The addition amount of the nucleating agent for use in the present invention is preferably from $1\times10^{-5}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of silver halide.

In the present invention, it is preferable to include a nucleation accelerator in the light-sensitive material. Examples of the nucleation accelerator (nucleating accelerator) for use in the present invention include an amine derivative, an onium salt, a disulfide derivative, and a hydroxymethyl derivative. Specific examples thereof are described below: compounds described in JP-A-7-77783, page 48, lines 2 to 37; specifically, Compounds A-1) to A-73) described on pages 49 to 58; compounds represented by (Chemical formula 21), (Chemical formula 22), and (Chemical formula 23) described in JP-A-7-84331; specifically, compounds described on pages 6 to 8 of the publication; compounds represented by formulae [Na] and [Nb] described in JP-A-7-104426; specifically, Compounds Na-1 to Na-22 and Compounds Nb-1 to Nb-12 described on pages 16 to 20 of the publication, the compounds represented by the formulae (1), (2), (3), (4), (5), (6) and (7) described in JP-A-8-272023, specifically, the compounds of 1-1 to 1-19, compounds of 2-1 to 2-22, compounds of 3-1 to 3-36, compounds of 4-1 to 4-5, compounds of 5-1 to 5-41, compounds of 6-1 to 6-58 and compounds of 7-1 to 7-38 described in the publication; the nucleation accelerators described in JP-A-9-297377, p55, column 108, line 8 to p69, column 136, line 44.

The nucleating accelerator that can be used in the present invention is most preferably an onium salt compound represented by the following formula (E), (F), (G), or (H).

First, the formula (E) will be described in detail.

formula (E)

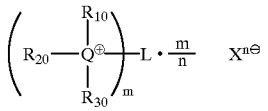

In the formula (E), $R_{10}$, $R_{20}$ and $R_{30}$ each represent an alkyl, cycloalkyl, aralkyl, aryl, alkenyl, cycloalkenyl, alkynyl or heterocyclic group; each of which may be further substituted, or may bond together to form a cyclic structure; Q represents a nitrogen or phosphorous atom; L represents an m-valent organic group whose carbon atom is bonded to $Q^+$; m is an integer of 1 to 4; $X^{n-}$ represents an n-valent counter ion; n is an integer of 1 to 3; and when $R_{10}$, $R_{20}$, $R_{30}$ or L has an anionic group as its substituent and is combined with $Q^+$ to form an intramolecular salt, $X^{n-}$ is unnecessary.

Examples of the group represented by $R_{10}$, $R_{20}$ or $R_{30}$ include straight-chain or branched alkyl groups such as methyl, ethyl, propyl, isopropyl, butyl, isobutyl, sec-butyl, tert-butyl, octyl, 2-ethylhexyl, dodecyl, hexadecyl and octadecyl; substituted or unsubstituted arylkyl groups such as benzyl; cycloalkyl groups such as cyclopropyl, cyclopentyl, and cyclohexyl; aryl groups such as phenyl, naphthyl, and phenanthryl; alkenyl groups such as ally, vinyl and 5-hexenyl; cycloalkenyl groups such as cyclopentenyl and cyclohexenyl; alkynyl groups such as phenylethynyl; and heterocyclic groups such as pyridyl, quinolyl, furyl, imidazolyl, thiazolyl, thiadiazolyl, benzotriazolyl, benzothiazolyl, morpholyl, pyrimidyl and pyrrolidyl.

Examples of a substituent substituting on these groups include halogen atoms such as fluorine, chlorine, bromine and iodine atoms; nitro, (alkyl or aryl)amino, alkoxy, aryloxy, (alkyl or aryl)thio, carbonamido, carbamoyl, ureiodo, thioureido, sulfonylureido, sulfonamido, sulfamoyl, hydroxyl, sulfonyl, carboxyl (including carboxylate), sulfo (including sulfonate), cyano, oxycarbonyl, acyl, and heterocyclic groups (including heterocyclic groups containing a quaternary nitrogen atom), as well as the examples of the group represented by $R_{10}$, $R_{20}$ or $R_{30}$. These substituents may further be substituted with at least one of these substituents.

Examples of the group represented by L include the same groups as described as examples of $R_{10}$, $R_{20}$ or $R_{30}$ when m is 1. When m is an integer of 2 or more, L represents an m-valent connecting group in which a carbon atom included in the L is bonded to $Q^+$, and specifically represents an alkylene, arylene, or heterocyclic group; or an m-valent connecting group obtained by combining at least one of these groups with —CO—, —O—, —N($R_N$)—, —S—, —SO—, or —$SO_2$— group, wherein $R_N$ represents a hydrogen atom or the same group as defined as $R_{10}$, $R_{20}$ or $R_{30}$, and when plural $R_N$'s are present in the molecule, the $R_N$'s may be the same or different and may be bonded to each other. L may have any substituent. Examples of the substituent include the same groups as described as examples of the substituent that the group represented by $R_{10}$, $R_{20}$ or $R_{30}$ may have.

Examples of the counter ion represented by $X^{n-}$ include halogen ions such as chlorine, bromine, and iodine ions; carboxylate ions such as acetate, oxalate, fumarate, and benzoate ions; sulfonate ions such as p-toluenesulfonate, methanesulfonate, butanesulfonate, and benzenesulfonate ions; a sulphate ion; a perchlorate ion; a carbonate ion; and a nitrate ion.

In the formula (E), each of $R_{10}$, $R_{20}$ and $R_{30}$ is preferably a group having 20 or less carbon atoms. When Q represents a phosphorous atom, an aryl group having 15 or less carbon atoms is particularly preferred. When Q represents a nitrogen atom, an alkyl, aralkyl or aryl group having 15 or less carbon atoms is particularly preferred. m is preferably 1 or 2. When m is 1, L is preferably a group having 20 or less carbon atoms and is particularly preferably an alkyl, aralkyl or aryl group having 15 or less carbon atoms. When m is 2, the divalent organic group represented by L is preferably an alkylene or arylene group; or a divalent group obtained by combining at least one of these groups with —CO—, —O—, —N($R_N$)—, —S—, or —$SO_2$— group. When m is 2, L is preferably a divalent group whose carbon atom is bonded to $Q^+$, the total number of carbon atoms in the divalent group being 20 or less.

The case in which L comprises plural (specifically, 2 to 67) repeating units of an ethyleneoxy or propyleneoxy group is a preferred example. To this case, the above-mentioned preferred scope of the total number of carbon atoms is not applied. When m is an integer of 2 or more, plural $R_{10}$s, $R_{20}$s and $R_{30}$s are present in the molecule, which may be the same or different.

The counter ion represented by $X^{n-}$ is preferably a halogen, carboxylate, sulfonate or sulphate ion. n is preferably 1 or 2.

Many compounds represented by the formula (E) that can be used in the present invention are known, and commercially available as reagents. Examples of a general method for synthesizing them when Q is a phosphrous atom, include a method of reacting a phosphinic acid with an alkylating agent such as an alkyl halide or a sulfonate ester; and a method of converting a counter anion of a phosphonium salt in a usual manner. When Q is a nitrogen atom, a method of reacting a primary, secondary or tertiary amine compound with an alkylating agent such as an alkyl halide or a sulfonate ester may be used.

Specific examples of the compound represented by the formula (E) are shown below. However, the present invention is not limited to these examples.

E-1

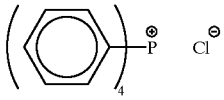

E-2

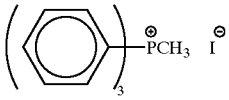

E-3

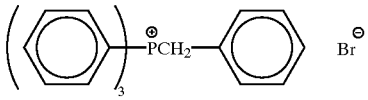

E-4

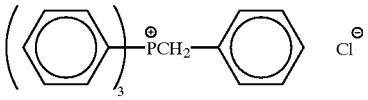

E-5

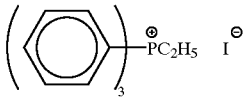

E-6

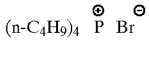

E-7

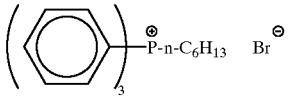

E-8

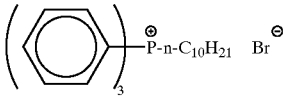

E-9

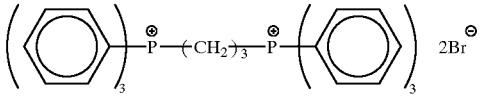

E-10

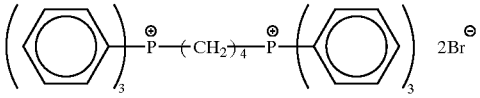

E-11

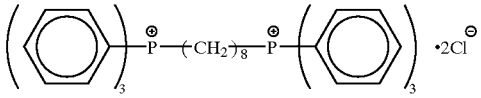

E-12

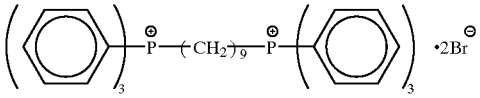

-continued
E-13
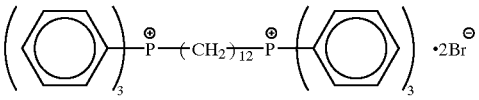
E-14
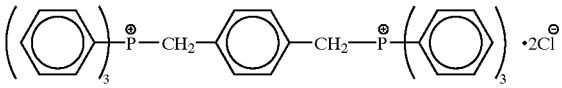
E-15
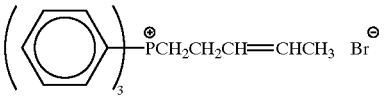
E-16
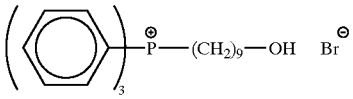
E-17
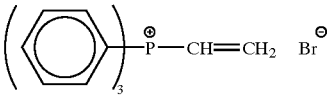
E-18
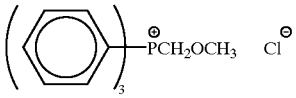
E-19
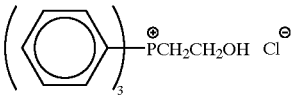
E-20
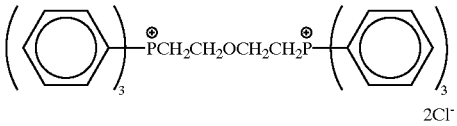
E-21
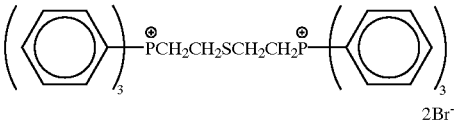
E-22
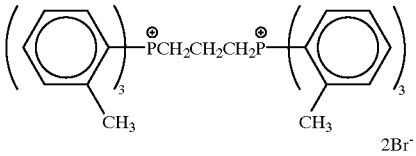
E-23
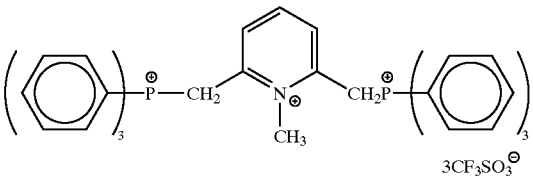
E-24
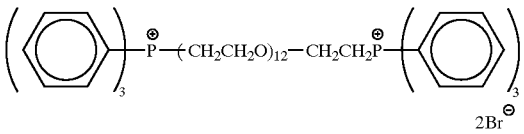
E-25
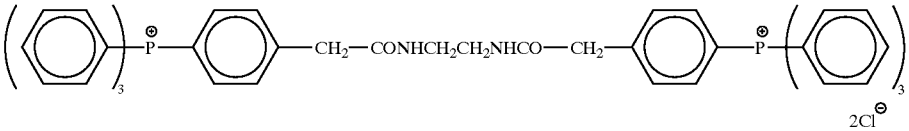
E-26
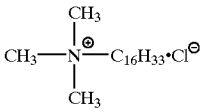
E-27
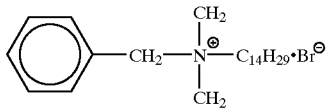
E-28
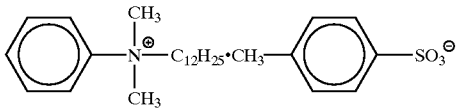
E-29
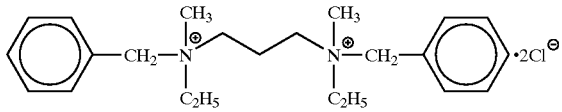
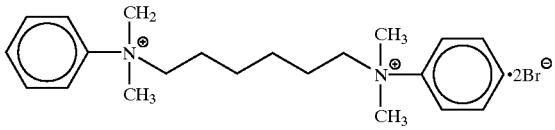
E-31
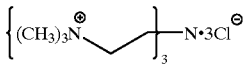
E-32
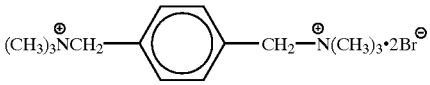
E-33
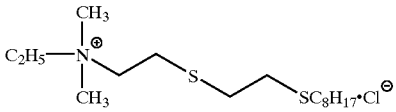

-continued
E-34
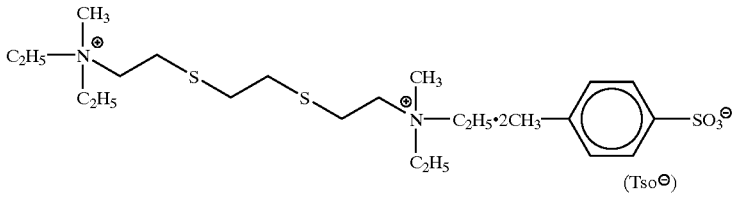
E-35
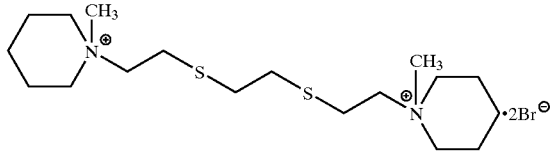
E-36
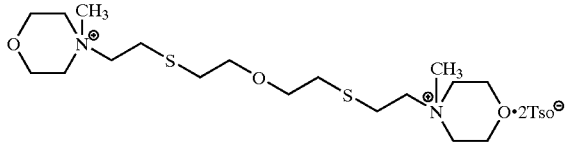
E-37
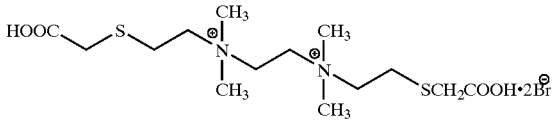
E-38
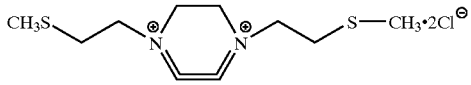
E-39
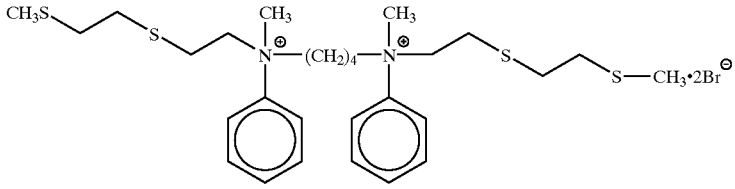
E-40
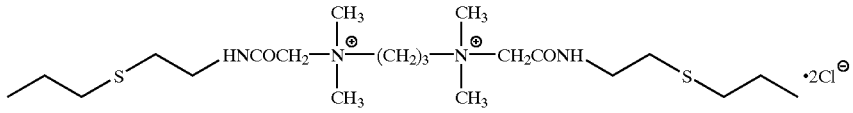
E-41
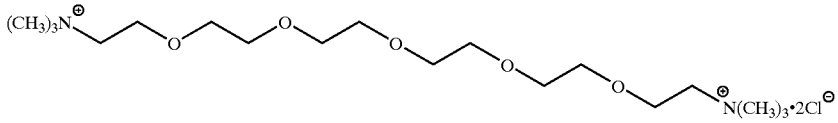
E-42
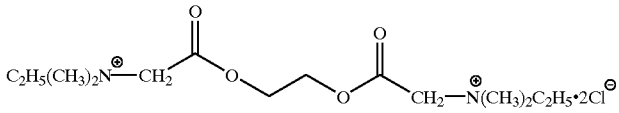
The formulae (F) and (G) will be described in detail below.
formula (F)
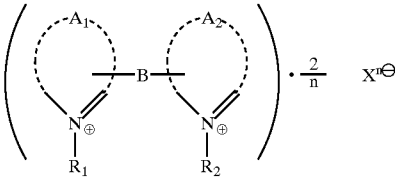
-continued
formula (G)
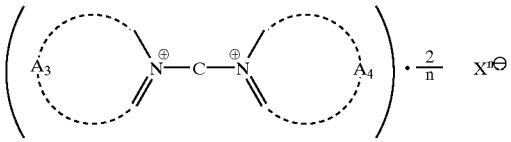
In the formulas (F) and (G), $A_1$, $A_2$, $A_3$ and $A_4$ each represents an organic residue which contains a quaternary nitrogen atom, and which is necessary to complete a substituted or unsubstituted, unsaturated heteroring, and which may contain a carbon, oxygen, nitrogen, sulfur or hydrogen atom; a benzene ring may be condensed to the heteroring; B and C each represents a divalent connecting group; $R_1$ and $R_2$ each represent a substituent; and a counter ion represented by $X^{n-}$ is the same as in the formula (E) and the preferred scope thereof is also the same.

Examples of the unsaturated heteroring formed by using $A_1$, $A_2$, $A_3$ and $A_4$ include pyridine, quinoline, isoquinoline, imidazole, thiazole, thiadiazole, benzotriazole, benzothiazole, pyrimidine, and pyrazole rings. Particularly preferred are pyridine, quinoline and isoquinoline rings.

The unsaturated heteroring formed by $A_1$, $A_2$, $A_3$ and $A_4$ together with the quaternary nitrogen atom may have a substituent thereon. Examples of the substituent in this case include the same as described as the examples of the substituent that the group represented by $R_{10}$, $R_{20}$ or $R_{30}$ in the formula (E) may have. Preferred examples of the substituent include halogen atoms (particularly, a chlorine atom), an aryl group having 20 or less carbon atoms (particularly preferably, phenyl), alkyl, carbamoyl, (alkyl or aryl)amino, oxycarbonyl, alkoxy, aryloxy, (alkyl or aryl) thio, hydroxy, carbonamido, sulfonamido, sulfo (including sulfonate), and carboxyl (including carboxylate) groups. Particularly preferred are phenyl, alkylamino and carbonamido groups, and chlorine atom.

The divalent connecting group represented by B or C is preferably alkylene, arylene, alkenylene, alkynylene, a divalent heterocyclic group, —$SO_2$—, —SO—, —O—, —S—, —N($R_{N'}$)—, —C═O—, and —P═O—, or a divalent group formed by combining these. $R_{N'}$ represents an alkyl, aralkyl or aryl group, or a hydrogen atom, and is preferably a hydrogen atom. The divalent connecting group represented by B or C may have any substituent. Examples of the substituent include the same as described as the examples of the substituent that the group represented by $R_{10}$, $R_{20}$ or $R_{30}$ in the formula (E) may have. Particularly preferred examples of B or C include those constituted with alkylene, arylene, —C═O—, —O—, —S—, —$SO_2$—, and —N($R_{N'}$)— singly or in combination. The case in which the combination of these groups results in a connecting group having plural (specifically, 2–67) repeating units of an ethyleneoxy or propyleneoxy group, is also an preferred example. The case in which the group represented by B or C contains a hydrophilic group, by a combination of these groups or as a substituent on B or C, is also a preferred example. The hydrophilic group herein means —CONH—, —NHCONH—, —$SO_2$NH—, —NH$SO_2$NH—, amino, guanidino, or ammonio group, a heterocyclic group containing a quaternary nitrogen atom, or a dissociating group (that is, a group or a moiety which has a proton having such a low acidity that the proton can be dissociated with an alkaline developing solution; or a salt thereof. Specific examples thereof include a carboxyl group/—COOH, a sulfo group/—$SO_3$H, a phosphonic acid group/—$PO_3$H, a phosphoric acid group/—$OPO_3$H, a hydroxyl group/—OH, a mercapto group/—SH, —$SO_2$NH group, a N-substituted sulfonamido group/—$SO_2$NH—, a —CONH$SO_2$-group, a —$SO_2$NH$SO_2$-group, a —CONHCO-group, an active methylene group, an —NH-group present in a nitrogen-containing heteroring, and salts thereof).

$R_1$ and $R_2$ each are preferably an alkyl or aralkyl group having 1–20 carbon atoms, which may be the same or different. The aralkyl group may have a substituent. Examples of the substituent include the same as described as the examples of the substituent that the group represented by $R_{10}$, $R_{20}$ and $R_{30}$ in the formula (E) may have. Each of $R_1$ and $R_2$ is particularly preferably an alkyl or aralkyl group having 1–10 carbon atoms. Examples of the preferable substituent thereon include carbamoyl, oxycarbonyl, acyl, aryl, sulfo (including sulfonate), carboxyl (including carboxylate), hydroxyl, and (alkyl or aryl)amino groups.

The compound that can be used in the present invention can easily be synthesized by methods which are widely known. The following literature is referred to: Quart. Rev., 16, 163 (1962).

Specific examples of the compound represented by the formula (F) or (G) are shown below, but the present invention is not limited to these examples.

F-6

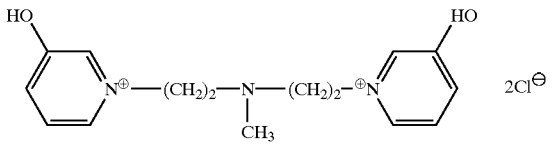

F-7

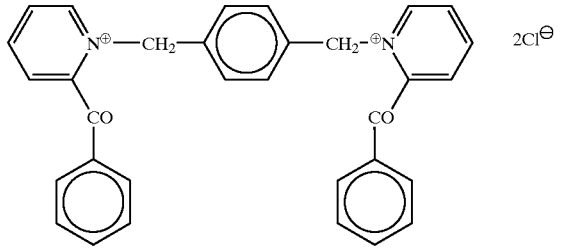

F-8

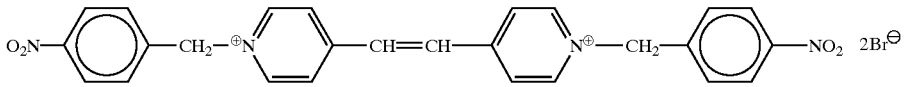

F-9

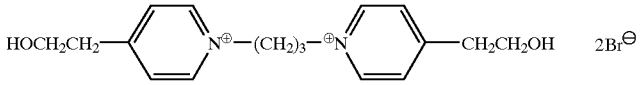

-continued
F-10
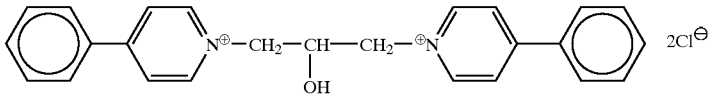
F-11
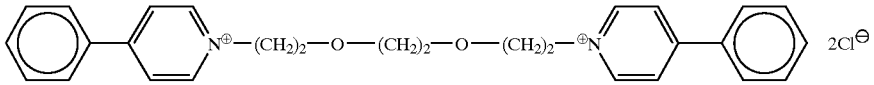
F-12
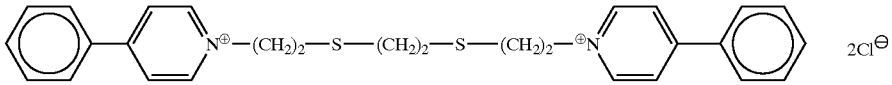
F-13
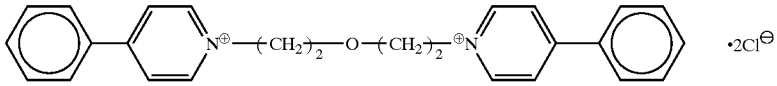
F-14
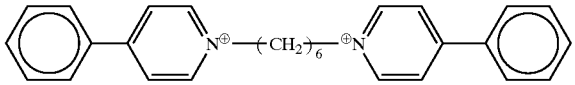
F-15
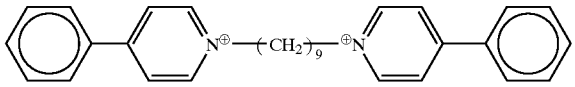
F-16
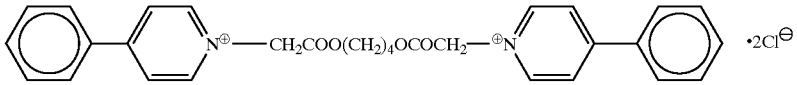
F-17
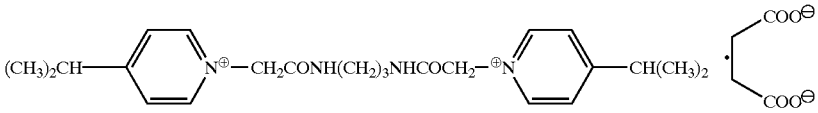
F-18
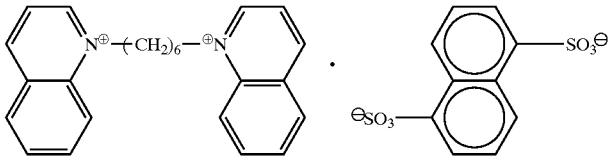
F-19
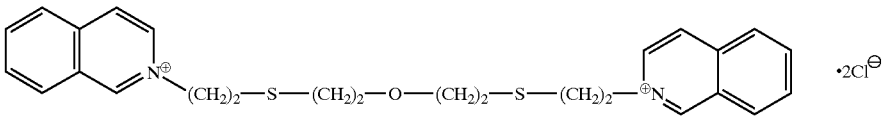
F-20
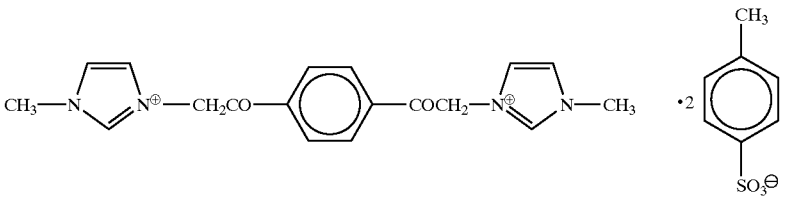
F-21
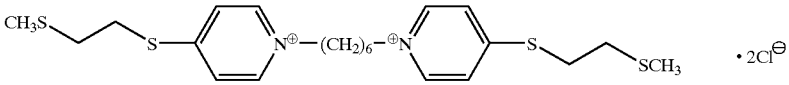
F-22
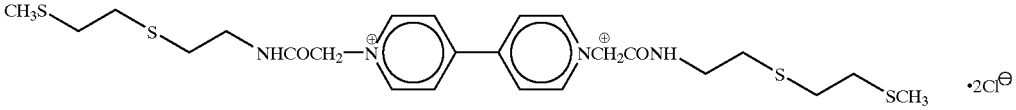

-continued
F-23
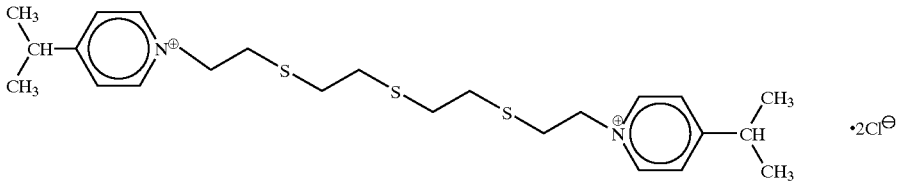
F-24
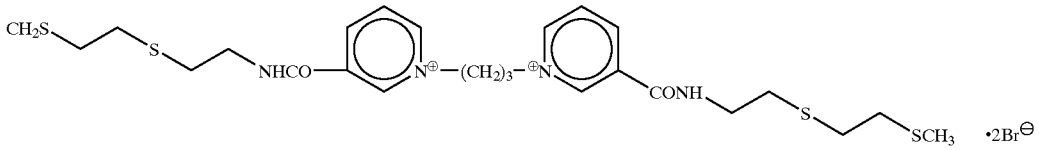
F-25
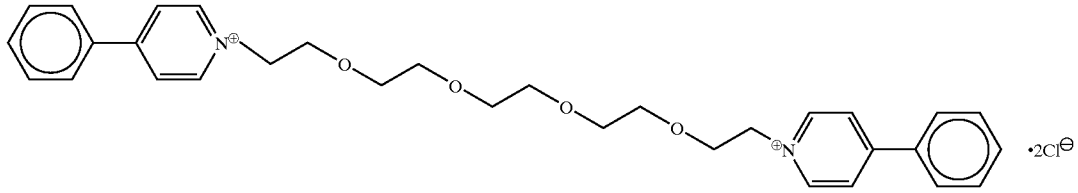
F-26
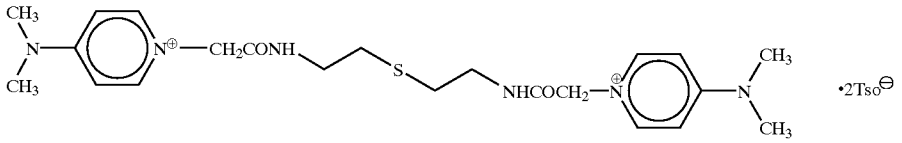
F-27
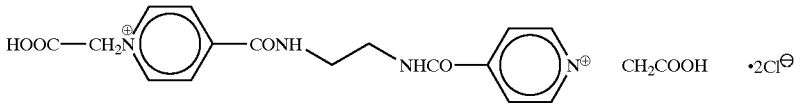
F-28
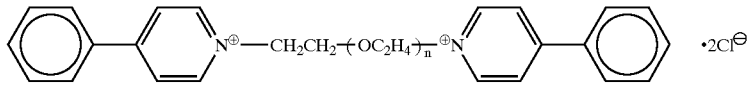
n ≐ 21
F-29
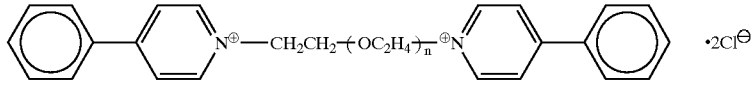
n ≐ 33
F-30
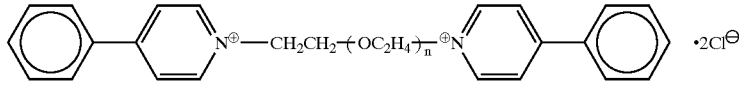
n ≐ 44
F-31
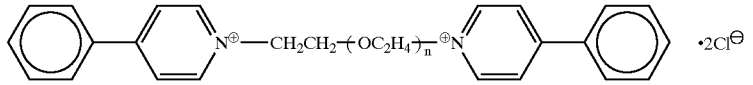
n ≐ 67
F-32
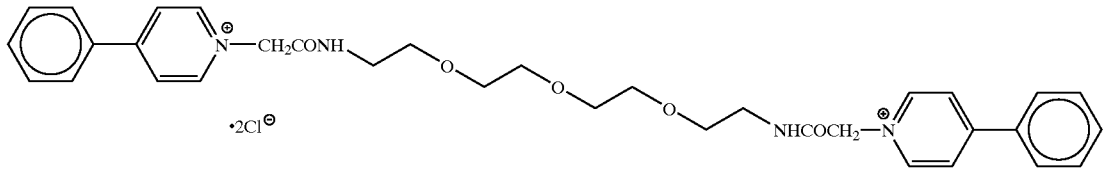

-continued
F-33
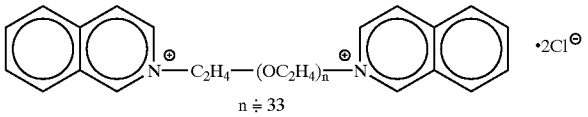
F-34
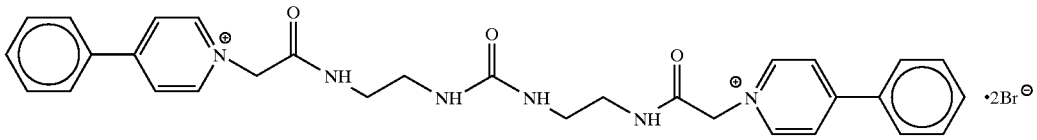
F-35
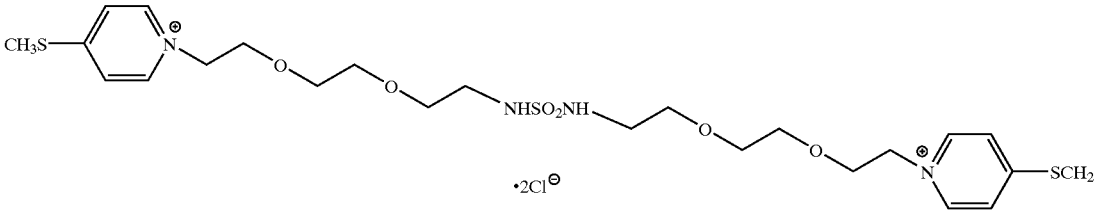
F-36
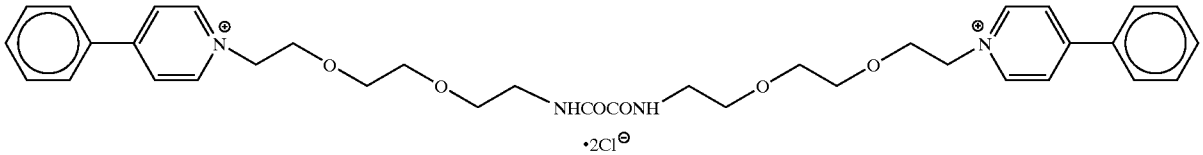
F-37
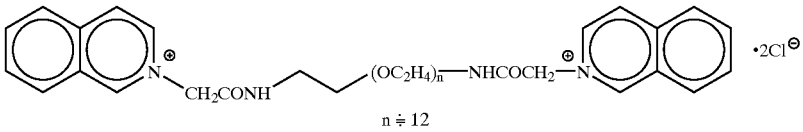
F-38
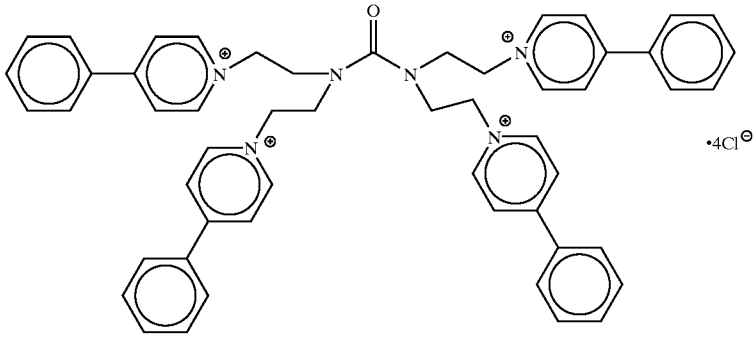
F-39
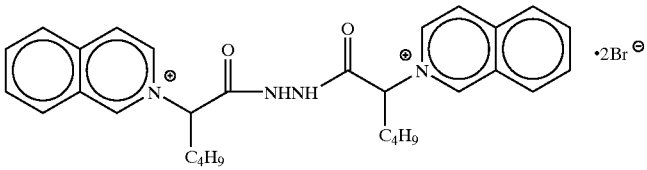
F-40
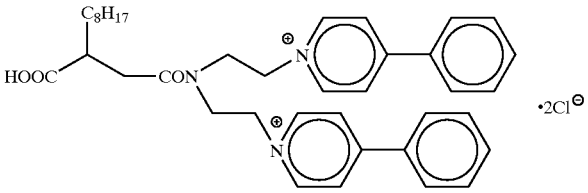

-continued

F-41

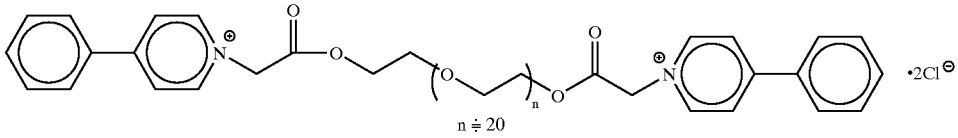

The formula (H) will be explained in detail below.

formula (H)

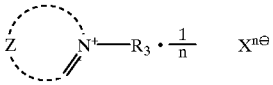

In the formula (H), Z represents an organic residue to form, together with the quaternary nitrogen atom, an unsaturated heteroring; $R_3$ represents a substituent, a counter anion represented by $X^{n-}$ is the same as in the formula (E) and the preferred scope thereof is also the same.

The nitrogen-containing unsaturated heteroring containing Z may contain a carbon, hydrogen, oxygen, or sulfur atom besides the nitrogen atom. A benzene ring may be condensed to the heteroring, and the heteroring may have a substituent. Examples of the formed heteroring include those the same as described as the examples of the nitrogen-containing unsaturated heteroring formed by using $A_1$, $A_2$, $A_3$ and $A_4$ in the formulae (F) and (G). The preferred scope thereof is also the same. Pyridine, quinoline, and isoquinoline rings are preferred.

In the case that the nitrogen-containing unsaturated heteroring containing Z has a substituent, examples of the substituent are the same as described as the examples of the substituent that the nitrogen-containing unsaturated heteroring formed by using $A_1$, $A_2$, $A_3$ and $A_4$ in the formulae (F) and (G) may have. The preferred scope thereof is also the same.

$R_3$ is preferably an alkyl or aralkyl group, which may be a substituted or unsubstituted group having 1–20 carbon atoms, and which may be straight, branched or cyclic. Examples of the substituent thereof are the same as described as the examples of the substituent that the alkyl group represented by $R_1$ or $R_2$ in the formula (F) may have. The preferred scope thereof is also the same. Particularly preferred are carbamoyl, oxycarbamoyl, acyl, aryl, sulfo (including sulfonate), carboxyl (including carboxylate), and (alkyl or aryl)amino. The case in which $R_3$ comprises plural (specifically, 2–67) repeating units of an ethyleneoxy or propyleneoxy group is also a preferred example.

The compound represented by the formula (H) that can be used in the present invention can easily be synthesized by methods which are widely known. The following literature is referred to: Quart. Rev., 16, 163 (1962).

Specific examples of the compound represented by the formula (H) that can be used in the present invention are shown below, but the present invention is not limited to these examples.

H-1

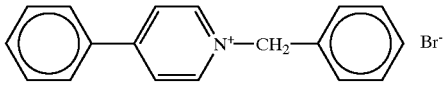

-continued

H-2

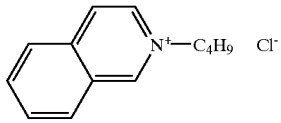

H-3

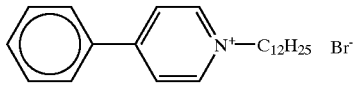

H-4

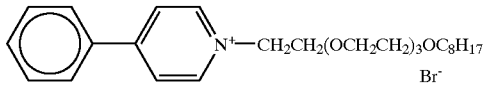

H-5

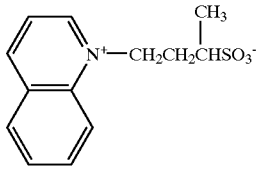

H-6

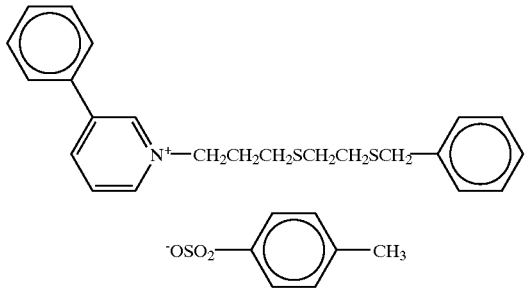

H-7

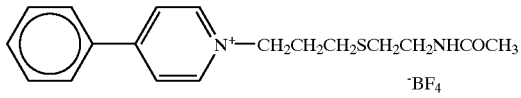

H-8

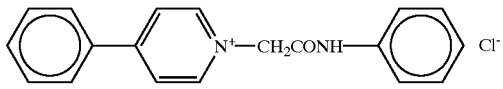

H-9

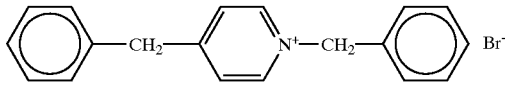

H-10

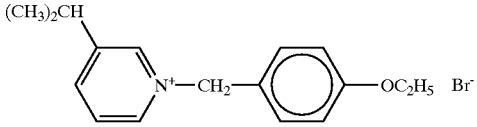

-continued

H-11

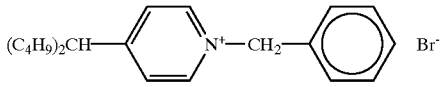

H-12

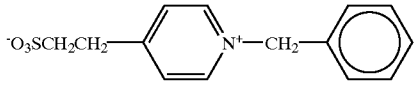

H-13

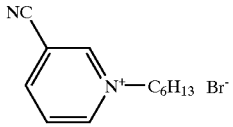

H-14

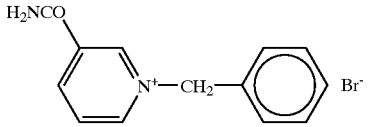

H-15

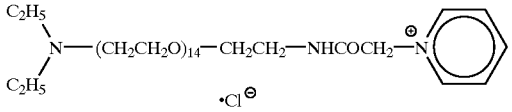

H-16

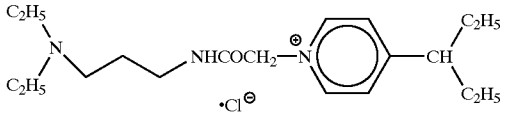

H-17

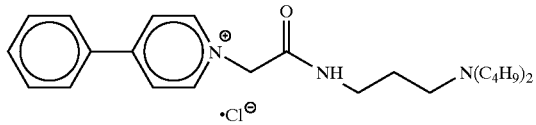

H-18

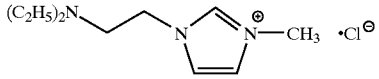

H-19

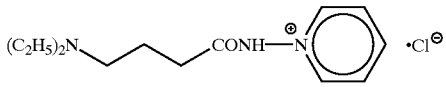

H-20

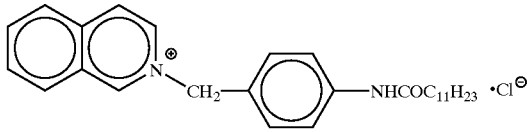

The nucleation accelerator for use in the present invention may be used after it is dissolved in a proper water-miscible organic solvent such as alcohols (methanol, ethanol, propanol or fluorinated alcohol), ketones (acetone or methyl ethyl ketone), dimethylformamide, dimethylsulfoxide or methyl cellosolve.

Also, the nucleation accelerator may be used after it is dissolved using an auxiliary solvent such as dibutylphthalate, tricresyl phosphate, an oil such as glyceryl triacetate or diethyl phthalate, ethyl acetate, or cyclohexanone, according to an already well-known emulsion-dispersion method, to produce an emulsified dispersion mechanically. Alternatively, the nucleation accelerator may be used by dispersing a powder of the nucleation accelerator in water by using a ball mill, colloid mill or ultrasonic waves, according to a method known as solid dispersing method.

In the present invention, the nucleation accelerator may be added to any layer of the silver halide emulsion layer and other hydrophilic colloidal layers on the side of the silver halide emulsion layer with respect to a support, but it is preferably added to the silver halide emulsion layer or a hydrophilic layer adjacent to the silver halide emulsion layer.

In the present invention, the amount of the nucleation accelerator to be added is preferably $1\times10^{-6}$ to $2\times10^{-2}$ mol, more preferably $1\times10^{-5}$ to $2\times10^{-2}$ mol, and most preferably $2\times10^{-5}$ to $1\times10^{-2}$ mol, per mol of silver halide. The nucleation accelerator may be used in combinations of two or more.

No particular limitation is imposed on the silver halide of the silver halide emulsion for use in the silver halide photographic light-sensitive material of the present invention. As the silver halide, silver chloride, silver chlorobromide, silver bromide, silver chlorobromoiodide or silver bromoiodide can be used, but silver chlorobromide or silver chlorobromoiodide containing 50 mol % or more of silver chloride is preferable. The silver halide grain may have any form, e.g., a cubic, tetradecahedron, octahedron, undefined shape and tabular, with cubic being preferable. The average grain diameter of the silver halide is preferably 0.1 $\mu$m to 0.7 $\mu$m and more preferably 0.1 to 0.5 $\mu$m. Silver halide grains having a narrow distribution of grain diameter are preferred, whose coefficient of variation given by the formula {(standard deviation of grain diameter)/(average grain diameter)}×100 is generally 15% or less and preferably 10% or less.

The silver halide grain may have a structure in which the inside and the surface are made of either uniform phases or different phases. The silver halide grain may also have a localized layer different in halogen composition in the inside or on the surface of the grain.

The photographic emulsion for use in the present invention can be prepared using methods described, for example, by P. Glafkides, in *Chimie et Physique Photographique*, Paul Montel (1967); by G. F. Duffin, in *Photographic Emulsion Chemistry*, The Focal Press (1966); and by V. L. Zelikman et al., in *Making and Coating Photographic Emulsion*, The Focal Press (1964).

More specifically, either an acid process or a neutral process may be used. Further, a method of reacting a soluble silver salt and a soluble halogen salt may be carried out by any of a single jet method, a double jet method, and a combination thereof. A method of forming grains in the presence of excessive silver ion (the so-called reverse-mixing method) may also be used.

As one form of the double jet method, a method of maintaining the pAg constant in the liquid phase where silver halide is produced, namely, a so-called controlled double jet method, may be used. Further, it is preferred to form grains using a so-called silver halide solvent, such as ammonia, thioether, or tetra-substituted thiourea, more preferably using a tetra-substituted thiourea compound, which are described in JP-A-53-82408 and JP-A-55-77737. Preferred examples of the thiourea compound include tetramethylthiourea and 1,3-dimethyl-2-imidazolidinethione. The amount of silver halide solvent to be added varies depending on the kind of the compound to be used or the grain size and the halogen composition to be obtained, but it is preferably from $10^{-5}$ to $10^{-2}$ mol, per mol of silver halide.

According to the controlled double jet method or the method of forming grains using a silver halide solvent, a silver halide emulsion comprising grains having a regular crystal form and a narrow grain size distribution can be easily prepared. These methods are useful means for preparing the silver halide emulsion for use in the present invention.

In order to render the grain size uniform, it is preferred to rapidly grow grains within the range not exceeding the critical saturation degree, using a method of changing the addition rate of silver nitrate or alkali halide according to the grain growth rate, as described in British Patent No. 1,535,016, JP-B-48-36890, and JP-B-52-16364, or a method of changing the concentration of the aqueous solution, as described in British Patent No. 4,242,445 and JP-A-55-158124.

The silver halide emulsion for use in the present invention may contain a metal that belongs to the group VIII. It is especially preferred to contain such a metal compound as a rhodium compound, an iridium compound and a ruthenium compound, to thereby attain a high contrast and a low fog. Further, the silver halide particles are advantageously doped with a metal complex hexacyanide such as $K_4[Fe(CN)_6]$, $K_4[Ru(CN)_6]$ or $K_3[Cr(CN)_6]$ for sensitivity enhancement.

As a rhodium compound for use in the present invention, a water-soluble rhodium compound can be used. Examples of the rhodium compound include rhodium (III) halide compounds, or rhodium coordination complex salts having halogen, amines, oxalato, or aqua, etc., as a ligand, such as a hexachloro rhodium (III) complex salt, a pentachloroaqua rhodium (III) complex salt, a tetrachlorodiaqua rhodium (III) complex salt, a hexabromo rhodium (III) complex salt, a hexamine rhodium (III) complex salt, and a trioxalato rhodium (III) complex salt. The above-described rhodium compound is generally dissolved in water or an appropriate solvent before use, and a method generally, commonly used for stabilizing a solution of the rhodium compound, namely, a method of adding an aqueous solution of hydrogen halogenide (e.g. hydrochloric acid, hydrobromine acid, hydrofluoric acid) or an alkali halide (e.g. KCl, NaCl, KBr, NaBr), may be used. It is also possible to add and dissolve separately prepared silver halide grains that are previously doped with rhodium, in place of a water-soluble rhodium compound, at the preparation of silver halide.

Rhenium, ruthenium, and osmium for use in the present invention can be added in the form of water-soluble complex salts of them, as described, for example, in JP-A-63-2042, JP-A-1-285941, JP-A-2-20852, and JP-A-2-20855. Among these, particularly preferred are hexa-coordination metal complexes represented by the following formula:

$$[ML_6]^{n-}$$

wherein M represents Ru, Re, or Os; L represents a ligand, and n represents 0, 1, 2, 3, or 4. A counter ion for the above-described complex is not so important, and use can be made of an ammonium ion or an alkali metal ion. Further, preferable examples of the ligand include a halide ligand, a cyanide ligand, a cyanate ligand, a nitrosyl ligand, and a thionitrosyl ligand. Specific examples of the complex for use in the present invention are illustrated below, but they are not intended to limit the scope of the invention.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CO)_3Cl_3]^{2-}$ | |

-continued

| | | |
|---|---|---|
| $[Ru(CO)Cl_5]^{2-}$ | $[RU(CO)Br_5]^{2-}$ | |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | $[Os(O)_2(CN)_4]^{4-}$ |

The addition amount of these compounds is preferably from $1\times10^{-9}$ mol to $1\times10^{-5}$ mol, and especially preferably from $1\times10^{-8}$ mol to $1\times10^{-6}$ mol, per mol of silver halide.

Examples of the iridium compound for use in the present invention include hexachloro iridium, hexabromo iridium, hexaammine iridium, and pentachloro nitrosyl iridium. Examples of the iron compound for use in the present invention include potassium hexacyano ferrate (II) and ferrous thiocyanate.

The silver halide emulsion for use in the present invention is preferably subjected to chemical sensitization. The chemical sensitization may be performed using a known method, such as sulfur sensitization, selenium sensitization, tellurium sensitization, or noble metal sensitization, and these sensitization methods may be used individually or in combination. When these sensitization methods are used in combination, a combination of sulfur sensitization and gold sensitization; a combination of sulfur sensitization, selenium sensitization, and gold sensitization; and a combination of sulfur sensitization, tellurium sensitization, and gold sensitization, are preferred.

The sulfur sensitization for use in the present invention is usually performed by adding a sulfur sensitizer and stirring the emulsion at a high temperature of 40° C. or higher for a predetermined time. The sulfur sensitizer to be used may be a known compound, and examples thereof include, in addition to the sulfur compound contained in gelatin, various sulfur compounds, such as thiosulfates, thioureas, thiazoles, and rhodanines. Preferred sulfur compounds are a thiosulfate and a thiourea compound. The addition amount of the sulfur sensitizer varies depending on various conditions, such as the pH and the temperature at the time of chemical ripening and the size of silver halide grains, but it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is generally performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-109240, JP-A-4-324855, and among these, particularly preferred are the compounds represented by formula (VIII) or (IX) in JP-A-4-324855.

The tellurium sensitizer for use in the present invention is a compound for forming silver telluride, which is presumed to become a sensitization nucleus, on the surface of or inside a silver halide grain. The formation rate of silver telluride in a silver halide emulsion can be examined according to a method described in JP-A-5-313284.

Specific examples of the tellurium sensitizer to be used include the compounds described in U.S. Pat. Nos. 1,623,499, 3,320,069, and 3,772,031, British Patent No. 235,211, British Patent No. 1,121,496, British Patent No. 1,295,462, and British Patent No. 1,396,696, Canadian Patent No. 800,958, JP-A-4-204640, JP-A-4-271341, JP-A-4-333043, JP-A-5-303157, *J. Chem. Soc. Chem. Commun.,* 635(1980); ibid., 1102 (1979); ibid., 645 (1979); *J. Chem. Soc. Perkin. Trans.,* 1, 2191 (1980); edited by S. Patai (compiler), *The Chemistry of Organic Serenium and Tellunium Compounds,*

Vol. 1 (1986); and ibid., Vol. 2 (1987). The compounds represented by formulae (II), (III), and (IV) in JP-A-4-324855 are particularly preferred.

The amount to be used of the selenium sensitizer or tellurium sensitizer for use in the present invention varies depending on the silver halide grains to be used or the chemical ripening conditions, but it is generally from in the order of $10^{-8}$ to $10^{-2}$ mol, preferably from $10^{-7}$ to $10^{-3}$ mol, per mol of silver halide. The conditions of chemical sensitization in the present invention are not particularly restricted, but the pH is generally from 5 to 8, the pAg is generally from 6 to 11, preferably from 7 to 10, and the temperature is generally from 40 to 95° C., preferably from 45 to 85° C.

Examples of the noble metal sensitizer for use in the present invention include gold, platinum, palladium, and iridium, and gold sensitization is particularly preferred. Specific examples of the gold sensitizer for use in the present invention include chloroauric acid, potassium chloroaurate, potassium auric thiocyanate, and gold sulfide. The gold sensitizer can be used in an amount of approximately from $10^{-7}$ to $10^{-2}$ mol per mol of silver halide.

In the silver halide emulsion for use in the present invention, a cadmium salt, a sulfite, a lead salt, or a thallium salt may be present together during formation or physical ripening of silver halide grains.

In the present invention, reduction sensitization may be used. Examples of the reduction sensitizer to be used include stannous salts, amines, formamidinesulfinic acid, and silane compounds.

To the silver halide emulsion for use in the present invention, a thiosulfonic acid compound may be added, according to the method described in European Unexamined Patent Publication (EP) -293,917.

As the silver halide emulsion in the light-sensitive material for use in the present invention, only one type may be used or two or more types (for example, those different in average grain size, in halogen composition, in crystal habit, in condition of chemical sensitization, or in sensitivity) may be used together. To obtain, particularly, high contrast, it is preferable to apply an emulsion with a higher sensitivity as the emulsion is closer to a support, as described in JP-A-6-324426.

The light-sensitive silver halide emulsion for use in the present invention may be spectrally sensitized to blue light, green light, red light or infrared light having relatively long wavelengths, by a sensitizing dye, and preferably it is spectrally sensitized by a spectrally sensitizing dye having a maximum absorption wavelength ranging from 450 nm to 600 nm. As the sensitizing dye, the compounds of the formula [I] described in JP-A-55-45015 and the compounds of the formula [I] described in JP-A-9-160185 are preferable, and the compounds of the formula [I] described in JP-A-9-160185 are particularly preferable. Specific examples include the compounds (1) to (19) described in JP-A-55-45015 and the compounds (I-1) to (I-40) and (I-56) to (I-85) described in JP-A-9-160185.

Examples of the sensitizing dye that can be used also include a cyanine dye, a merocyanine dye, a complex cyanine dye, a complex merocyanine dye, a holopolar cyanine dye, a styryl dye, a hemicyanine dye, an oxonol dye, and a hemioxonol dye.

Other useful sensitizing dyes for use in the present invention are described, for example, in *Research Disclosure*, Item 17643, IV-A (December, 1978, page 23); ibid., Item 18341 X (August 1979, page 437), and publications cited therein. In particular, sensitizing dyes having spectral sensitivity suitable for spectral characteristics of various light sources in a scanner, an image setter, or a photomechanical camera, can be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, Compounds of Examples 1 to 14 described in U.S. Pat. No. 2,161,331, and Compounds 1 to 7 described in West Germany Patent No. 936,071; B) for a helium-neon laser light source, Compounds I-1 to I-38 described in JP-A-54-18726, Compounds I-1 to I-35 described in JP-A-6-75322, and Compounds I-1 to I-34 described in JP-A-7-287338; C) for an LED light source, Dyes 1 to 20 described in JP-B-55-39818, Compounds I-1 to I-37 described in JP-A-62-284343, and Compounds I-I to I-34 described in JP-A-7-287338; D) for a semiconductor laser light source, Compounds I-1 to I-12 described in JP-A-59-191032, Compounds I-1 to I-22 described in JP-A-60-80841, Compounds I-i to I-29 described in JP-A-4-335342, and Compounds I-1 to I-18 described in JP-A-59-192242; and E) for a tungsten or xenon light source of a photomechanical camera, besides the above-described compounds, Compounds I-41 to I-55 and I-86 to I-97 described in JP-A-9-160185, Compounds 4-A to 4-S, 5-A to 5-Q, and 6-A to 6-T described in JP-A-6-242547, may be advantageously selected.

These sensitizing dyes may be used individually or in combination, and a combination of sensitizing dyes is often used for the purpose of, particularly, supersensitization. In combination with the sensitizing dye, a dye which itself has no spectral sensitization effect, or a material that absorbs substantially no visible light, but that exhibits supersensitization, may be incorporated into the emulsion.

Useful sensitizing dyes, combinations of dyes that exhibit supersensitization, and materials that show supersensitization are described, for example, in *Research Disclosure*, Vol. 176, 17643, page 23, Item IV-J (December 1978); or the above-mentioned JP-B-49-25500, JP-B-43-4933, JP-A-59-19032, and JP-A-59-192242.

The sensitizing dyes for use in the present invention may be used in a combination of two or more thereof. The sensitizing dye may be added to a silver halide emulsion by dispersing it directly in the emulsion, or by dissolving it in a sole or mixed solvent of such solvents of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol or N,N-dimethylformamide, and then adding the solution to the emulsion.

Alternatively, the sensitizing dye may be added to the emulsion by a method disclosed in U.S. Pat. No. 3,469,987, in which a dye is dissolved in a volatile organic solvent, and the resultant solution is dispersed in water or a hydrophilic colloid, and the dispersion is added to the emulsion; a method disclosed, for example, in JP-B-44-23389, JP-B-44-27555, and JP-B-57-22091, in which a dye is dissolved in an acid, and the resultant solution is added to the emulsion, or a dye is formed into an aqueous solution in the co-existence of an acid or base and then it is added to the emulsion; a method disclosed, for example, in U.S. Pat. Nos. 3,822,135 and 4,006,025, in which a dye is formed into an aqueous solution or a colloid dispersion in the presence of a surface-active agent together, and the solution or dispersion is added to the emulsion; a method disclosed in JP-A-53-102733 and JP-A-58-105141, in which a dye is directly dispersed in a hydrophilic colloid, and the dispersion is added to the emulsion; or a method disclosed in JP-A-51-74624, in which a dye is dissolved using a compound capable of red-shift, and the solution is added to the emulsion. Ultrasonic waves may also be used in the solution.

The sensitizing dye for use in the present invention may be added to a silver halide emulsion for use in the present invention at any step known to be useful during the preparation of a photographic emulsion. For example, the dye may be added at a step of formation of silver halide grains, and/or in a period before desalting, or at a step of desalting, and/or in a period between after desalting and before initiation of chemical ripening, as disclosed, for example, in U.S. Pat. Nos. 2,735,766, 3,628,960, 4,183,756, and 4,225,666, JP-A-58-184142, and JP-A-60-196749, or the dye may be added in any period or at any step before coating of the emulsion, such as immediately before or during chemical ripening, or in a period after chemical ripening but before coating, as disclosed, for example, in JP-A-58-113920. Also, a sole kind of compound alone, or compounds different in structure in combination, may be added in divided manner; for example, a part during grain formation, and the remaining during chemical ripening, or after completion of the chemical ripening; or a part before or during chemical ripening, and the remaining after completion of the chemical ripening, as disclosed, for example, in U.S. Pat. No. 4,225,666 and JP-A-58-7629. The kind of compounds added in divided manner, or the kind of the combination of compounds, may be changed.

The addition amount of the sensitizing dye for use in the present invention varies depending upon the shape, size, the halogen composition of silver halide grains, the method and degree of chemical sensitization, the kind of antifoggant, and the like, but the addition amount can be from $4\times10^{-6}$ to $8\times10^{-3}$ mol per mol of silver halide. For example, when the silver halide grain size is from 0.2 to 1.3 $\mu$m, the addition amount is preferably from $2\times10^{-7}$ to $3.5\times10^{-6}$, more preferably from $6.5\times10^{-7}$ to $2.0\times10^{-6}$ mol, per $m^2$ of the surface area of a silver halide grain.

Various additives for use in the light-sensitive material of the present invention are not particularly restricted, and, for example, those described in the following portions may be preferably used:

Polyhydroxybenzene compounds described in JP-A-3-39948, from page 10, right lower column, line 11, to page 12, left lower column, line 5, specifically, Compounds (III)-1 to -25 described in the publication;

Compounds represented by formula (I) and having substantially no maximum absorption in the visible region, as described in JP-A-1-118832, specifically, Compounds I-1 to I-26 described in the publication;

Antifogging agents described in JP-A-2-103536, page 17, right lower column, line 19, to page 18, right upper column, line 4;

Polymer latexes described in JP-A-2-103536, page 18, left lower column, lines 12 to 20; polymer latexes having an activated methylene group, as represented by formula (I), as described in JP-A-9-179228, specifically, Compounds I-1 to I-16 described in the specification thereof; polymer latexes having a core/shell structure, as described in JP-A-9-179228, specifically, Compounds P-1 to P-55 described in the specification thereof; acidic polymer latexes described in the publication of JP-A-7-104413, page 14, left column, line 1 to right column, line 30, specifically the compounds II-1) to II-9) described in the same publication, page 15;

Matting agents, slipping agents, and plasticizers, as described in JP-A-2-103536, from page 19, left upper column, line 15, to right upper column, line 15;

Hardening agents described in JP-A-2-103536, page 18, right upper column, lines 5 to 17;

Compounds having an acid group, as described in JP-A-2-103536, from page 18, right lower column, line 6, to page 19, left upper column, line 1;

Electrically conductive materials described in JP-A-2-18542, from page 2, left lower column, line 13, to page 3, right upper column, line 7, specifically, metal oxides described in the publication, page 2, right lower column, lines 2 to 10, and electrically conductive high-molecular compounds of Compounds P-1 to P-7 described in the publication;

Water-soluble dyes described in JP-A-2-103536, from page 17, right lower column, lines 1 to page 17, right upper column, line 18;

Solid dispersion dyes represented by formulae (FA), (FA1), (FA2), or (FA3), as described in JP-A-9-179243, specifically, Compounds F1 to F34 in the specification thereof, and Compounds (II-2) to (II-24), (III-5) to (III-18), and (IV-2) to (IV-7) described in JP-A-7-152112; solid dispersion dyes described in JP-A-2-294638 and JP-A-5-11382;

Surface-active agents described in JP-A-2-12236, from page 9, right upper column, line 7 to page 9, right lower column, line 3; PEG-series surface-active agents described in JP-A-2-103536, page 18, left lower column, lines 4 to 7; fluorin-containing surface-active agents described in JP-A-3-39948, from page 12, left lower column, line 6, to page 13, right lower column, line 5, specifically, Compounds VI-1 to VI-15 described in the publication;

Binders described in the publication of JP-A-2-18542, page 3, right lower column, line 1 to line 20.

The degree of swelling of the hydrophilic colloid layers of the silver halide photographic light-sensitive material of the present invention, including a silver halide emulsion layer and a protective layer, is preferably from 80 to 150%, and more preferably from 90 to 140%. The degree of swelling of the hydrophilic colloid layers is obtained by measuring the thickness ($d_0$) of the hydrophilic colloid layers, including a silver halide emulsion layer and a protective layer, of the silver halide photographic light-sensitive material, measuring the swollen thickness ($\Delta d$) of the said silver halide photographic light-sensitive material after it has been dipped in distilled water at 25° C. for 1 minute, and following the calculating equation set forth below.

$$\text{Degree of swelling } (\%)=(\Delta d)\div d_0\times100$$

The pH of a film surface on the side to which the silver halide emulsion layer of the silver halide photographic light-sensitive material of the present invention is applied is generally in a range of 4.5 to 7.5, preferably 4.8 to 7.0 and particularly preferably 5.0 to 6.0.

Examples of the support (base) that can be used in practice of the present invention include a baryta paper, a polyethylene-coated paper, a polypropylene synthetic paper, a glass plate, cellulose acetate, cellulose nitrate, and polyester films, such as polyethylene terephthalate. These supports are properly selected in accordance with the use purpose of each silver halide photographic light-sensitive material.

Also, a support composed of a styrene-series polymer having a syndiotactic structure, as described in JP-A-7-234478 and U.S. Pat. No. 558,979, is preferably used.

The processing agents, such as the developer and the fixing solution, and the processing methods for use in the present invention are described below, but the invention is by no means limited to the following description and specific examples.

The development processing for use in the present invention may be performed by any known method, and a known development processing solution may be used.

The developing agent for use in the developer (the development-initiating solution and the development replenisher are collectively called a developer, hereinafter the same) used in the present invention is not particularly restricted, but it preferably contains a dihydroxybenzene compound, ascorbic acid and its derivative or a hydroquinone monosulfonate, individually or in combination. Particularly, it is preferable for the developer to contain a combination of a dihydroxybenzene-series developing agent with an auxiliary developing agent that shows superadditivity. Examples of such a combination include the combination of dihydroxybenzenes and/or ascorbic acid derivatives with 1-phenyl-3-pyrazolidones, and the combination of dihydroxybenzenes and/or ascorbic acid derivatives with p-aminophenol compounds.

Examples of the dihydroxybenzene developing agent for use in the present invention include hydroquinone, chlorohydroquinone, isopropylhydroquinone, and methylhydroquinone, with hydroquinone being particularly preferred. As an ascorbic acid derivative-type developing agent, ascorbic acid or isoascorbic acid or their salts may be used. Particularly sodium erysorbate is preferable in view of material costs.

Examples of the 1-phenyl-3-pyrazolidones or derivatives thereof as the developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol-series developing agent for use in the present invention include N-methyl-p-aminophenol, p-aminophenol, N-(β-hydroxyphenyl)-p-aminophenol, N-(4- hydroxyphenyl)glycine, o-methoxy-p-(N,N-dimethylamino)phenol, and o-methoxy-p-(N-methylamino)phenol, with N-methyl-p-aminophenol and aminophenols, described in JP-A-9-297377 and JP-A-9-297378 being preferred.

The dihydroxybenzene-series developing agent is preferably used in an amount of generally from 0.05 to 0.8 mol/l. When a dihydroxybenzene compound and a 1-phenyl-3-pyrazolidone compound or a p-aminophenol compound are used in combination, the former is preferably used in an amount of from 0.05 to 0.6 mol/l, more preferably from 0.10 to 0.5 mol/l, and the latter is preferably used in an amount of 0.06 mol/l or less, more preferably from 0.03 to 0.003 mol/l.

The ascorbic acid derivative-type developing agent is used in an amount of generally 0.01 mol/l to 0.5 mol/l and more preferably 0.05 mol/l to 0.3 mol/l. When a combination of an ascorbic acid derivative and a 1-phenyl-3-pyrazolidone compound or a p-aminophenol compound is used, preferably the ascorbic acid derivative is used in an amount of 0.01 mol/l to 0.5 mol/l and 1-phenyl-3-pyrazolidones or p-aminophenols are used in an amount of 0.005 mol/l to 0.2 mol/l.

The developer used in processing the light-sensitive material of the present invention may contain additives (e.g. a developing agent, an alkali agent, a pH buffer, a preservative, a chelating agent) that are commonly used. Specific examples thereof are described below, but the present invention is by no means limited thereto.

Examples of the buffer for use in the developer used in development-processing of the light-sensitive material of the present invention include carbonates, boric acids described in JP-A-62-186259, saccharides (e.g. saccharose) described in JP-A-60-93433, oximes (e.g. acetoxime), phenols (e.g. 5-sulfosalicylic acid), and tertiary phosphates (e.g. sodium salt and potassium salt), with carbonates and boric acids being preferred. The buffer, particularly the carbonate, is preferably used in an amount of 0.1 mol/l or more, particularly preferably from 0.2 to 1.5 mol/l.

Examples of the preservative for use in the present invention include sodium sulfite, potassium sulfite, lithium sulfite, ammonium sulfite, sodium bisulfite, sodium methabisulfite, and formaldehyde-sodium bisulfite (adduct). The sulfite is used in an amount of preferably 0.2 mol/l or more, particularly preferably 0.3 mol/l or more, but if it is added too excessively, silver staining in the developer is caused. Accordingly, the upper limit is preferably 1.2 mol/l. The amount is particularly preferably from 0.35 to 0.7 mol/l.

As a preservative for a dihydroxybenzene-series developing agent, the aforementioned ascorbic acid derivative may be used in a small amount together with a sulfite. Among these ascorbic derivatives, it is preferable to use sodium erysorbate in view of material costs. The amount of the ascorbic acid derivative to be added is in a range of preferably 0.03 to 0.12 and particularly preferably 0.05 to 0.10 in terms of mol ratio to dihydroxybenzene-series developing agent. When an ascorbic acid derivative is used as a preservative, it is not preferable that a boron compound is contained in the developer.

Examples of additives to be used other than those described above include a development inhibitor, such as sodium bromide and potassium bromide, an organic solvent, such as ethylene glycol, diethylene glycol, triethylene glycol, and dimethylformamide; a development accelerator, such as an alkanolamine including diethanolamine and triethanolamine, and an imidazole and derivatives thereof; and a physical development unevenness inhibitor, such as a heterocyclic mercapto compound (e.g. sodium 3-(5-mercaptotetrazol-1-yl)benzene sulfonate, 1-phenyl-5-mercaptotetrazole) and the compounds described in JP-A-62-212651.

Further, a mercapto-series compound, an indazole-series compound, a benzotriazole-series compound, or a benzimidazole-series compound may be added, as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzoimidazole, 2-isopropyl-5-nitrobenzoimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, and 2-mercaptobenzotriazole. The addition amount thereof is generally from 0.01 to 10 mmol, preferably from 0.1 to 2 mmol, per liter of the developer.

Further, various kinds of organic or inorganic chelating agents can be used individually or in combination in the developer for use in the present invention.

Examples of the inorganic chelating agent include sodium tetrapolyphosphate and sodium hexametaphosphate.

Examples of the organic chelating agent include organic carboxylic acid, aminopolycarboxylic acid, organic phosphonic acid, aminophosphonic acid, and organic phosphonocarboxylic acid.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, and tartaric acid. Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acid, described in U.S. Pat. Nos. 3,214,454 and 3,794,591 and West German Patent Publication (OLS) No. 2,227,369, and the compounds described in *Research Disclosure*, Vol. 181, Item 18170 (May 1979).

Examples of the aminophosphonic acid include aminotris(methylenephosphonic acid), ethylenediamine tetramethylenephosphonic acid, aminotrimethylenephosphonic acid, and the compounds described in *Research Disclosure*, No. 18170 (supra), JP-A-57-208554, JP-A-54-61125, JP-A-55-29883, and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A- 55-126241, JP-A-55-65955, JP-A-55-65956, and *Research Disclosure*, No. 18170 (supra).

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$ to $1\times10^{31\ 1}$ mol. more preferably from $1\times10^{-3}$ to $1\times10^{-2}$ mol, per liter of the developer.

Examples of the silver stain inhibitor added to the developer include the compounds described in JP-A-56-24347, JP-B-56-46585, JP-B-62-2849, JP-A-4-362942, and JP-A-8-6215; triazines having one or more mercapto groups (for example, the compounds described in JP-B-6-23830, JP-A-3- 282457, and JP-A-7-175178); pyrimidines having one or more mercapto groups (e.g. 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, compounds described in JP-A-9-274289); pyridines having one or more mercapto groups (e.g. 2-mercaptopyridine, 2,6-dimercaptopyridine, 3,5-dimercaptopyridine, 2,4,6-trimercaptopyridine, compounds described in JP-A-7-248587); pyrazines having one or more mercapto groups (e.g. 2-mercaptopyrazine, 2,6-dimercaptopyrazine, 2,3-dimercaptopyrazine, 2,3,5-trimercaptopyrazine); pyridazines having one or more mercapto groups (e.g. 3-mercaptopyridazine, 3,4-dimercaptopyridazine, 3,5-dimercaptopyridazine, 3,4,6-trimercaptopyridazine); the compounds described in JP-A-7-175177, and polyoxyalkylphosphates described in U.S. Pat. No. 5,457,011. These silver stain inhibitors may be used individually or in combination of two or more of these. The addition amount thereof is preferably from 0.05 to 10 mmol, more preferably from 0.1 to 5 mmol, per liter of the developer.

The developer may contain the compounds described in JP-A-61-267759, as a dissolution aid.

Further, the developer may contain a color toner, a surface-active agent, a defoaming agent, or a hardening agent, if necessary.

The developer preferably has a pH of from 9.0 to 12.0, more preferably from 9.0 to 11.0, particularly preferably from 9.5 to 11.0. The alkali agent used for adjusting the pH may be a usual water-soluble inorganic alkali metal salt (e.g. sodium hydroxide, potassium hydroxide, sodium carbonate, potassium carbonate, or the like).

With respect to the cation of the developer, potassium ion does not inhibit development but causes small indentations, called a fringe, on the periphery of the blacked portion, as compared with sodium ion. When the developer is stored as a concentrated solution, potassium salt is generally preferred, because of its higher solubility. However, since, in the fixing solution, potassium ion causes fixing inhibition on the same level as caused by silver ion, if the developer has a high potassium ion concentration, the developer is carried over by the light-sensitive material, to disadvantageously increase the potassium ion concentration in the fixing solution. Accordingly, the molar ratio of potassium ion to sodium ion in the developer is preferably between 20:80 and 80:20. The ratio of potassium ion to sodium ion can be freely controlled within the above-described range by a counter cation, such as a pH buffer, a pH-adjusting agent, a preservative, or a chelating agent.

The replenishing amount of the developer replenisher is generally 390 ml or less, preferably from 325 to 30 ml, and most preferably from 250 to 120 ml, per $m^2$ of the light-sensitive material. The developer replenisher may have the same composition and/or concentration as the development initiating solution, or it may have a different composition and/or concentration from the initiating solution.

Examples of the fixing agent in the fixing processing agent for use in the present invention include ammonium thiosulfate, sodium thiosulfate, and ammonium sodium thiosulfate. The amount to be used of the fixing agent may be varied appropriately, but it is generally from about 0.7 to about 3.0 mol/l.

The fixing solution for use in the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, and aluminum lactate. These are each preferably contained, in terms of an aluminum ion concentration in the use solution, in an amount of from 0.01 to 0.15 mol/l.

When the fixing solution is stored as a concentrated solution or a solid agent, it may be constituted by a plurality of parts, preparing a hardening agent or the like as a separate part, or it may be constituted as a one-part agent containing all components.

The fixing processing agent may contain, if desired, a preservative (e.g. sulfite, bisulfite, metabisulfite; in an amount of generally 0.015 mol/l or more, preferably from 0.02 to 0.3 mol/1), a pH buffer (e.g. acetic acid, sodium acetate, sodium carbonate, sodium hydrogencarbonate, phosphoric acid, succinic acid, adipic acid; in an amount of generally from 0.1 to 1 mol/l, preferably from 0.2 to 0.7 mol/l), or a compound having aluminum-stabilizing ability or hard-water-softening ability (e.g. gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron (trade name), ascorbic acid, glutaric acid, aspartic acid, glycine, crysteine, ethylenediaminetetraacetic acid, nitrilotriacetic acid, and a derivative and salt thereof, saccharides, and boric acid; in an amount of generally from 0.001 to 0.5 mol/l, preferably from 0.005 to 0.3 mol/l).

In addition, the fixing processing agent may contain a compound described in JP-A-62-78551, a pH-adjusting agent (e.g. sodium hydroxide, ammonia, sulfuric acid), a surface-active agent, a wetting agent, or a fixing accelerator. Examples of the surface-active agent include anionic surface-active agents, such as sulfated products and sulfonated products; polyethylene-series surface-active agents, and amphoteric surface-active agents described in JP-A-57-

6840. A known deforming agent may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535, and JP-B-58-122536; alcohols having a triple bond within the molecule; thioether compounds described in U.S. Pat. No. 4,126,459; mercapto compounds described in JP-A-64-4739, JP-A-1-4739, JP-A-1-159645, and JP-A-3-101728; thiocyanates and meso-ionic compounds described in JP-A-4-170539.

The fixing solution for use in the present invention has a pH of generally 4.0 or more, preferably from 4.5 to 6.0. The pH of the fixing solution increases due to mingling of the developer upon processing, and in this case, the hardening fixing solution has a pH of generally 6.0 or less, preferably 5.7 or less, and the non-hardening fixing solution has a pH of generally 7.0 or less, preferably 6.7 or less.

The replenishing amount of the fixing solution is generally 500 ml or less, preferably 390 ml or less, more preferably from 320 to 80 ml, per 1 $m^2$ of the light-sensitive material. The replenisher may have the same composition and/or concentration as the initiating solution, or it may have a composition and/or a concentration different from the initiating solution.

The fixing solution may be regenerated and reused using a known fixing solution regenerating method, such as electrolytic silver recovery. Examples of the regeneration apparatus include Reclaim R-60, trade name, manufactured by Fuji Hunt KK.

It is also preferred to remove dyes or the like through an adsorption filter, such as activated carbon.

When the development and fixing processing agents for use in the present invention are liquid agents, it is preferable to store these agents in packing material having low oxygen-permeability as described in, for example, JP-A-61-73147. Moreover, when these solutions are concentrated solutions, they are used after being diluted by adding water in a ratio of 0.2 to 3 parts to 1 part of the concentrated solution such that a given concentration is obtained.

Even if the development- and fixing-processing agents used in the present invention are solids, the same results as those of the liquid agents can be obtained. Descriptions concerning the solid processing agents will be shown hereinbelow.

For the solid agents for use in the present invention, known forms (e.g., a powder, particle, granule, block, tablet, compactor, briquette, plate, bar and paste) may be used. These solid agents may be coated with a water-soluble coating agent or film to separate components, which are mutually brought into contact and reacts, from each other, or may have a structure of plural layers to separate components, which mutually reacts, from each other. Also, these means may be combined.

As the coating agent and granulation auxiliary for use in the present invention, known materials may be used and a polyvinylpyrrolidone, polyethylene glycol, polystyrenesulfonic acid or vinyl-series compound is preferable. Besides the above compounds, the description of JP-A-5-45805, column 2, line 48 to column 3, line 13 can be made to reference.

When a structure of plural layers is adopted, a material having the structure in which a component that is not reactive is interposed between components that react with each other when brought into contact, may be prepared and may be processed into a tablet or a briquette or the like. Also, components having known forms are used to make the above same layer structure, which is then packaged. These methods are shown in, for example, JP-A- 61-259921, JP-A-4-16841, JP-A-4-78848 and JP-A-5-93991.

The apparent density of the solid agent is preferably 0.5 to 6.0 g/$cm^3$, specifically, 1.0 to 5.0 g/$cm^3$ in the case of a tablet and 0.5 to 1.5 g/$cm^3$ in the case of a granule.

As the method of the production of the solid agent for use in the present invention, any known method may be used. For example, methods described in JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and the like can be made to reference.

More specifically, a rolling granulation method, extrusion granulation method, compression granulation method, cracking granulation method, agitation granulation method, spray drying method, dissolution solidification method, briquetting method, roller compacting method, or the like may be used.

The solid agent for use in the present invention may be changed in surface condition (e.g. smoothness and porousness) and thickness in part, or it may be made into a hollow donut shape, to control solubility. It is also possible to make the solid agents have plural shapes, in order to give plural granulated materials different solubilities, or to make materials having different solubilities accord with each other in solubility. Further, multilayer granulated materials in which the surface and the inside have different compositions may be used.

As the packing material for the solid agent, materials which have low oxygen and water permeability are preferable and as the shape of the package material, known shapes such as a bag form, cylinder form and box form may be used. A foldable form as disclosed in JP-A-6-242585 to JP-A-6-242588, JP-A-6-247432, JP-A-6-247448, JP-A-6-301189, JP-A-7-5664 and JP-A-7-5666 to JP-A-7-5669 is preferable to decrease a space required for storing discarded packings. These packing materials may be provided with a screw cap, pull-top, or aluminum seal at the take-off port or may be heat-sealed. Also, other known materials may be used and the packing materials are not particularly restricted. Moreover, it is preferable to recycle or reuse discarded packings in view of environmental safeguard.

There is no particular limitation to a method of dissolving and replenishing the solid agent for use in the present invention and known methods may be used. Examples of these methods include a method in which a fixed amount of solid agent is dissolved in a dissolving apparatus with a stirring function and replenished, a method in which the solid agent is dissolved in a dissolving apparatus comprising a dissolution section and a section for stocking a complete solution and is replenished from the stock section as disclosed in JP-A-9-80718, a method in which the processing agent is introduced into a circulatory system of an automatic developing machine to dissolve and replenish the processing agent as disclosed in JP-A-5-119454, JP-A-6-19102 and JP-A-7-261357 and a method in which corresponding to the processing of a light-sensitive material the processing agent is introduced into and dissolved in an automatic developing machine with a built-in dissolving vessel. Also, any one of known methods besides the above methods may be used. Also, the processing agent may be introduced either by human hands or by opening the seal and introducing automatically by using a dissolution apparatus comprising a seal-opening mechanism as described in JP-A-9-138495 and using an automatic developing machine. The latter is preferable in view of working circumstance. Specifically, there are methods of breaking through, peeling off, cutting off and push-cutting the take-off port and methods described in JP-A-6-19102 and JP-A-6-95331.

The light-sensitive material processed through development and fixing is then subjected to water-washing or stabilization (hereinafter, unless otherwise specified, water-washing includes stabilization, and the solution for use therein is called water or washing water). The water for use in water-washing may be tap water, ion exchanged water, distilled water, or a stabilizing solution. The replenishing amount of the washing water is generally from about 17 to about 8 liter per $m^2$ of the light-sensitive material, but a replenishing amount lower than the above-described range may also be used. In particular, when the replenishing amount is 3 liter or less (including 0, namely, standing water washing), not only can the processing achieve water savings, it can also dispense with piping for installation of an automatic developing machine. When water-washing is performed with a small replenishing amount of water, a rinsing tank of a squeeze roller or a crossover roller, described in JP-A-63-18350 and JP-A-62-287252, is preferably provided. Alternatively, addition of various oxidizing agents (e.g. ozone, hydrogen peroxide, sodium hypochlorite, active halogen, chlorine dioxide, sodium carbonate hydrogen peroxide salt) or filter filtration may be combined, so as to reduce the pollution load, which is a problem incurred in the case of water-washing with a small amount of water, or for preventing water scale. As the method for reducing the replenishing amount of washing water, a multi-stage countercurrent system (for example, two or three stages) has been known for a long time, and the replenishing amount of washing water is preferably from 200 to 50 ml per $m^2$ of the light-sensitive material. This effect can also be obtained similarly in the case of an independent multi-stage system (a method of not using a countercurrent system but supplying a new solution individually to the multi-stage water-washing tanks).

In the method in the present invention, a means for preventing water scale may be provided in the water-washing step. The water-scale-preventing means is not particularly restricted, and a known means may be used. Examples thereof include a method of adding a fungicide (a so-called water scale inhibitor), a method of passing electricity, a method of irradiating ultraviolet rays, infrared rays, or far infrared rays, a method of applying a magnetic field, a method of treating with ultrasonic waves, a method of applying heat, and a method of evacuating the tank on standing. The water-scale-preventing means may be applied according to the processing of the light-sensitive material; it may be applied at a predetermined interval irrespective of the use state, or it may be applied only in the period of non-processing time, such as nighttime. Further, the washing water may be previously treated with a water-scale-preventing means and then replenished. Further, in view of preventing generation of resistant microbes, it is preferred to perform different water-scale-preventing means at predetermined intervals.

The fungicide is not particularly restricted, and a known fungicide may be used. Examples thereof include, in addition to the above-described oxidizing agents, a glutaraldehyde, a chelating agent, such as aminopolycarboxylic acid, a cationic surface-active agent, and a mercaptopyridine oxide (e.g. 2-mercaptopyridine-N-oxide), and a sole fungicide may be used, or a plurality of fungicides may be used in combination.

The electricity may be passed according to the method described in JP-A-3-224685, JP-A-3-224687, JP-A-4-16280, or JP-A-4-18980.

In addition, a known water-soluble surface-active agent or defoaming agent may be added, so as to prevent uneven processing due to bubbling, or to prevent transfer of stains. Further, a dye adsorbent described in JP-A-63-163456 may be provided in the water-washing system, so as to prevent stains due to a dye dissolved out from the light-sensitive material.

An overflow solution from the water-washing step may be partly or wholly used by mixing it with the processing solution having fixing ability, as described in JP-A-60-235133. It is also preferred, in view of conservation of the natural environment, to reduce the biochemical oxygen demand (BOD), chemical oxygen demand (COD), or iodine consumption before discharge, by subjecting the solution to microorganism treatment (for example, sulfur oxidation bacteria or activated sludge treatment, or treatment with a filter comprising a porous carrier, such as activated carbon or ceramic, having carried thereon microorganisms) or oxidation treatment with an oxidizing agent or electrification, or to reduce the silver concentration in waste water by passing the solution through a filter, using a polymer having affinity for silver, or by adding a compound that forms a hardly soluble silver complex, such as trimercaptotriazine, to precipitate silver, and then passing the solution through a filter.

In some cases, stabilization may be performed subsequent to the water-washing, and as one example, a bath containing the compounds described in JP-A-2-201357, JP-A-2-132435, JP-A-1-102553, and JP-A-46-44446 may be used as a final bath of the light-sensitive material. This stabilization bath may also contain, if desired, an ammonium compound, a metal compound, such as Bi or Al, a fluorescent brightening agent, various chelating agents, a layer pH-adjusting agent, a hardening agent, a bactericide, a fungicide, an alkanolamine, or a surface-active agent.

The additives, such as a fungicide and a stabilizing agent added to the water-washing or stabilization bath, may be formed into a solid agent, similarly to the above-described development and fixing processing agents.

Wastewater of the developer, the fixing solution, the washing water, or the stabilizing solution for use in the present invention, is preferably burned for disposal. The wastewater can also be formed into a concentrated solution or a solid by a concentrating apparatus, as described, for example, in JP-B-7-83867 and U.S. Pat. No. 5,439,560, and then disposed.

When the replenishing amount of the processing agent is reduced, it is preferred to prevent evaporation or air oxidation of the solution, by reducing the contact area of the processing tank with air. A roller transportation-type automatic-developing machine is described, for example, in U.S. Pat. Nos. 3,025,779 and 3,545,971, and in the present specification, it is simply referred to as a roller transportation-type automatic processor. This automatic processor comprises four steps of development, fixing, water-washing, and drying, and it is most preferred to follow this four-step processing also in the present invention, though other steps (e.g. stopping step) are not excluded. Further, a rinsing bath may be provided between development and fixing, and/or between fixing and water-washing.

In the processing in the present invention, the dry-to-dry time is preferably from 25 to 160 seconds, the development time and the fixing time are each generally 40 seconds or less, preferably from 6 to 35 seconds, and the temperature of each solution is preferably from 25 to 50° C., more preferably from 30 to 40° C. The temperature and the time of water-washing are preferably from 0 to 50° C. and 40 seconds or less, respectively. According to the method in the present invention, the light-sensitive material after development, fixing, and water-washing may be passed through squeeze rollers, for squeezing washing water, and then dried. The drying is generally performed at a temperature of from about 40° C. to about 100° C. The drying time may be appropriately varied depending upon the ambient state. The drying method is not particularly restricted, and any known method may be used, but hot-air drying, and drying by far infrared rays or a heat roller as described in JP-A-4-15534, JP-A-5-2256, and JP-A-5-289294 may be used, and a plurality of drying methods may also be used in combination.

The silver halide photographic light-sensitive material of the present invention is a silver halide photographic light-sensitive material that has high sensitivity, high contrast (e.g., $\gamma$ is 10 or more), and high maximum density (high Dmax) as its photographic properties, and that also shows excellent original reproduction, and that is more enhanced in its properties.

The silver halide photographic light-sensitive material of the present invention is, in addition to the above, a silver halide photographic light-sensitive material that is reduced in the variations of sensitivity, γ, and Dmax, and that shows also excellent original reproduction, even if the light-sensitive material is processed in a developer in which the concentration of sulfurous acid, introduced as a preservative, is decreased and the pH is changed by deterioration with the lapse of time, or even if it is processed in a developer in which the pH is changed and the concentration of bromine ions is increased due to processing of a large number of films.

The processing method of the present invention is a processing method of a silver halide photographic light-sensitive material, which method makes it possible to give an image having high sensitivity, high contrast, high Dmax and high original-reproducibility, even if a developing solution having a pH lower than conventional developing solutions is used.

The silver halide photographic light-sensitive material of the present invention has high sensitivity, high contrast, and high maximum density, and it also has wide latitude for exposure, and it is excellent in ordinal-reproducibility. In particular, the silver halide photographic light-sensitive material of the present invention has a remarkable effect of exhibiting excellent original-reproducibility about superfine images. Even if this material is developed with an exhausted developing solution, change in the above-mentioned properties is small. Thus, a stable image can be obtained.

According to the processing method of the present invention, using this silver halide photographic light-sensitive material, a stable ultra-high contrast image excellent in the original-reproducibility can be realized, using a developing solution having a pH value of 11.0 or less.

The present invention will be described in more detail based on examples given below, but the present invention is not meant to be limited by these examples.

The present invention will now be described in more detail with reference to the following examples, but the invention is not limited to those.

EXAMPLES

Example 1

<Preparation of Silver Halide Emulsion A>

500 ml of an aqueous silver nitrate solution in which 150 g of silver nitrate was dissolved, and 500 ml of an aqueous halide solution in which 44 g of potassium bromide and 34 g of sodium chloride were dissolved and $(NH_4)_2RhCl_5(H_2O)$ and $K_3IrCl_6$ were included in amounts equivalent to $2\times10^{-7}$ mol and $1\times10^{-7}$ mol respectively per 1 mol of silver in terms of formed grains, were added to an aqueous 2% gelatin solution, in which 2 g of sodium chloride, 0.02 g of 1,3-dimethyl-2-imidazolithion, 0.5 g of citric acid, 4 mg of sodium benzenethiosulfonate, and 1 mg of sodium benzenesulfinate were dissolved in 1 liter of water, at 38° C. over 20 minutes with stirring by using a double jet method, to obtain grains of silver chlorobromide having an average grain size of 0.21 μm and containing silver chloride in a content of 58 mol %, thereby forming a nuclei. In succession, 200 ml of an aqueous silver nitrate solution in which 50 g of silver nitrate was dissolved, and 200 ml of an aqueous halide solution in which 12 g of potassium bromide and 13 g of sodium chloride were dissolved and potassium hexacyano iron (II) acid was included in an amount equivalent to $1\times10^{-5}$ mol per 1 mol of silver of a total emulsion, were added to the resulting solution over 10 minutes by using a double jet method.

Thereafter, thereto was added a KI solution in an amount of $1\times10^{-3}$ mole per mole of silver, to perform conversion. The resultant solution was washed with water by a flocculation method according to a usual manner. Specifically, the temperature of the solution was fallen to 35° C., and thereto was added 3 g of the following anionic precipitating agent-1. Sulfuric acid was used to lower the pH of the solution until silver halide precipitated. (The pH was within the range of 3.2±0.2.) Then, about 3 liters of the supernatant was removed (first water-washing). Furthermore, 3 liters of distilled water was added thereto, and then sulfuric acid was added thereto until silver halide precipitated. Three liters of the supernatant was again removed (second water-washing). The same operation as in the second water-washing was repeated one time (third water-washing). Thus, the water-washing and desalting steps were completed. To the emulsion after the water-washing and desalting, was added gelatin in an amount of 40 g per mole of silver, to adjust the pH of the emulsion to 5.9 and the pAg thereof to 7.5. Thereafter, thereto were added 16 mg of sodium benzenethiosulfonate, 4 mg of sodium benzenesulfinate, 3 mg of sodium thiosulfate, 4 mg of triphenylphosphine selenide, and 8 mg of chlorauric acid, per mole of silver. The emulsion was heated at 55° C. for 60 minutes and subjected to chemical sensitization. Thereafter, thereto were added 150 mg of 4-hydroxy-6-methyl-1,3,3a,7-tetrazaindene as a stabilizer and 100 mg of PROXEL (trade name) made by ICI Co., Ltd. as an antiseptic. The resultant grains were silver iodochlorobromide cubic grains having an average grain size of 0.20 μm, a coefficient of variation of 10%, and a silver chloride content of 60% by mole. (Finally, the emulsion had the following properties: pH=5.9, pAg=7.2, conductivity=37 μS/m, density=$1.20\times10^{-3}$ kg/m$^3$, and viscosity=20 mPa·s)

<Preparation of Silver Halide Emulsion B>

250 ml of an aqueous silver nitrate solution in which 75 g of silver nitrate was dissolved, and 250 ml of an aqueous halide solution in which 16 g of potassium bromide and 20 g of sodium chloride were dissolved and $(NH_4)_2RhCl_5(H_2O)$ and $K_3IrCl_6$ were included in amounts equivalent to $4\times10^{-7}$ mol and $1\times10^{-7}$ mol respectively per 1 mol of silver in terms formed grains, were added to an aqueous 2% gelatin solution, in which 4 g of sodium chloride, 0.02 g of 1,3-dimethyl-2-imidazolithion, 0.5 g of citric acid, 4 mg of sodium benzenethiosulfonate, and 1 mg of sodium benzenesulfinate were dissolved in 1 liter of water, at 45° C. over 12 minutes with stirring by using a double jet method, to obtain grains of silver chlorobromide having an average grain size of 0.20 μm and containing silver chloride in a content of 70 mol %, thereby forming a nuclei. In succession, 400 ml of an aqueous silver nitrate solution in which 125 g of silver nitrate was dissolved and 400 ml of an aqueous halide solution in which 26 g of potassium bromide and 34 g of sodium chloride were dissolved, were added to the resulting solution over 20 minutes by using a double jet method.

Thereafter, thereto was added a KI solution in an amount of $1\times10^{-3}$ mole per mole of silver, to perform conversion. The solution was washed with water by a flocculation method according to a usual manner. Specifically, the same process as for the emulsion A was performed. To the emulsion after the water-washing and desalting, was added gelatin in an amount of 40 g per mole of silver, to adjust the pH of the emulsion to 6.0 and the pAg thereof to 7.5. Thereafter, thereto were added 7 mg of sodium benzenethiosulfonate, 2 mg of sodium benzenesulfinate, 8 mg of chlorauric acid and 5 mg of sodium thiosulfate, per mole of silver. The emulsion was heated at 60° C. for 60 minutes to subjected to chemical sensitization. Thereafter, thereto were added 250 mg of 4-hydroxy-6-methyl-1,3,3a,7-tetrazaindene as a stabilizer and 100 mg of PROXEL (trade name) made by ICI Co., Ltd. as an antiseptic. The resultant grains were silver iodochlorobromide cubic grains having an average grain size of 0.28 μm, a coefficient of variation of 10%, and a silver chloride content of 70% by mole. (Finally, the emulsion had the following properties: pH=6.1, pAg=7.5, conductivity=46 μS/m, density=1.20×$10^{-3}$ kg/$m^3$, and viscosity=62 mPa·s)

<Formation of Coated Sample>

Coating solutions were coated onto the below-mentioned polyethylene terephthalate film support having both surface on which moisture-proof undercoat layers containing vinylidene chloride were provided, so that a structure of a UL layer/a hydrazine-containing EM layer/an intermediate layer/a redox-compound-containing EM layer/a protective layer would be formed on the support. Thus, each sample was formed.

The following will describe the methods for preparing raw materials for the respective layers, coating amounts thereof, and coating methods.

(UL Layer)

As the UL layer, 0.3 g/$m^2$ of gelatin (containing PROXEL (trade name) made by ICI Co., Ltd. as an antiseptic), 7.5×$10^{-6}$ mol/$m^2$ of the nucleating accelerator F-30, and 0.25 g/$m^2$ of a polyethyl acrylate dispersed product, and 50 mg/$m^2$ of 1,2-bis(vinylsulfonylacetamido)ethane as a hardener were coated. The pH of the coating solution was adjusted to 5.8.

(Hydrazine-containing EM Layer)

<Preparation of Coating Solution for Hydrazine-containing Layer Emulsion>

To the emulsion A was added a compound having the following structural formula (s-1) in an amount of 5×$10^{-4}$ mol per mole of silver. Furthermore, thereto were added 1×$10^{-3}$ mol of potassium bromide, 5×$10^{-4}$ mol of a mercapto compound represented by the structural formula (a), and a mercapto compound represented by the structural formula (b), 1×$10^{-4}$ mol of a triazine compound represented by the structural formula (c), hydrazine nucleating agents-A, and -B, each in an amount of 1×$10^{-4}$ mol. Thereto were added colloidal silica (trade name: Snow Tex C, made by Nissan Chemical Industries, Ltd.) and a polyethylene acrylate dispersed product in the manner that each of them would be coated in an amount of 500 mg/$m^2$, so as to prepare the coating solution for hydrazine-containing layer. The pH of the solution was adjusted to 5.8.

(S-1)

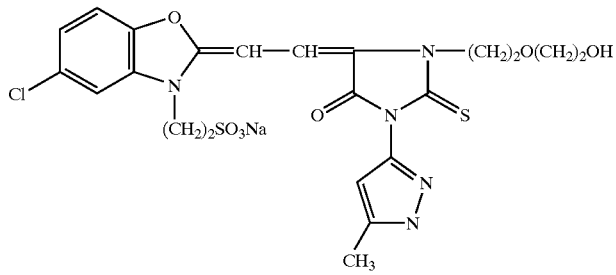

(a)

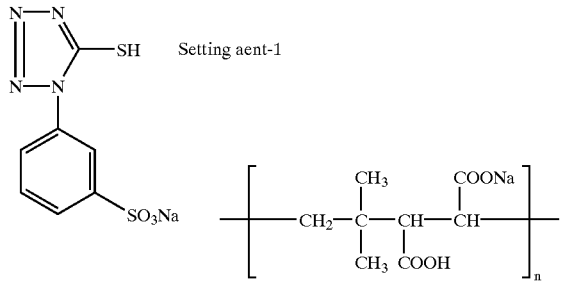

Setting aent-1

Average molecular weight 120,000

(b)

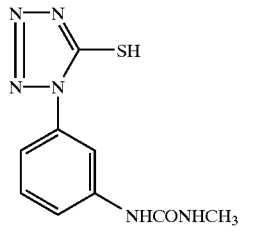

(c)

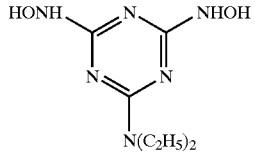

Hydrazine nucleating agent-A

-continued

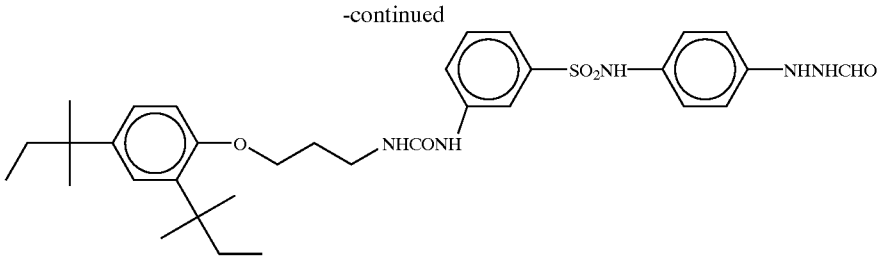

Hydrazine nucleating agent-B

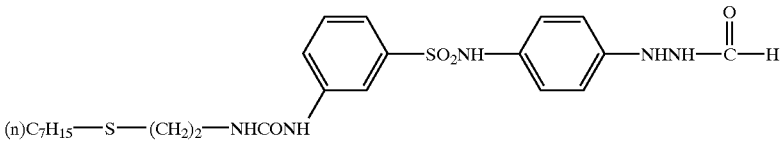

The prepared coating solution for silver halide emulsion was coated in the manner that the amount of silver would be 3.4 g/m$^2$ and the amount of the gelatin would be 1.6 g/m$^2$.

(Intermediate Layer)

<Preparation of Coating Solution for Intermediate Layer>

To a gelatin solution containing PROXEL (trade name) as an antiseptic were added sodium ethanethiosulfonate, a dye represented by the following structural formula (e), hydroquinone, 5-chloro-8-hydroxyquinoline, and a polyethyl acrylate dispersed product in the manner that they were coated in amounts of 5 mg/m$^2$, 50 mg/m$^2$, 100 mg/m$^2$, 10 mg/m$^2$ and 100 mg/m$^2$, respectively. Thus, an intermediate layer coating solution was prepared. The pH of the solution was adjusted to 7.0.

The intermediate layer was coated in the manner that the amount of the gelatin would be 1.0 g/m$^2$.

(Redox Compound-containing EM Layer)

<Preparation of Coating Solution for Redox Compound-containing Layer Emulsion >

To the emulsion B were added a compound having the above-mentioned structural formula (s-1), as a sensitizing dye, in an amount of $1\times10^{-4}$ mole per mole of silver in a redox compound-containing layer emulsion. Thereto were then added $5\times10^{-4}$ mole of a mercapto compound represented by the structural formula (a), and $1\times10^{-4}$ mole of a triazine compound represented by the structural formula (c). Furthermore, thereto were added a dye represented by the following structural formula (f), a polyethyl acrylate dispersed product, and 1,2-bis(vinylsulfonylacetamido)ethane as a hardener in the manner that they would be coated in amounts of 5 mg/m$^2$, 100 mg/m$^2$, and 50 mg/m$^2$, respectively. Thereto was then added the compound for comparison or the exemplified compound for use in the present invention, as a redox compound, as shown in Table 17, in an amount of $2.1\times10^{-4}$ mol/m$^2$. Thus, a redox compound-containing layer emulsion coating solution was prepared. The pH of the solution was adjusted to 5.4.

At this time, the redox compound was added to the coating solution by dissolving at 60° C. the emulsion prepared by the following method.

(Preparation of the Redox Emulsion)

Into 30 ml of ethyl acetate were added 8 g of the redox compound, 0.3 g of sodium p-dodecylbenzenesulfonate, 4 g of oil represented by the following structural formula (P-1), and 4 g of oil represented by the following structural formula (P-2), and they were dissolved at 60° C., so as to prepare an A solution. Into 170 g of water were added 8.5 g of gelatin, and 0.05 g of PROXEL (trade name) made by ICI Co., Ltd., and they were dissolved at 60° C., so as to prepare a B solution. The A solution and the B solution were mixed with each other, and the resultant mixture was subjected to emulsification and dispersion, using a high-speed homogenizer at 60° C. After the emulsification and dispersion, the solvent was removed off at 60° C. under reduced pressure. Thus, an emulsified dispersion containing 4% by weight of the redox compound was obtained.

The prepared redox compound-containing layer emulsion coating solution was coated in the manner that the amount of silver would be 0.4 g/m$^2$ and the amount of the gelatin would be 0.5 g/m$^2$.

(Protective Layer)

The following were coated: 0.2 g/m$^2$ of gelatin, 50 mg/m$^2$ of an amorphous $SiO_2$ matting agent having an average particle size of about 3.5 $\mu$m, 60 mg/m$^2$ of colloidal silica (Snow Tex C, trade name, made by Nissan Chemical Industries, Ltd.), 50 mg/m$^2$ of liquid paraffin, and, as auxiliary coating agents, 1 mg/m$^2$ of a fluorine-based surface-active agent represented by the following structural formula (g) and 10 mg/m$^2$ of sodium p-dodecylbenzenesulfonate.

A viscosity-enhancer represented by the following structural formula (Z) was added to the coating solutions for the respective layers, so as to adjust the viscosity of the solutions.

(a)

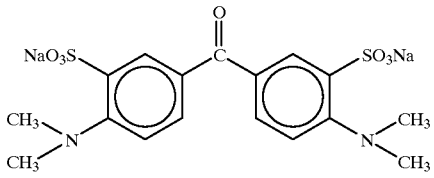

-continued (f)

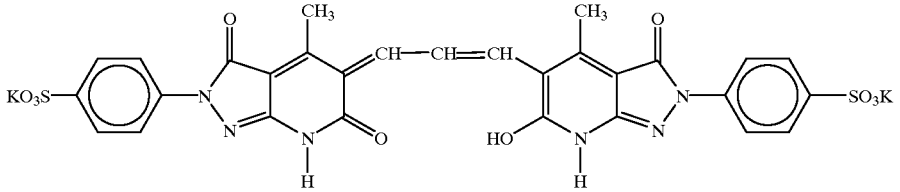

(P-1)

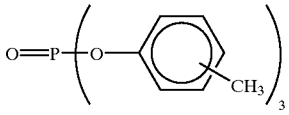

(P-2)

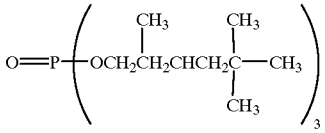

(g)

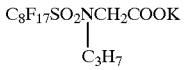

(z)

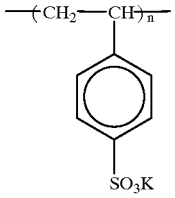

Also, the backing layer was coated using the following composition.

<Backing Layer>

| | |
|---|---|
| Gelatin | 2.8 g/m$^2$ |
| Surfactants: | |
| Sodium p-dodecylbenzenesulfonate | 40 mg/m$^2$ |
| Sodium dihexyl-α-sulfosuccinate | 40 mg/m$^2$ |
| Gelatin hardening agent: | |
| 1,2-bis(vinylsulfonylacetamide)ethane | 200 mg/m$^2$ |
| $SnO_2$/Sb (weight ratio: 90/10, average particle | 200 mg/m$^2$ |

-continued

| | |
|---|---|
| diameter: 0.20 μm) | |
| Dye (a mixture of the following dyes (h-1), (h-2), (h-3) and (h-4)) | |
| Dye (h-1) | 20 mg/m$^2$ |
| Dye (h-2) | 50 mg/m$^2$ |
| Dye (h-3) | 20 mg/m$^2$ |
| Dye (h-4) | 30 mg/m$^2$ |
| Antiseptic agent (PROXEL, trade name) | 10 mg/m$^2$ |

(h-1)

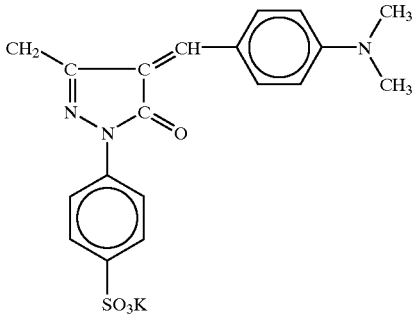

-continued

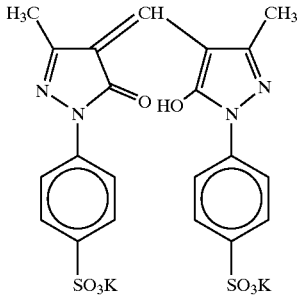

(h-2)

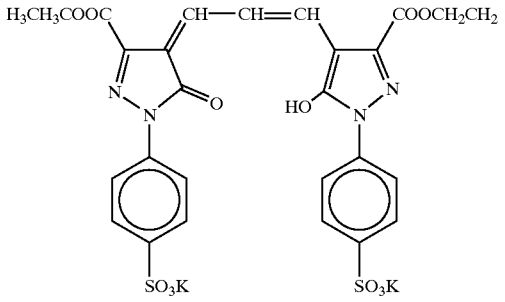

(h-3)

(h-4)

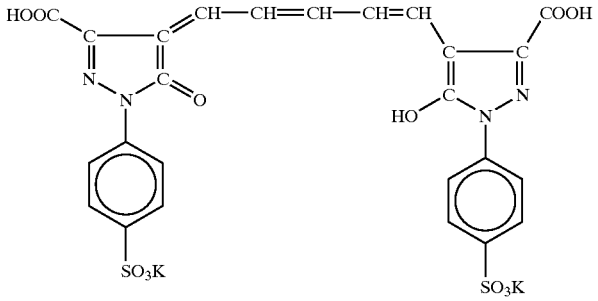

<Back Protective Layer>

| | |
|---|---|
| Gelatin | 1.1 g/m$^2$ |
| Fine particles of a polymethylmethacrylate (average particle size: 2.5 $\mu$m) | 20 mg/m$^2$ |
| Sodium p-dodecylbenzenesulfonate | 15 mg/m$^2$ |
| Sodium dihexyl-$\alpha$-sulfosuccinate | 15 mg/m$^2$ |
| Sodium acetate | 60 mg/m$^2$ |
| Antiseptic agent (PROXEL, trade name) | 1 mg/m$^2$ |

<Support>

First and second undercoat layers having the following compositions were coated to both surfaces of a biaxially-stretched polyethylene terephthalate support (thickness: 100 $\mu$m).

<First Undercoat Layer>

| | |
|---|---|
| Core-shell type vinylidene chloride copolymer ① | 15 g |
| 2,4-dichloro-6-hydroxy-s-triazine | 0.25 g |
| Polystyrene fine particle (average particle size: 3 $\mu$m) | 0.05 g |
| Compound (i) | 0.20 g |
| Colloidal silica (trade name: Snow Tex ZL, made by Nissan Chemical Industries, Ltd, particle size: 70–100 $\mu$m) | 0.12 g |
| Water to make | 100 g |

Furthermore, 10% by mass of KOH was added to the composition, to adjust the pH of the composition to 6. The resultant solution was coated in the manner that the thickness of the resultant dried film would be 0.9 $\mu$m after drying at a drying temperature of 180° C. for 2 minutes.

<Second Undercoat Layer>

| | |
|---|---|
| Gelatin | 1 g |
| Methyl cellulose | 0.05 g |
| Compound (j) | 0.02 g |
| $C_{12}H_{25}O(CH_2CH_2O)_{10}H$ | 0.03 g |
| Antiseptic (PROXEL, trade name) | $3.5 \times 10^{-3}$ g |
| Acetic acid | 0.2 g |
| Water to make | 100 g |

This coating solution was coated in the manner that the thickness of the resultant dried film would be 0.1 $\mu$m after drying at a drying temperature of 170° C. for 2 minutes.

Core/shell-type vinylidene chloride copolymer ①

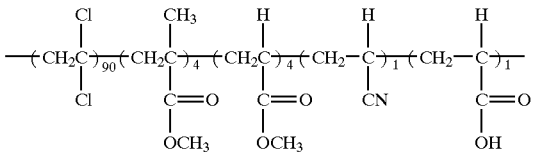

VDC MMA MA AN AA

Core: VDC/MMA/MA (80 wt. %)
Shell: VDC/AN/AA (20 " )
Average particle size: 70 nm Compound (i)

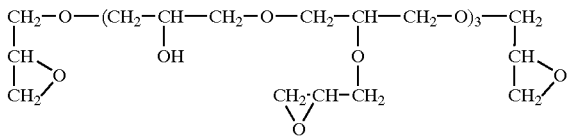

Compound (j)

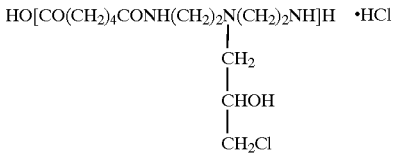

<Coating Method>

On the emulsion-coated surface side of the support that had been provided the above-mentioned undercoat layers, five layers, which were the UL layer, the hydrazine-containing EM layer, the intermediate layer, the redox compound-containing EM layer, and the protective layer were simultaneously multilayer-coated, in this order from the support, in a slide bead coater manner while a hardener solution was added thereto under keeping the temperature at 35° C. The resultant coated film was passed through a cold wind setting zone (5° C.). Thereafter, on the side opposite to the emulsion-coated surface side, the backing layer and the back protective layer were simultaneously multilayer-coated, in this order from this support, in a curtain coater manner while a hardener solution was added thereto. The resultant coated film was passed through a cold wind setting zone (5° C.). When the resultant coated film was passed through each of the cold wind setting zones, the coated solution exhibited sufficient capability of being set. Subsequently, in a drying zone both of the two surfaces of the resultant coated film were simultaneously dried under the following drying conditions. From the end of the coating on the backing surface side to winding of the resultant coated film, the product was carried without contact with a roller or any other member. At this time, the speed of the coating was 120 m/minute.

<Drying Conditions>

After the setting, the above-dried, coated film was dried with dry wind having a temperature of 30° C. until the mass ratio of water/gelatin was 800%. The resultant coated film was dried with dry wind having a temperature of 35° C. and 30% RH (relative humidity) from the mass ratio of 800% to a mass ratio of 200%. The dry wind continued to be applied to the coated film. After 30 seconds from the time when the surface temperature was 34° C. (the time was regarded as the drying was completed), the resultant coated film was dried with air having a temperature of 48° C. and 2% RH for 1 minute. At this time, the time for the drying was as follows: 50 seconds from the start of the drying to the water/gelatin mass ratio of 800%; 35 seconds from the mass ratio of 800% to the mass ratio of 200%; and 5 seconds from the mass ratio of 200% to the end of the drying.

The thus-prepared light-sensitive material was wound at 25° C. and 55% RH. Then, the light-sensitive material was cut in the same environment. After the humidity of this material was adjusted at 25° C. and 50% RH for 8 hours, the light-sensitive material and a cardboard whose humidity was adjusted at 25° C. and 50% RH for 2 hours were airtightly put into a barrier bag whose humidity was adjusted for 6 hours. Thus, each sample shown in Table 17 was prepared.

The humidity in the barrier bag was measured. As a result, the humidity was 53% RH. The pH of the film surface of the emulsion layer side of the resultant samples was 5.5–5.8.

Evaluations were performed by the following methods.

<Halftone, and Dot Quality>

Each resultant sample was adhered closely at the emulsion layer side to a Contact Screen Gray Scanner Negative No. 2 (trade name, made by Dainippon Screen Mfg. Co., Ltd.) having 150 lines/inch, and the resultant adhered product was exposed to light from a tungsten light source through a step wedge.

A developing solution (A) and a fixing solution (B) having the following compositions were used to process the light-sensitive material at 35° C. for 30 seconds by means of an FG-680AG Automatic Processor (trade name) made by Fuji Photo Film Co., Ltd.

Formulation of the Developing Solution (A)
(The composition per liter of a concentrated solution thereof is shown.)

| | |
|---|---|
| Potassium hydroxide | 60.0 g |
| Diethylenetriamine · 5 acetic acid | 3.0 g |
| Potassium carbonate | 90.0 g |
| Sodium metabisulfite | 105.0 g |
| Potassium bromide | 10.5 g |
| Hydroquinone | 60.0 g |
| 5-methylbenzotriazole | 0.53 g |
| 4-hydroxymethyl-4-methyl-1-phenyl-3-pyrazolidone | 2.3 g |
| Sodium 3-(5-mercaptotetrazole-1-yl)benzenesulfonate | 0.15 g |
| Sodium 2-mercaptobenzoimidazole-5-sulfonate | 0.45 g |
| Sodium erysorbate | 9.0 g |
| Diethylene glycol | 7.5 g |
| pH | 10.79 |

For use of the solution (A), 2 parts of the above-mentioned concentrated solution were diluted with 1 part of water to prepare a mother solution. The pH of the mother solution was 10.65. Four parts of the above-mentioned concentrated solution were diluted with 3 parts of water to prepare a replenishing solution. The pH of the replenishing solution was 10.62.

Formulation of the Developing Solution (B)
(The composition per liter of a concentrated solution thereof is shown.)

| | |
|---|---|
| Ammonium thiosulfate | 360 g |
| Etylenediamine · tetraacetic acid · 2 Na · 2 hydrate salt | 0.09 g |
| Sodium thiosulfate · 5 hydrate salt | 33.0 g |
| Sodium metadisulfite | 57.0 g |
| Sodium hydroxide | 37.2 g |
| Acetic acid (100%) | 90.0 g |
| Tartaric acid | 8.7 g |
| Sodium gluconate | 5.1 g |
| Aluminum sulfate | 25.2 g |
| pH | 4.85 |

For use of the solution (B), 1 part of the above-mentioned concentrated solution was diluted with 2 parts of water. The pH of the solution for use was 4.8.

Halftone

The halftone (the logarithm-indicated ratio between the exposure amount for giving a dot area of 95% and the exposure amount for giving a dot area of 5%) of the obtained dot image was measured. It is shown that as the value of the halftone is larger, the latitude for exposure is wider and reproducibility of an image is better.

Dot Quality

Dots were observed with a loupe of 100 magnifications, and the quality of the obtained dots was evaluated.

The result of dot quality was rated 5 ranks ranging 5 to 1 as: "5": high dot density, and good edge sharpness (definition); "1": low contrast and poor definition; and "3": the dot quality is a level practicable for originals for photoengraving.

<Evaluation of Practice Density>

A photocomposing paper PR-100WP (trade name) made by Fuji Photo Film Co., Ltd. was used to make an original having lines of 40 μm in width. A camera for photographing on a mount sheet, Companica C-690 (trade name) made by Dainippon Screen Mfg. Co., Ltd. was used to photograph this original onto the coated sample. The sample was then developed under the above-mentioned processing conditions. The density of black solid portions when the width of lines of the resultant sample was 40 μm was defined as the maximum practice density Dmax.

The practice density based on an exhausted solution was obtained by processing using the following exhausted solution instead of the above-mentioned developing solution. As the exposure amount in this case, a value when the width of lines of the sample was made to 40 μm by the above-mentioned developing solution was used. Method of preparation for the exhausted solution With the above-mentioned developing solution, 300 encyclopedia-sized scanner films HL (trade name) made by Fuji Photo Film Co., Ltd. and blackened by 80% per day were processed while 50 ml of the developing solution was replenished in an amount of 50 ml per encyclopedia-size (50.8×61 cm). This operation was continuously performed for 4 days so that a large number of films were processed. Thus, a developing solution whose pH was lowered to 10.2 and whose bromide ion concentration increased was obtained.

The obtained results are shown in Table 17.

The light-sensitive materials of the present invention (Nos. 4–11) were excellent in halftone and dot quality. The practice density based on the exhausted solution was also remarkably high, and the processing stability of the materials was excellent. The sample Nos. 4 to 8 using the exemplified compounds-1, -2, -4, -5 and -11 according to the present invention were particularly excellent.

On the other hand, the samples No. 1 to 3 using the compounds for comparison were poor in dot quality, and the practice density based on the exhausted solution was quite low in an impracticable level.

The light-sensitive materials No. 1 to 11 had a high sensitivity and a high contrast. Even if they were developed with the above-mentioned exhausted solution, the fluctuation in the sensitivity and γ was small.

TABLE 17

| Sample No. | Redox compound | pKa value by the PUG group | Halftone | Dot quality | Practice density New solution | Practice density Exhausted solution | Remarks |
|---|---|---|---|---|---|---|---|
| 1 | Comparative compound (A) | 11.2 | 1.40 | 3.5 | 4.2 | 2.3 | Comparative example |
| 2 | Comparative compound (B) | 10.6 | 1.39 | 3 | 4.6 | 2.4 | Comparative example |
| 3 | Comparative compound (C) | 11.7 | 1.40 | 3 | 4.4 | 2.2 | Comparative example |
| 4 | Exemplified compound-1 | 10.5 | 1.42 | 5 | 5.5 | 5.1 | This invention |
| 5 | Exemplified compound-2 | 9.8 | 1.43 | 5 | 5.6 | 5.3 | This invention |
| 6 | Exemplified compound-4 | 9.8 | 1.40 | 4.5 | 5.4 | 4.7 | This invention |
| 7 | Exemplified compound-5 | 9.9 | 1.42 | 5 | 5.6 | 5.3 | This invention |
| 8 | Exemplified compound-11 | 10.7 | 1.41 | 4.5 | 5.5 | 5.2 | This invention |
| 9 | Exemplified compound-17 | 9.4 | 1.41 | 4 | 5.0 | 4.6 | This invention |
| 10 | Exemplified compound-19 | 10.9 | 1.40 | 4 | 5.1 | 4.5 | This invention |
| 11 | Exemplified compound-24 | 10.9 | 1.40 | 4 | 5.1 | 4.5 | This invention |

Compounds for comparison (A)

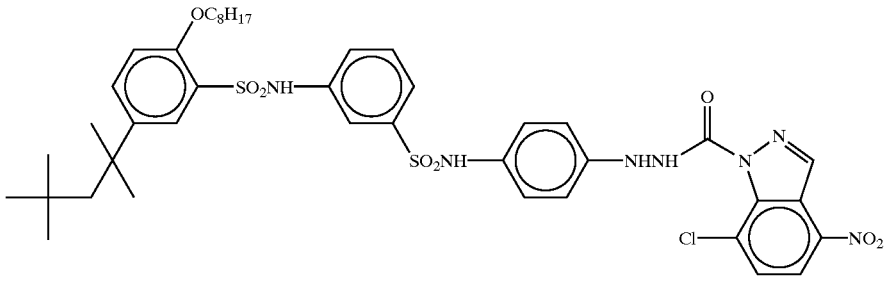

Compound R-27 described in JP-A-9-269553

(B)

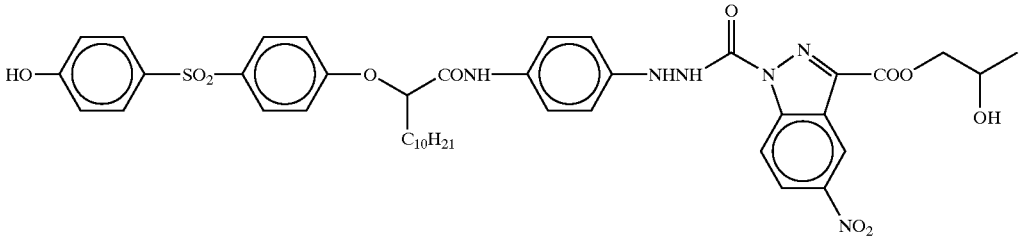

Compound R-34 described in JP-A-9-269553

(C)

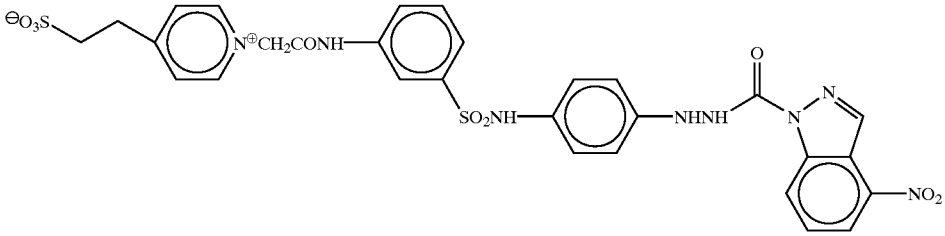

Compound (3) described in JP-A-9-2647639

Example 2

The experiment was carried out in the same manner as in Example 1, except that the following solid developing agent (C) and solid fixing agent (D) were used. As a result, similarly in Example 1, the light-sensitive material samples of the present invention exhibited good performances.

| Preparation of the solid developing agent (C) | |
|---|---|
| Sodium hydroxide (beads) 99.5% | 11.5 g |
| Potassium sulfite (crude power) | 63.0 g |
| Sodium sulfite (crude powder) | 46.0 g |
| Potassium carbonate | 62.0 g |
| Hydroquinone (briquette) | 40.0 g |

The following were combined and made into a briquette.

| | |
|---|---|
| Diethylenetriamine · 5 acetic acid | 2.0 g |
| 5-Methylbenzotriazole | 0.35 g |
| 4-Hydroxymethyl-4-methyl-1-phenyl-3-pyrazolidone | 1.5 g |
| 4-(N-carboxymethyl)-N-methylamino-2,6-dimercaptopyrimidine | 0.2 g |
| Sodium 3-(5-mercaptotetrazole-1-yl) benzenesulfonate | 0.1 g |
| Sodium erysorbate | 6.0 g |
| Potassium bromide | 6.6 g |
| Water to make | 1 liter |
| pH | 10.65 |

About the products in the form of the crude powder, ordinary industrial products were used as they were, and about beads of the alkali metal salt, a commercially available product was used.

About the product in the form of the briquette, the product was compressed into a plate, using a briquetting machine, the plate was crushed, and the crushed pieces were used. About the minor components, the respective components were blended with each other, and the blend was made into a briquette.

Ten liters of the prepared agent was filled into a folding container made of high-density polyethylene, and its opening was sealed up with an aluminum seal. For dissolution and replenishment, a dissolving and replenishing machine having an automatic opening mechanism, as disclosed in JP-A-9-80718 and JP-A-9-138495, was used.

Preperation of the solid fixing solution (D)

| A agent (solid) | |
|---|---|
| Ammonium thiosulfate (compact) | 125.0 g |
| Anhydrous sodium thiosulfate (crude powder) | 19.0 g |
| Sodium metadisulfite (crude powder) | 18.0 g |
| Anhydrous sodium acetate (crude powder) | 42.0 g |
| B agent (liquid) | |
| Etylenediamine · tetraacetic acid · 2 Na · 2 hydrate salt | 0.03 g |
| Tartaric acid | 2.9 g |
| Sodium gluconate | 1.7 g |
| Aluminum sulfate | 8.4 g |
| Sulfuric acid | 2.1 g |
| Water to make | 50 ml |

The A agent and the B agent were dissolved into water, then the amount of the solution was made to 1 liter. This solution was used as the fixing solution (D). The pH thereof was 4.8.

Ammonium thiosulfate was made into flakes by a spray-drying process, the flakes were compressed with a roller compacter, and the compressed flakes were crushed into shape-undecided chips having a size of about 4 to 6 mm. The resultant chips of ammonium thiosulfate (conmpact) were mixed with anhydrous sodium thiosulfate. About the other crude powders, ordinary industrial products were used.

Ten liters of each of the A agent and the B agent was filled into a folding container made of high-density polyethylene, respectively. The opening for taking out the A agent was sealed up with an aluminum seal. The opening in the container for the B agent was closed with a screw cap. For dissolution and replenishment, a dissolving and replenishing machine having an automatic opening mechanism, as disclosed in JP-A-9-80718 and JP-A-9-138495, was used.

Example 3

The experiment was carried out in the same manner as in Example 1, except that the following developing solution (E) was used instead of the developing solution (A) in Example 1. As a result, similarly in Example 1, the light-sensitive material samples of the present invention exhibited good performances.

The composition per liter of a concentrated solution of the developing solution (E) is shown below.

| | |
|---|---|
| Potassium hydroxide | 105.0 g |
| Diethylenetriamine · 5 acetic acid | 6.0 g |
| Potassium carbonate | 120.0 g |
| Sodium metabisulfite | 120.0 g |
| Potassium bromide | 9.0 g |
| Hydroquinone | 75.0 g |
| 5-methylbenzotriazole | 0.25 g |
| 4-hydroxymethyl-4-methyl-1-phenyl-3-pyrazolidone | 1.35 g |
| 4-(N-carboxymethyl-N-methylamino)-2,6-dimercaptopyrimidine | 0.3 g |
| Sodium 2-mercaptobenzoimidazole-5-sulfonate | 0.45 g |
| Sodium erysorbate | 9.0 g |
| Diethylene glycol | 60.0 g |
| pH | 10.7 |

For use, 1 part of the above-mentioned concentrated solution was diluted with 2 parts of water. The pH of the solution for use was 10.5.

Example 4

Images obtained with the light-sensitive material samples of the present invention in Example 1 were evaluated by the following method. As a result, good performances were obtained.

1. Evaluation of an Quality of Enlarged (Division-extension) Image (1) Formation of an original Monochrome scanner SCANART 30 (trade name) and an exclusive light-sensitive material SF-100 (trade name), made by Fuji Photo Film Co., Ltd., were used, to form a permeable portrait image composed of dots, and a step wedge whose dot percentage was gradually changed. At this time, the number of screen lines was made to 150 lines/inch.

(2) Photographing

The original was set to a process camera Fine Zoom C-880 (trade name), processed by a camera-integrated type automatic processor LD-281Q (trade name) made by Dainippon Screen Mfg. Co., Ltd., so as to have an equivalent enlargement magnification. Thereafter, light from a Xe lamp was irradiated to expose each sample for evaluation. At this time, the exposure was performed in the manner that the exposure amount was controlled to be 10% on each sample on 90% area of the step wedge of the original.

(3) Evaluation

The gradation reproduction (difficulty in causing dullness of the dots) of a shadow area on each sample wherein the dot percentage of its small dot side (highlighted area) was adjusted by controlling the exposure amount as described in the above-mentioned item (2) was evaluated with naked eyes.

2. Evaluation of Copy Dots (1) Formation of an original

Monochrome scanner SCANART 30 (trade name) and an exclusive light-sensitive material SP-100WP (trade name), each made by Fuji Photo Film Co., Ltd., were used, to form a step wedge whose dot percentage was gradually changed. The number of screen lines at the time of exposure was made to 150 lines/inch.

(2) Photographing

The above-mentioned original and each sample were set on prescribed position to a process camera C-690 (Auto Companica) made by Dainippon Screen Mfg. Co., Ltd. and light was irradiated onto the reflex original to perform photographing. At this time, the exposure was performed in the manner that the exposure amount was controlled to be 20% on the sample on 80% area of the step wedge of the original. The developing solution (A) and the fixing solution (B) in Example 1 were used to develop each sample in FG-460A Automatic Processor (trade name) made by Fuji Photo Film Co., Ltd. at 35° C. for 30 seconds.

(3) Evaluation

The gradation reproduction (difficulty in causing dullness of the dots) of a shadow area on each sample wherein the dot percentage of its highlighted area was adjusted by controlling the exposure time as described in the above-mentioned item (2) was evaluated with naked eyes.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material, comprising at least one compound represented by formula (1):

Formula (1)

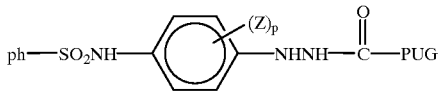

wherein PUG represents a nitrogen-containing heterocyclic group which is bonded to the adjacent carbonyl group through a nitrogen atom, the heterocyclic group is a heterocyclic group which directly or indirectly has at least one nitro group as its substituent(s) and can give a pKa value of 9 to 11, ph represents a phenyl group and directly or indirectly has at least one dissociating group as its substituent(s), Z represents a substituent which is capable of substitution on the benzene ring, and p is an integer of 0 to 4.

2. The silver halide photographic light-sensitive material according to claim 1, wherein the heterocyclic group represented by PUG is selected from indazoles.

3. The silver halide photographic light-sensitive material according to claim 1, wherein the dissociating group capable of direct or indirect substitution on the ph group is a benzenesulfonamido group having, as its substituent(s), at least one electron withdrawing group.

4. The silver halide photographic light-sensitive material according to claim 1, wherein the compound represented by the formula (1) has, as its ballasting group(s), at least one group having as a moiety an alkyl or alkylene group having 9 or more carbon atoms.

5. The silver halide photographic light-sensitive material according to claim 1, which comprises at least one nucleating agent.

6. The silver halide photographic light-sensitive material according to claim 5, which comprises at least one nucleation accelerator.

7. The silver halide photographic light-sensitive material according to claim 5, which has a first silver halide emulsion layer and a second silver halide emulsion layer in this order on a support, wherein the first silver halide emulsion layer or a hydrophilic colloidal layer adjacent thereto contains the at least one nucleating agent, and wherein the second silver halide emulsion layer or a hydrophilic colloidal layer adjacent thereto contains the compound represented by the formula (1).

8. The silver halide photographic light-sensitive material according to claim 5, which has a first silver halide emulsion layer and a second silver halide emulsion layer in this order on a support, wherein the first silver halide emulsion layer or a hydrophilic colloidal layer adjacent thereto contains the compound represented by the formula (1), and wherein the second silver halide emulsion layer or a hydrophilic colloidal layer adjacent thereto contains the at least one nucleating agent.

9. The silver halide photographic light-sensitive material according to claim 5, wherein the at least one nucleating agent is a hydrazine derivative represented by formula (D):

Formula (D)

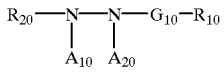

wherein $R_{20}$ represents an aliphatic group, an aromatic group, or a heterocyclic group; $R_{10}$ represents a hydrogen atom or a blocking group; $G_{10}$ represents a —CO—, —COCO—, —C(=S)—, —$SO_2$—, —SO—, or —PO($R_{30}$)— group (in which $R_{30}$ is selected from the same range of groups for $R_{10}$ as defined above, and $R_{30}$ and $R_{10}$ may be the same or different), or an iminomethylene group; $A_{10}$ and $A_{20}$ each represent a hydrogen atom, or one of $A_{10}$ and $A_{20}$ is a hydrogen atom and the other is a substituted or unsubstituted alkylsulfonyl group, a substituted or unsubstituted arylsulfonyl group, or a substituted or unsubstituted acyl group.

10. The silver halide photographic light-sensitive material according to claim 1, which comprises a silver halide emulsion containing cubic silver chlorobromide or silver chlorobromoiodide grains having a silver chloride content of 50 mol % or more.

11. The silver halide photographic light-sensitive material according to claim 1, wherein the compound represented by formula (1) contains an alkyl-, aryl- or heterocyclic-thio group that is substituted on the group represented by ph in formula (1) directly or indirectly.

12. The silver halide photographic light-sensitive material according to claim 1, wherein the compound represented by formula (1) is used in an amount ranging from $1\times10^{-6}$ to $5\times10^{-2}$ mol, per mol of silver halide.

13. The silver halide photographic light-sensitive material according to claim 1, wherein the compound represented by formula (1) is being introduced by dissolving in at least one water-miscible organic solvent selected from the group consisting of alcohols, ketones, dimethylformamide, dimethyl sulfoxide and methyl cellosolve.

14. A method of processing a silver halide photographic light-sensitive material, which comprises the step of developing the silver halide photographic light-sensitive material according to claim 1, with a developing solution having a pH of 9.0–11.0, after imagewise exposure to light.

15. The method of processing according to claim 14, wherein the developing step is carried out with a solid developing agent.

16. The method of processing according to claim 14, wherein the processing time is from 25 to 160 seconds in terms of dry-to-dry time.

17. The method of processing according to claim 14, wherein the developing step is carried out in the development time of 40 seconds or less.

* * * * *